US009765951B2

(12) United States Patent
Zhang et al.

(10) Patent No.: US 9,765,951 B2
(45) Date of Patent: Sep. 19, 2017

(54) METHOD FOR CONSTRUCTING UNIVERSAL LED BULB, FLANGE INNER SNAP RING TYPE LED BULB AND LAMP

(71) Applicant: GUIZHOU GZGPS CO., LTD, Guiyang, Guizhou (CN)

(72) Inventors: Jiqiang Zhang, Guizhou (CN); Zheyuan Zhang, Guizhou (CN)

(73) Assignee: GUIZHOU GZGPS CO., LTD., Guiyang, Guizhou (CN)

( * ) Notice: Subject to any disclaimer, the term of this patent is extended or adjusted under 35 U.S.C. 154(b) by 69 days.

(21) Appl. No.: 14/416,389

(22) PCT Filed: Jul. 23, 2013

(86) PCT No.: PCT/CN2013/000878
§ 371 (c)(1),
(2) Date: Jan. 22, 2015

(87) PCT Pub. No.: WO2014/015654
PCT Pub. Date: Jan. 30, 2014

(65) Prior Publication Data

US 2015/0204521 A1 Jul. 23, 2015

(30) Foreign Application Priority Data

Jul. 23, 2012 (CN) ..... 2012 1 0253482
Jul. 23, 2012 (CN) ..... 2012 1 0253512
(Continued)

(51) Int. Cl.
*F21V 17/16* (2006.01)
*F21V 21/28* (2006.01)
(Continued)

(52) U.S. Cl.
CPC ..... *F21V 17/168* (2013.01); *F21K 9/20* (2016.08); *F21K 9/232* (2016.08); *F21S 8/03* (2013.01);
(Continued)

(58) Field of Classification Search
CPC ..... F21V 17/06; F21V 29/50; F21V 29/70; F21V 29/74; F21V 15/01; F21V 21/03;
(Continued)

(56) References Cited

FOREIGN PATENT DOCUMENTS

CN 201582681 U 9/2010
CN 102213370 A 10/2011
(Continued)

OTHER PUBLICATIONS

International Search Report for International Application PCT/CN2013/000878 dated Oct. 31, 2013 (Oct. 31, 2013) along with an English translation thereof.

*Primary Examiner* — Mary Ellen Bowman
(74) *Attorney, Agent, or Firm* — Nath, Goldberg & Meyer; Joshua B. Goldberg; Christopher Thomas

(57) ABSTRACT

The present invention discloses a method for constructing a universal LED bulb, a flange snap ring type LED bulb and a lamp. A heat conductive bracket (3) with a flange is used as a structure supporting main body of the bulb to establish an optical engine core member of the LED bulb. An inner snap ring (81) fixed to the heat conductive bracket (3) is used to support the optical engine core member in an auxiliary manner. The optical engine core member is composed of the heat conductive bracket (3), an optical engine module (4), the inner snap ring (81), an inner cover (6), an electric connector (11) and a light distribution optical lens (7). The optical engine module (4) is made up of an optical engine die
(Continued)

plate, an LED chip and a relevant wiring by bonding and packaging, or is further integrated with a power supply drive chip.

21 Claims, 41 Drawing Sheets

(30) Foreign Application Priority Data

| | | |
|---|---|---|
| Jul. 23, 2012 | (CN) | 2012 1 0253599 |
| Jul. 23, 2012 | (CN) | 2012 1 0253684 |
| Jul. 23, 2012 | (CN) | 2012 1 0253766 |
| Jul. 23, 2012 | (CN) | 2012 1 0253769 |
| Jul. 23, 2012 | (CN) | 2012 1 0253843 |
| Jul. 23, 2012 | (CN) | 2012 1 0253844 |
| Jul. 23, 2012 | (CN) | 2012 1 0253914 |

(51) Int. Cl.

| | |
|---|---|
| ***F21V 29/00*** | (2015.01) |
| ***F21S 8/00*** | (2006.01) |
| ***F21V 23/06*** | (2006.01) |
| ***F21V 29/70*** | (2015.01) |
| ***F21V 29/74*** | (2015.01) |
| ***F21V 29/83*** | (2015.01) |
| ***F21S 8/08*** | (2006.01) |
| ***F21V 5/04*** | (2006.01) |
| ***F21V 9/16*** | (2006.01) |
| ***F21V 17/12*** | (2006.01) |
| ***F21V 21/00*** | (2006.01) |
| ***F21V 31/00*** | (2006.01) |
| ***F21K 9/20*** | (2016.01) |
| ***F21K 9/232*** | (2016.01) |
| *F21W 111/02* | (2006.01) |
| *F21Y 113/00* | (2016.01) |
| *F21W 131/103* | (2006.01) |
| *F21Y 115/10* | (2016.01) |

(52) U.S. Cl.

CPC ..... *F21S 8/085* (2013.01); *F21V 5/048* (2013.01); *F21V 9/16* (2013.01); *F21V 17/12* (2013.01); *F21V 21/00* (2013.01); *F21V 21/28* (2013.01); *F21V 23/06* (2013.01); *F21V 29/004* (2013.01); *F21V 29/70* (2015.01); *F21V 29/74* (2015.01); *F21V 29/83* (2015.01); *F21V 31/005* (2013.01); *F21W 2111/02* (2013.01); *F21W 2131/103* (2013.01); *F21Y 2113/00* (2013.01); *F21Y 2115/10* (2016.08); *Y10T 29/49117* (2015.01)

(58) Field of Classification Search

CPC ..... F21V 21/30; F21V 31/00; F21K 9/135; F21K 9/30; F21S 8/00

See application file for complete search history.

(56) References Cited

FOREIGN PATENT DOCUMENTS

| | | | |
|---|---|---|---|
| CN | 202100978 | U | 1/2012 |
| CN | 202125839 | U | 1/2012 |
| CN | 102777822 | A | 11/2012 |
| CN | 102777824 | A | 11/2012 |
| CN | 102777826 | A | 11/2012 |
| CN | 102777832 | A | 11/2012 |
| CN | 102798009 | A | 11/2012 |
| CN | 102818172 | A | 12/2012 |
| CN | 102818179 | A | 12/2012 |
| CN | 102829391 | A | 12/2012 |
| CN | 102927463 | A | 2/2013 |
| JP | 2011-114094 | A | 6/2011 |

METHOD FOR CONSTRUCTING UNIVERSAL LED BULB, FLANGE INNER SNAP RING TYPE LED BULB AND LAMP

This is a National Phase Application filed under 35 U.S.C. 371 as a national stage of PCT/CN2013/000878, filed Jul. 23, 2013, an application claiming the benefit of Chinese Application No. 201210253844.8, filed Jul. 23, 2012, Chinese Application No. 201210253914.X, filed Jul. 23, 2012, Chinese Application No. 201210253482.2, filed Jul. 23, 2012, Chinese Application No. 201210253684.7, filed Jul. 23, 2012, Chinese Application No. 201210253599.0, filed Jul. 23, 2012, Chinese Application No. 201210253769.5, filed Jul. 23, 2012, Chinese Application No. 201210253512.X, filed Jul. 23, 2012, Chinese Application No. 201210253843.3, filed Jul. 23, 2012 and Chinese Application No. 201210253766.1, filed Jul. 23, 2012, the content of each of which is hereby incorporated by reference in its entirety.

FIELD OF THE INVENTION

The present invention relates to a method for constructing a universal LED bulb, a flange inner snap ring type LED bulb and a lamp, which involves the field of LED lighting technology.

BACKGROUND OF THE INVENTION

As a new generation of lighting technology, LED semiconductor lighting has five energy-saving advantages incomparable by the existing other lighting technologies, such as high photoelectric conversion efficiency, easy control of light source direction, easy control of lighting time and manner, high light source color rendering property, and a high power factor under reasonable design, thus being warmly welcomed by worldwide investors and vigorously supported by the governments of all countries. The luminous efficiency of most current LED lamps may exceed 70 LM/W, thus having better energy saving advantages than the traditional energy saving lamps. The luminous efficiency of green LEDs may be up to 683 LM/W theoretically; the theoretical efficiency of white LED is also up to 182.45 LM/W, so the improvement space of LED lighting efficiency is huge.

In the current design of high power LED lighting products, especially high power LED lamps, due to heat dissipation, when a high power LED lamp is assembled, an LED light module, a driving power supply and a lighting fitting are integrally designed, namely such components as the LED light module, the driving power supply and the lighting fitting must be produced collectively, thus forming a so-called situation of "LED having lamp while lacking bulb". This brings a series of fatal problems to the LED lighting products, such as high manufacturing cost, inconvenience for use, maintenance difficulty, and the like. First of all, national and even global uniform standardized production could not be achieved on manufacture, leading to numerous product specifications, few batches and high prices; second, the products of producers are varied, not universal, let alone interchangeable; third, the LED light module, the driving power supply, the lighting fitting and the like need to be integrally detached for maintenance in the case of product failure, thus the maintenance is very inconvenient, and such defects as expanded failure, delayed maintenance and high maintenance cost and the like are very liable to form. These defects greatly restrict the popularization and use of LED lighting and are inherent problems in the popularization of the LED lighting products.

SUMMARY OF THE INVENTION

The object of the present invention is to provide a method for constructing a universal LED bulb, a flange inner snap ring type LED bulb and a lamp. It is simple and stable in structure, convenient to install, capable of being provided with a radiator to independently operate and may also be installed on a radiator of the lamp, thus being used flexibly. By adopting the present invention, the LED bulb is independently produced and used with such products as lamp and lighting control and the like on production, thereby greatly reducing the production procedures of the LED lighting products, improving mass production and facilitating the industrialization of LED energy-saving lighting products.

The technical solutions of the present invention are as follows: a method for constructing a universal LED bulb, including: establishing an optical engine core member of the LED bulb using a heat conductive bracket with a flange as the structure supporting main body of the bulb, supporting the optical engine core member of the LED bulb in an auxiliary manner using an inner snap ring fixed to the heat conductive bracket, and using the inner snap ring as an installation base of a lens snap ring, wherein the LED bulb optical engine core member is composed of the heat conductive bracket, an optical engine module, the inner snap ring and a light distribution optical lens, an inner cover is provided outside the optical engine module, and an electric connector is provided to the heat conductive bracket; the optical engine module is made up of an optical engine die plate, an LED chip set and a relevant wiring by bonding and packaging, or is further integrated with a power supply drive chip. The optical engine die plate is a normalized heat conductive substrate.

In the above-mentioned method for constructing the universal LED bulb, the diameter of the heat conductive bracket is a bulb outer diameter D, the bulb outer diameter D and an upper limit of the power W of the constructed LED bulb satisfy a relationship $W=1.1812e^{0.0361D}$, discrete values are selected for the diameter D on the relationship curve $W=1.1812e^{0.0361D}$ to construct a plurality of LED bulbs with fixed bulb outer diameters D, in order to improve the interchangeability and universality of the LED bulbs; on the relationship curve $W=1.1812e^{0.0361D}$, 20 mm is used as the lower limit of the bulb outer diameter D, 130 mm is used as the upper limit, each 10 mm is set as a segment, the relationship curve is divided into 12 segments to form limited bulb outer diameter specifications, and the interchangeability and universality of the LED bulbs are further improved by the small amount of bulb outer diameter specifications; flange fixing holes on the installation flange of the lens snap ring are uniformly distributed at a diameter D1, and the diameter D1 is a value obtained by subtracting a diameter of a fixing screw cap and then subtracting a margin of 0.8-4 mm from the bulb outer diameter D; the diameter D2 of a radiator interface opening of the LED bulb on a lamp is a value obtained by subtracting two times of a diameter of a fixing screw cap and then subtracting two times of the margin corresponding to the diameter D1 from the bulb outer diameter D. The installation interface of the LED bulb includes a surface in contact with the LED bulb and a hole connected to the LED bulb, on the lamp.

In the foregoing method for constructing the universal LED bulb, the heat conductive bracket is combined and adhered with the optical engine module integrally, the inner snap ring surrounds the optical engine module, or an inner ring cover is further provided between the inner snap ring and the inner cover; the upper part of the inner snap ring is connected to the heat conductive bracket, the lower part of the inner snap ring is adhered with the light distribution optical lens, for sealing the optical engine module in a sealed waterproof space among the heat conductive bracket, the inner snap ring and the light distribution optical lens, or the inner snap ring is further used as the installation base of an LED bulb radiator; the lens snap ring fastens the light distribution optical lens and is fixed to the outer diameter of the inner snap ring; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology. Due to this structure, the structure between the LED light source chip and the radiator is simpler, heat generated by the chip will be quickly transferred to the optical engine die plate for dispersion, thus being conducive to cool the LED chip and prolong the service life of the LED light source.

In the foregoing method for constructing the universal LED bulb, for a small size LED bulb, the heat conductive bracket, the optical engine module, the inner snap ring and the light distribution optical lens are sequentially overlapped and adhered to form an integral LED bulb optical engine core member, or the inner ring cover is further provided between the inner snap ring and the inner cover, and components packaged on the optical engine die plate in the optical engine module are packaged in the sealed waterproof space among the heat conductive bracket, the inner snap ring and the light distribution optical lens; or, the inner cover and the inner snap ring are of an integral structure (namely, an inner cover with the function of the inner snap ring), the components packaged on the optical engine die plate are packaged in the waterproof space between the optical engine die plate and the integral structure formed by the inner cover and the inner snap ring; or the inner snap ring is further used as the installation base of the LED bulb radiator; the lens snap ring fastens the light distribution optical lens, and in order to prevent accidental drop-off of the lens, a lens snap ring fixing screw is provided for fixing the lens snap ring on the outer diameter of the inner snap ring; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate, in which a circuit is embedded by silver paste printed circuit technology.

In the foregoing method for constructing the universal LED bulb, a radiator is provided on the heat conductive bracket, and a heat conductive pad is provided between the radiator and the heat conductive bracket; the radiator is a nonmetal radiator assembly, the nonmetal radiator assembly includes a nonmetal radiator and a heat conductive conversion bracket, the nonmetal radiator and the heat conductive conversion bracket are obtained by extrusion moulding an ultrafine nonmetal heat conductive material (such as alumina, silicon carbide or the like with fineness smaller than 300 meshes) at a low temperature to form a screen mesh shape and sintering the same at a high temperature, the contact surfaces thereof are adhered into an entirety by coating a heat conductive adhesive, the heat conductive conversion bracket is overhead, the nonmetal radiator takes the shape of a screen mesh, and the nonmetal radiator is overhead by the heat conductive conversion bracket, for enabling the air to enter the screen mesh of the nonmetal radiator from the heat conductive conversion bracket. A rubber sheath or screw fixing glue is filled in the fixing screw hole of the nonmetal radiator for connecting a fixing screw, and a radiator outer cover, which may be made of a metal material by stamping or from plastics by die casting to beautify the appearance of the bulb, is provided outside the nonmetal radiator; or the radiator is a metal radiator, the heat conductive pad is provided between the metal radiator and the heat conductive bracket, the metal radiator is of a hollow structure, a foam metal is filled in the hollow part, superconductive liquid is filled in the hollow structure, upper and lower stoppers are pressed by interference fit or screwed by a threaded seal gum in the hollow structure to form a sealed space, and the sealed space is vacuumized; a radiator fixing screw penetrates through a fixing through hole on the inner snap ring, in order to be connected to the radiator fixing screw hole of the nonmetal radiator or the metal radiator.

In the foregoing method for constructing the universal LED bulb, fluorescent powder is spray-coated on the LED chip on the optical engine module, and transparent silica gel is covered thereon; or the number of the LED chips is configured according to the proportion of blue and red lights necessary for plants, and only the transparent silica gel is covered on the welded LED chip for package; or, the LED chip on the optical engine module is merely packaged by the transparent silica gel, and then, an inner cover coated with fluorescent powder on the inner side is provided outside the packaged optical engine module; or no silica gel is covered on the LED chip on the optical engine module, a concave inner cover filled with transparent insulating heat conductive liquid is provided outside the optical engine module, the fluorescent powder is provided in the transparent insulating heat conductive liquid, and the concave inner cover is an elastic inner cover of a thin concave structure.

The fluorescent powder is spray-coated on the LED chip on the optical engine module, and the transparent silica gel is covered thereon; or the number of the LED chips on the optical engine module is configured according to the proportion of blue and red lights necessary for plants, and only the transparent silica gel is covered on the welded LED chip; or, the LED chip on the optical engine module may also be packaged by the traditional package solution, namely, the fluorescent powder is spray coated on the LED chip and the transparent silica gel is covered thereon, while no inner cover is used; when the present invention is applied to agricultural production lighting, the number of the LED chips on the optical engine module is configured according to the proportion of blue and red lights necessary for plants, and only the transparent silica gel is covered on the welded LED chip.

In the foregoing method for constructing the universal LED bulb, the LED chip on the optical engine module is packaged by transparent silica gel, then the inner cover coated with fluorescent powder on the inner side is provided outside the packaged optical engine module, this structure ensures the fluorescent powder has better uniformity of compared with that being directly sprayed on the chip, the fluorescent powder is away from the LED heating chip, the LED chip may operate at a relatively higher temperature, thereby perfecting the LED operation condition, effectively reducing the luminous decay of the LED bulb and ensuring a better LED light emission effect, and the dosage of the fluorescent powder is not increased to a larger extent; or no silica gel is covered on the LED chip on the optical engine module, the concave inner cover filled with transparent insulating heat conductive liquid is provided outside the optical engine module, the fluorescent powder is provided in the transparent insulating heat conductive liquid, and the concave inner cover is an elastic inner cover of a thin concave structure, in this structure, when the LED is electrified to generate heat, the transparent insulating heat conductive liquid is heated to flow to take away the heat of the LED chip, in order to exchange the heat with the radiator on a larger area, thus avoiding local high heat of the LED chip and the surrounding fluorescent powder in the traditional solution and effectively reducing the generation of LED luminous decay, and when the transparent insulating heat conductive liquid is heated to expand, the concave inner cover protrudes outwards to increase the volume for receiving the expanded liquid, in order to prevent expanding of the liquid from resulting in ineffective seal of the inner cover.

In the foregoing method for constructing the universal LED bulb, a connector plug fixing hole is provided on the heat conductive bracket, a connector plug with a contact pin is inserted into the connector plug fixing hole and is fixed with the part inserted into the bulb as a fixed end, the tail end of the contact pin is welded with the optical engine die plate in the universal LED bulb, to form a simple electric interface on the outer surface of the universal LED bulb, during installation, the electric connection of the universal LED bulb is achieved as long as the connector plug is in butt joint with a connector socket with a cable and the universal LED bulb is fixed; the eccentric position of the hole of the connector plug on the heat conductive bracket and the size of the fixed end of the connector plug are limited, such that the optical engine die plate in the LED bulb may meet the demands of arranging the LED chip and the driving power supply chip and registering them; the connector plug with the contact pin is of a four-pin structure, wherein two pins are used for power supply access, and the other two pins are used for control access; the fixed end is in a nut fixing manner or a fusion ring fixing manner; when the fixed end is in the nut fixing manner, a waterproof rubber ring is added between the connector plug and the heat conductive bracket to prevent water; in order to prevent rotation, an antiskid groove is provided on the connector plug, and a corresponding projection is provided at the through hole of the heat conductive bracket; a three-hole flange is provided on the connector socket and is fixed to the lamp radiator through a fixing screw, and an adjusting rubber pad is provided between the connector socket and the radiator to adjust the thickness, in order to ensure tightness of a waterproof surface; or external threads are provided on the connector plug to match with the internal threads of the fixing nut on the connector socket provided with the waterproof rubber ring to prevent water; an slot is provided on the connector socket, and the waterproof rubber ring is provided in the slot to prevent water.

A flange inner snap ring type LED bulb constructed by the foregoing method, comprising a heat conductive bracket with a flange, wherein at least an optical engine module, an inner snap ring and a light distribution optical lens are provided on the heat conductive bracket sequentially, a lens snap ring fastens the light distribution optical lens, and in order to prevent accidental drop-off of a lens, a lens snap ring fixing screw is provided for fixing the lens snap ring on the outer diameter of the inner snap ring; the optical engine module is made up of an optical engine die plate, an LED chip and a relevant wiring by bonding and packaging, or is further integrated with a power supply drive chip.

In the foregoing flange inner snap ring type LED bulb, the inner snap ring surrounds outside the optical engine module, or an inner ring cover is further provided between the inner snap ring and the inner cover, the upper part of the inner snap ring is connected to the heat conductive bracket, the lower part of the inner snap ring is adhered with the light distribution optical lens, a sealed waterproof space for packaging the optical engine module is formed by the three components, or the inner snap ring is further used as the installation base of an LED bulb radiator; the lens snap ring fastens the light distribution optical lens, and in order to prevent accidental drop-off of a lens, a lens snap ring fixing screw is provided for fixing the lens snap ring on the outer diameter of the inner snap ring; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

In the foregoing flange inner snap ring type LED bulb, for a small-specification LED bulb, the heat conductive bracket, the optical engine module, the inner snap ring and the light distribution optical lens are sequentially overlapped and adhered, or the inner ring cover is further provided between the inner snap ring and the inner cover, and the optical engine die plate of the optical engine module, the inner snap ring and the light distribution optical lens form a sealed waterproof space used for packaging components packaged on the optical engine die plate; or, the inner snap ring and the inner cover are processed to an inner cover having the function of the inner snap ring and having an integral structure; or the inner snap ring is further used as the installation base of the LED bulb radiator; or the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

In the foregoing flange inner snap ring type LED bulb, a radiator is provided on the heat conductive bracket; the radiator is a nonmetal radiator assembly, the nonmetal radiator assembly includes a nonmetal radiator and an overhead heat conductive conversion bracket at the lower side thereof, a rubber sheath or screw fixing glue is filled in the radiator fixing screw hole of the nonmetal radiator for connecting a fixing screw, and a radiator outer cover is provided outside the nonmetal radiator; or the radiator is a metal radiator, a heat conductive pad is provided between the metal radiator and the heat conductive bracket, the metal radiator includes a cooling fin, a superconductive fluid cavity is provided at the middle of the cooling fin, a foam metal is filled in the superconductive fluid cavity and superconductive fluid is filled therein, an upper plug and a lower plug are provided at two ends of the superconductive fluid cavity, and a vacuum suction pipe is provided on the upper plug or the lower plug; a cable hole used for penetration of a cable and a radiator fixing screw hole are further provided on the radiator.

Only transparent silica gel for package is provided outside the LED chip on the optical engine module, an inner cover is provided outside the optical engine module with the transparent silica gel, and fluorescent powder coating is provided on the inner layer of the inner cover; or, no silica gel is packaged on the LED chip on the optical engine module, a concave inner cover filled with transparent insulating heat conductive liquid is provided outside the optical engine module, the LED chip on the optical engine module is soaked in the transparent insulating heat conductive liquid, fluorescent powder is provided in the transparent insulating heat conductive liquid, and the concave inner cover is an elastic inner cover of a thin concave structure.

In the foregoing flange inner snap ring type LED bulb, an electric connector is provided on the heat conductive bracket, the electric connector includes a connector plug, a contact pin is provided on the connector plug, and a contact pin welding spot on a tail end of the contact pin is welded with the optical engine module; after penetrating through a fixing hole of the connector plug on the universal LED bulb, the connector plug is provided with a fixed end for fixing; the connector plug is cooperatively connected to a connector socket with a jack, and the connector socket is connected to a cable; the contact pin of the electric connector has a four-pin structure, wherein two pins are used for power supply access, and the other two pins are used for control access.

In the foregoing flange inner snap ring type LED bulb, the fixed end is a fusion ring; or the fixed end is a fixing nut, a waterproof rubber ring slot is further provided on the connector plug, and a waterproof rubber ring is provided in the waterproof rubber ring slot; in order to prevent rotation, an antiskid groove is provided on the connector plug, and a corresponding projection is provided at the through hole of the heat conductive bracket; a three-hole flange is provided on the connector socket, and the connector socket is fixed with the radiator or a heat conductive converting plate on the lamp through the three-hole flange and a fixing screw of the connector socket, and a fixed adjusting rubber pad is also provided between the flange and the radiator or the heat conductive converting plate on the lamp to ensure tightness of a waterproof surface; or the connector plug is provided with external threads to match with the internal threads of the fixing nut on the connector socket provided with the waterproof rubber ring so as to be fixed to the connector plug; an slot is provided on the connector socket, and the waterproof rubber ring is provided in the slot.

In another aspect, the present invention further provides a variety of lamps using the foregoing LED bulb. The lamp provided by the present invention is simple in structure, low in manufacturing cost, quick, cheap and convenient to install, use and maintain and is unlikely to expand failure, achieves independent production and use of the bulb, lamp and the lighting control product of the LED bulb, greatly reduces the production procedures, achieves mass production and facilitates the application and the industrial scale of the LED energy-saving lighting products.

As a first type, an LED tunnel lamp using an extrusion type double-faced radiator structure, comprising a metal extrusion type double-faced radiator formed by an extrusion process, wherein an LED bulb is provided on the extrusion type double-faced radiator, and a lamp housing punch-formed by a metal or die-cast by plastics is provided outside the extrusion type double-faced radiator; the extrusion type double-faced radiator is installed on an installation support, and an installation interface used for installing the LED bulb is provided on the extrusion type double-faced radiator.

In the foregoing LED tunnel lamp using the extrusion type double-faced radiator structure, the extrusion type double-faced radiator includes a substrate, and fins are provided at the two sides of the substrate; the installation interface used for installing the LED bulb is provided at one side of the substrate, and circular or elliptic conical spaces are formed by cutting the fins around the installation interface of the substrate according to the illumination angle of the light emitted by the bulb to the extent of ensuring not to shade the light emitted by the LED bulb; a conducting wire bracket is provided at the other side of the substrate, and the conducting wire bracket is used for connecting a conducting wire led out from the LED bulb to a power supply; the installation interface includes a surface in contact with the LED bulb and a hole connected to the LED bulb, on the extrusion type double-faced radiator.

In the foregoing LED tunnel lamp using the extrusion type double-faced radiator structure, the extrusion type double-faced radiator is installed on an L-shaped connecting plate, the L-shaped connecting plate is fixed to a diversion bracket, and the diversion bracket is fixed to the installation support, such that the extrusion type double-faced radiator may simultaneously adjust its angle in a horizontal direction and a vertical direction.

In the foregoing LED tunnel lamp using the extrusion type double-faced radiator structure, an installation support turning locking groove is engraved on the installation support, after the illumination angle of the lamp is adjusted, an installation support rotation fixing screw (the screw is used for locking the lamp along the gravity direction to prevent loosening) and a diversion bracket fixing screw may be screwed, meanwhile, an installation support turning locking screw is screwed in the installation support turning locking groove to prevent the illumination direction from changing. The illumination angle may be simultaneously adjusted in the horizontal and vertical directions by adjusting the diversion bracket fixing screw and the installation support rotation fixing screw.

In the foregoing LED tunnel lamp using the extrusion type double-faced radiator structure, a vent hole is provided on the lamp housing to ensure the radiating effect of the extrusion type radiator.

In the foregoing LED tunnel lamp using the extrusion type double-faced radiator structure, 6 flange fixing holes on the installation interface of the extrusion type radiator are uniformly distributed at a diameter D1, and the diameter D1 is a value obtained by subtracting a diameter of a fixing screw cap and then subtracting a margin of 0.8-4 mm from an outer diameter D of the LED bulb.

As a second type, an LED street lamp using a multifunctional lamp housing as an installation interface bracket structure, including the multifunctional lamp housing punch-formed by a metal sheet via a stamping process, wherein the multifunctional lamp housing is fixed to a lamp post through a lamp post fixing member; one or more installation interface hole used for installing extrusion type radiators is provided on the multifunctional lamp housing; an installation interface used for installing an LED bulb is provided on each extrusion type radiator, the LED bulb is provided on the installation interface, and the LED bulb and the installation interface are provided in a one-to-one correspondent manner.

In the foregoing LED street lamp using the multifunctional lamp housing as the installation interface bracket structure, a wire harness connector is provided on the multifunctional lamp housing, and the wire harness connector is used for connecting a plurality of LED bulbs to a power supply and a control circuit; an edgefold for reinforcing the structural strength is further provided at the edge of the multifunctional lamp housing.

In the foregoing LED street lamp using the multifunctional lamp housing as the installation interface bracket structure, the lamp post fixing member includes a lamp post fixing bracket, a lamp post fixing bracket bolt and a reinforcing plate, wherein the lamp post fixing bracket and the reinforcing plate are provided at the upper and lower sides of the multifunctional lamp housing; the multifunctional lamp housing is fixed to the lamp post through the lamp post fixing bracket and the reinforcing plate.

In the foregoing LED street lamp using the multifunctional lamp housing as the installation interface bracket structure, the extrusion type radiator includes a substrate, and a fin is provided on one side of the substrate; an installation interface used for installing the LED bulb is provided on the other side of the substrate; the installation interface includes a surface in contact with the LED bulb and a hole connected to the LED bulb on the extrusion type radiator.

In the foregoing LED street lamp using the multifunctional lamp housing as the installation interface bracket structure, 6 flange fixing holes on the installation interface of the extrusion type radiator are uniformly distributed at a diameter D1, and the diameter D1 is a value obtained by subtracting a diameter of a fixing screw cap and then subtracting a margin of 0.8-4 mm from an outer diameter D of the LED bulb.

As a third type, an LED street lamp using a multifunctional lamp housing as an installation interface bracket structure, including the multifunctional lamp housing punch-formed by a metal sheet via a stamping process, wherein the multifunctional lamp housing is fixed to a lamp post through a lamp post fixing member; one or more installation interface used for installing an LED bulb is provided on the multifunctional lamp housing, and the LED bulb is installed on the installation interface.

In the foregoing LED street lamp using the multifunctional lamp housing as the installation interface bracket structure, a wire harness connector is provided on the multifunctional lamp housing, and the wire harness connector is used for connecting a plurality of LED bulbs to a power supply and a control circuit; an edgefold for reinforcing the structural strength is further provided at the edge of the multifunctional lamp housing; the installation interface includes a surface in contact with the LED bulb and a hole connected to the LED bulb, on the multifunctional lamp housing.

In the foregoing LED street lamp using the multifunctional lamp housing as the installation interface bracket structure, the lamp post fixing member includes a lamp post fixing bracket, a lamp post fixing bracket bolt and a reinforcing plate, and the lamp post fixing bracket and the reinforcing plate are provided at the upper and lower sides of the multifunctional lamp housing respectively; the multifunctional lamp housing is fixed to the lamp post through the lamp post fixing bracket and the reinforcing plate; or the multifunctional lamp housing is fixedly fixed to the lamp post through the lamp post fixing bracket.

As a fourth type, an oval LED street lamp using an installation interface bracket structure, including an installation interface plate fixing bracket, wherein an installation interface plate is provided under the installation interface plate fixing bracket, an installation interface is provided on the installation interface plate, and an LED bulb is provided on the installation interface; the installation interface plate fixing bracket is connected to a lamp post; a lamp housing is provided on the installation interface plate fixing bracket, a lampshade is provided outside the installation interface plate, and the lamp housing matches with the lampshade to form an oval shape.

In the foregoing oval LED street lamp using the installation interface bracket structure, a wire harness connector is provided on the installation interface plate fixing bracket, and the wire harness connector is used for connecting a plurality of LED bulbs to a power supply and a control circuit.

In the foregoing oval LED street lamp using the installation interface bracket structure, the installation interface plate fixing bracket includes a sleeve, wherein the sleeve is used for installing the lamp post, wire harness connector brackets are provided at the two sides of the sleeve, and the wire harness connector brackets are used for installing the wire harness connector; a ring plate is provided outside the sleeve and the wire harness connector brackets, and the ring plate is used for fixedly connecting the installation interface plate to the installation interface plate fixing bracket.

In the foregoing oval LED street lamp using the installation interface bracket structure, a light penetration hole and a water drainage hole are provided on the lamp cover; the installation interface includes a surface in contact with the LED bulb and a hole connected to the LED bulb, on the installation interface plate.

In the foregoing oval LED street lamp using the installation interface bracket structure, a radiator interface opening and 6 flange fixing holes are provided on the installation interface of the installation interface plate, the flange fixing holes are used for fixing the LED bulb, and the radiator interface opening is used for enabling the LED bulb to penetrate through the installation interface; the flange fixing holes are uniformly distributed at a diameter D1, and the diameter D1 is a value obtained by subtracting a diameter of a fixing screw cap and then subtracting a margin of 0.8-4 mm from an outer diameter D of the LED bulb; the diameter D2 of the radiator interface opening on the installation interface is a value obtained by subtracting two times of a diameter of a fixing screw cap and then subtracting two times of the margin corresponding to the diameter D1 from the outer diameter D of the bulb.

As a fifth type, an LED street lamp using an extrusion type installation interface bracket structure, including a metal extrusion type installation interface bracket, wherein the extrusion type installation interface bracket is fixed to a lamp post; the extrusion type installation interface bracket includes a lamp post fixing sleeve, bracket panels are provided at the two sides of the lamp post fixing sleeve, and an installation interface used for installing an LED bulb is provided on the bracket panels; the LED bulb is installed on the installation interface.

The foregoing LED street lamp using the extrusion type installation interface bracket structure further includes a wire harness connector, wherein the wire harness connector is provided on the lamp post fixing sleeve, and the wire harness connector is used for connecting a plurality of LED bulbs to a power supply and a control circuit.

In the foregoing LED street lamp using the extrusion type installation interface bracket structure, in the extrusion type installation interface bracket, the bracket panels at the two sides are provided to form an included angle; a lamp post seal head is provided at one end of the lamp post fixing sleeve, and the other end of the lamp post fixing sleeve is fixed to the lamp post through a lamp post fixing screw; the installation interface includes a surface in contact with the LED bulb and a hole connected to the LED bulb, on the bracket panels.

In the foregoing LED street lamp using the extrusion type installation interface bracket structure, a radiator interface opening and 6 flange fixing holes are provided on the installation interface, the flange fixing holes are used for fixing the LED bulb, and the radiator interface opening is used for enabling the LED bulb to penetrate through the installation interface; the 6 flange fixing holes are uniformly distributed at a diameter D1, and the diameter D1 is a value obtained by subtracting a diameter of a fixing screw cap and then subtracting a margin of 0.8-4 mm from an outer diameter D of the LED bulb; the diameter D2 of the radiator interface opening on the installation interface is a value obtained by subtracting two times of a diameter of a fixing screw cap and then subtracting two times of the margin corresponding to the diameter D1 from the outer diameter D of the bulb.

As a sixth type, an LED lighting lamp using an installation interface bracket combined member, including the installation interface bracket combined member, wherein an LED bulb provided with a radiator is provided on the installation interface bracket combined member; a lamp housing punch-formed by a metal or die-cast by plastics is provided outside the installation interface bracket combined member; the installation interface bracket combined member includes a pipe bracket which is formed by segmenting a standard pipe, a lamp fixing flange and a lamp housing and bulb fixing bracket, the pipe bracket, the lamp fixing flange and the lamp housing and bulb fixing bracket are connected, an installation interface used for installing the LED bulb is provided on the lamp housing and bulb fixing bracket, and the pipe bracket is connected to the lamp fixing flange and the lamp housing and bulb fixing bracket; the lamp fixing flange is a flat flange or an arched flange; the lamp housing is connected to the installation interface bracket combined member through the lamp housing and bulb fixing bracket.

In the foregoing LED lighting lamp using the installation interface bracket combined member, the installation interface includes a surface in contact with the LED bulb and a hole connected to the LED bulb, on the lamp housing and bulb fixing bracket; the lamp housing and bulb fixing bracket is punch-formed by a metal, the pipe bracket is connected to the center of the lamp housing and bulb fixing bracket, the lamp housing and bulb fixing bracket is engraved to be hollow around its portion connected to the pipe bracket, so that passage of a cable and formation of a chimney effect in the lamp housing are facilitated to ensure ventilating and radiating effects, and a screw hole used for installing the lamp housing is provided at an edge of the lamp housing and bulb fixing bracket.

In the foregoing LED lighting lamp using the installation interface bracket combined member, 6 flange fixing holes provided on the installation interface are uniformly distributed at a diameter D1, and the diameter D1 is a value obtained by subtracting a diameter of a fixing screw cap and then subtracting a margin of 0.8-4 mm from an outer diameter D of the LED bulb.

As a seventh type, an LED tunnel lamp using a lamp housing as an installation interface bracket structure, including the lamp housing formed by a metal stamping or plastics die casting process, wherein the lamp housing includes an installation interface bracket plate used for installing an extrusion type radiator and a foot screw hole used for fixedly installing the entire LED tunnel lamp; one or more opening used for installing the extrusion type radiator is provided on the installation interface bracket plate, an installation interface is provided on the extrusion type radiator, and an LED bulb is provided on the installation interface.

In the foregoing LED tunnel lamp using the lamp housing as the installation interface bracket structure, a protection plate is further provided on the lamp housing.

In the foregoing LED tunnel lamp using the lamp housing as the installation interface bracket structure, the extrusion type radiator includes a substrate, a fin is provided at one side of the substrate, and the installation interface used for installing the LED bulb is provided at the other side of the substrate; the installation interface includes a surface in contact with the LED bulb and a hole connected to the LED bulb, on the extrusion type radiator.

In the foregoing LED tunnel lamp using the lamp housing as the installation interface bracket structure, 6 flange fixing holes on the installation interface are uniformly distributed at a diameter D1, and the diameter D1 is a value obtained by subtracting a diameter of a fixing screw cap and then subtracting a margin of 0.8-4 mm from an outer diameter D of the LED bulb.

As an eighth type, an LED screw lamp, including a screw fitting, wherein an installation interface is provided on a radiator of the screw fitting or a heat conductive converting plate connected to the top of the radiator for fixedly installing an LED bulb, and the lampshade of the screw fitting is connected to the radiator or the heat conductive converting plate in an adhesion, threaded connection or clamping manner. The installation interface includes a surface in contact with the LED bulb and a hole connected to the LED bulb, of the radiator or the heat conductive converting plate. The installation interface includes a surface in contact with the LED bulb and a hole connected to the LED bulb, of the radiator or the heat conductive converting plate.

In the foregoing LED screw lamp, the screw lamp includes a screw lamp holder, an intermediate connecting element, the radiator, the lampshade, or further includes a driving power supply provided in the screw lamp holder; an electric connector assembly is provided at the joint of the LED bulb and the screw lamp, the intermediate connecting element on the screw lamp holder is connected to the radiator through threads thereon, or through a lamp holder fixing screw or in a direct adhesion manner, or the heat conductive converting plate is further provided on the radiator.

In the foregoing LED screw lamp, the electric connector assembly includes a connector socket, a fixing screw and an adjusting rubber pad; the connector socket is cooperatively connected to a connector plug on the LED bulb, a three-hole flange is provided on the connector socket, the connector socket is fixed with the radiator or the heat conductive converting plate through the three-hole flange and the fixing screw of the connector socket, and a fixed adjusting rubber pad is further provided between the flange and the radiator or the heat conductive converting plate to ensure tightness of a waterproof surface; a conducting wire led out from the connector socket is welded to the lamp holder.

In the foregoing LED screw lamp, the radiator is a columnar radiator, the radiator is provided with a radiator substrate thickness inwards at the maximal outer diameter of the cylinder and is provided with fins towards the center of the cylinder in a radial line, 2-3 layers of interrupted grooves are provided on the columnar radiator along an enclosed circular arc with the substrate as thickness, after the radiator is heated, external air naturally flows into the center of the radiator through the interrupted grooves to form convection current, so as to achieve a cooling effect.

In the foregoing LED screw lamp, the radiator is a convection radiator, the radiator is provided with a radiator substrate thickness outwards from the cylindrical surface (using the outer diameter of a straightly fixed connector socket as the diameter) at the center and is provided with fins outwards from the substrate in a radial line, and an arched shape is formed on the surface of each fin upwards to gradually increase the open area; the surface of the each fin is covered with a radiator outer cover, and a plurality of through air flow channels are formed between the outer cover and the fins; after the radiator is heated, the air enters from the flow channel opening at the lower end and flows out from the flow channel opening at the higher end, of the radiator to form a chimney effect, in order to achieve air convection to dissipate heat.

Compared with the prior art, in the present invention, the lens snap ring is used as the supporting component of the entire lamp, the inner snap rings in the lens snap ring are used as auxiliary support to finally form the entire structure in which the entire lens snap ring is filled between the optical engine module with inner snap rings adhered to each other and the heat conductive bracket, therefore the structure is very stable. Moreover, the optical engine module in the present invention is sealed in the sealed section defined by the inner snap rings, the heat conductive bracket and the lens, therefore the waterproof performance of the bulb is greatly improved under the condition of not adding other waterproof elements. The flange inner snap ring type LED bulb in the present invention is used for establishing the lamp in a simple, easy, flexible and variable manner, in this way, the bulb, the lamp and the lighting control product of the LED bulb are independently produced and used, thereby greatly reducing the production procedures of the LED lighting products, improving mass production and facilitating the industrialization of LED energy-saving lighting products. Moreover, in the present invention, one connector plug with a contact pin is fixed in the hole on the LED bulb in a trepanning manner, and circuit welding and mechanical fixing are performed in the bulb, thus the peripheral structure of the entire universal LED bulb is simple and smooth, and the LED bulb is provided with no cable externally, when the bulb is installed, the connector plug is aligned to the connector socket on the cable, then the LED bulb is mechanically fixed, and meanwhile, reliable electric connection of the universal LED lamp is achieved. Moreover, in the present invention, the connector plug and the connector socket may be connected to directly achieve a reliable waterproof function without adding additional cost scarcely, thus the universal LED bulb equipped with the electric connector in the present invention may be both used outdoors and indoors and may also be used in explosion proof environments, such that the application range of the LED bulb is greatly expanded.

DETAILED DESCRIPTION OF THE EMBODIMENTS

Figure 1:
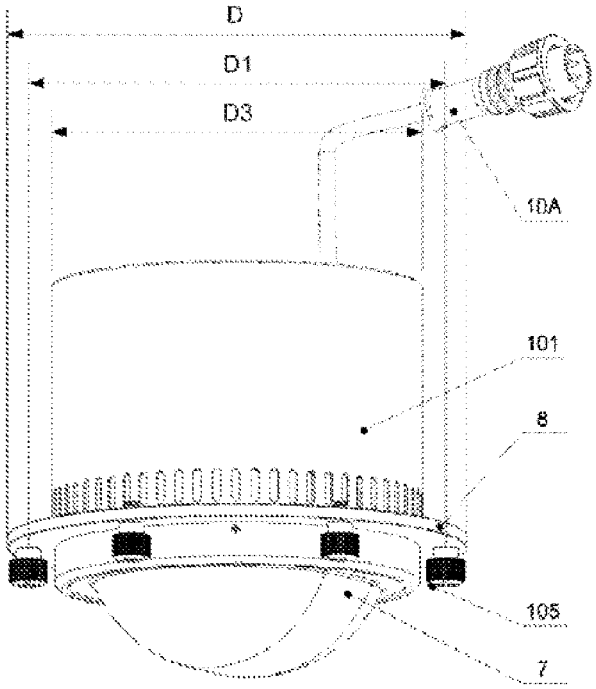
FIG. 1 is an external view of a bulb convex lens solution with a nonmetal radiator in the present invention.

The present invention will be further illustrated below in conjunction with accompanying drawings and embodiments, which are not used as a basis of limiting the present invention.

EMBODIMENTS

A method for constructing a universal LED bulb, including: establish an optical engine core member of the LED bulb using a heat conductive bracket with a flange as the structure supporting main body of the bulb, supporting the LED bulb optical engine core member in an auxiliary manner using an inner snap ring fixed to the heat conductive bracket, and using the inner snap ring as an installation base of a lens snap ring, wherein the LED bulb optical engine core member is composed of the heat conductive bracket, an optical engine module, the inner snap ring and a light distribution optical lens, an inner cover is provided outside the optical engine module, and an electric connector is provided on the heat conductive bracket; the optical engine module is made up of an optical engine die plate, an LED chip set and a relevant wiring by bonding and packaging, or is further integrated with a power supply drive chip. The diameter of the heat conductive bracket is a bulb outer diameter D, the bulb outer diameter D and the upper limit of the power W of the constructed LED bulb satisfy a relationship $W=1.1812e^{0.0361D}$, discrete values are selected for the diameter D on the relationship curve $W=1.1812e^{0.0361D}$ to construct LED bulbs with a plurality of fixed bulb outer diameters D, in order to improve the interchangeability and universality of the LED bulbs; on the relationship curve $W=1.1812e^{0.0361D}$, 20 mm is used as the lower limit of D, 130 mm is used as the upper limit, each 10 mm is set as a segment, the relationship curve is divided into 12 segments to form limited bulb outer diameter specifications, and the interchangeability and universality of the LED bulbs are further improved by the small amount of bulb outer diameter specifications; flange fixing holes on the installation flange of the lens snap ring are uniformly distributed at a diameter D1, and the diameter D1 is a value obtained by subtracting a diameter of a fixing screw cap and then subtracting a margin of 0.8-4 mm from the bulb outer diameter D; the diameter D2 of a radiator interface opening of the LED bulb on a lamp is a value obtained by subtracting two times of a diameter of a fixing screw cap and then subtracting the margin corresponding to the diameter D1 from the bulb outer diameter D; the heat conductive bracket is combined and adhered with the optical engine module integrally, the inner snap ring surrounds the optical engine module, or an inner ring cover is further provided between the inner snap ring and the inner cover; the upper part of the inner snap ring is connected to the heat conductive bracket, the lower part of the inner snap ring is adhered with the light distribution optical lens, for sealing the optical engine module in a sealed waterproof space among the heat conductive bracket, the inner snap ring and the light distribution optical lens, or the inner snap ring is further used as the installation base of an LED bulb radiator; the lens snap ring fastens the light distribution optical lens and is fixed to the outer diameter of the inner snap ring; or, the heat conductive bracket and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

For a small-specification LED bulb, the heat conductive bracket, the optical engine module, the inner snap ring and the light distribution optical lens are sequentially overlapped and adhered to form an integral LED bulb optical engine core member, or the inner ring cover is further provided between the inner snap ring and the inner cover, and components packaged on the optical engine die plate in the optical engine module are packaged in the sealed waterproof space among the heat conductive bracket, the inner snap ring and the light distribution optical lens; or, the inner cover and the inner snap ring are of an integral structure (namely, an inner cover with a function of the inner snap ring), the components packaged on the optical engine die plate are packaged in the waterproof space between the optical engine die plate and the integral structure formed by the inner cover and the inner snap ring.

When an LED bulb with a radiator needs to be constructed, a radiator is provided on the heat conductive bracket, and a heat conductive pad is provided between the radiator and the heat conductive bracket; the radiator is a nonmetal radiator assembly, the nonmetal radiator assembly includes a nonmetal radiator and a heat conductive conversion bracket, the nonmetal radiator and the heat conductive conversion bracket are obtained by extrusion moulding an ultrafine nonmetal heat conductive material (such as alumina, silicon carbide or the like) at a low temperature and sintering the same at a high temperature, the contact surfaces thereof are adhered into an entirety by coating a heat conductive adhesive, a rubber sheath or screw fixing glue is filled in the fixing screw hole of the nonmetal radiator for connecting a fixing screw, a radiator outer cover, which may be made of a metal material by stamping or from plastics by die casting to beautify the appearance of the bulb, is provided outside the nonmetal radiator, the heat conductive conversion bracket is overhead, the nonmetal radiator takes the shape of a screen mesh, and the heat conductive conversion bracket spans the nonmetal radiator, for enabling the air to enter the screen mesh of the nonmetal radiator from the heat conductive conversion bracket; or the radiator is a metal radiator, the heat conductive pad is provided between the metal radiator and the heat conductive bracket, the metal radiator is of a hollow structure, a foam metal is filled in the hollow part, superconductive liquid is filled in the hollow structure, upper and lower stoppers are pressed by interference fit or screwed by a threaded seal gum in the hollow structure to form a sealed space, and the sealed space is vacuumized; a radiator fixing screw penetrates through a fixing through hole on the inner snap ring to be connected to the radiator fixing screw hole of the nonmetal radiator or the metal radiator. Fluorescent powder is spray coated on the LED chip, and transparent silica gel is covered thereon; or the number of the LED chips is configured according to the proportion of blue and red lights necessary for plants, and only the transparent silica gel is covered on the welded LED chip for package; or, the LED chip is merely packaged by the transparent silica gel, and then, an inner cover coated with fluorescent powder on the inner side is provided outside the packaged LED chip; or no silica gel is covered on the LED chip, a concave inner cover filled with transparent insulating heat conductive liquid is provided outside the LED chip, fluorescent powder is provided in the transparent insulating heat conductive liquid, and the concave inner cover is an elastic inner cover of a thin concave structure. A through hole is provided on the heat conductive bracket, a connector plug with a contact pin is inserted into the through hole and is fixed with the part inserted into the bulb as a fixed end, the tail end of the contact pin is welded with the optical engine die plate in the universal LED bulb, to form a simple electric interface on the outer surface of the universal LED bulb, during installation, the electric connection of the universal LED bulb is achieved as long as the connector plug is in butt joint with a connector socket with a cable and the universal LED bulb is fixed; the eccentric position of the hole of the connector plug on the heat conductive bracket and the size of the fixed end of the connector plug are limited, such that the optical engine die plate in the LED bulb may meet demands of arranging the LED chip and the driving power supply chip and registering them registering them; the connector plug with the contact pin is of a four-pin structure, wherein two pins are used for power supply access, and the other two pins are used for control access; the fixed end is in a nut fixing manner or a fusion ring fixing manner; when the fixed end is in the nut fixing manner, a waterproof rubber ring is added between the connector plug and the heat conductive bracket to prevent water; in order to prevent rotation, an antiskid groove is provided on the connector plug, and a corresponding projection is provided at the through hole of the heat conductive bracket; a three-hole flange is provided on the connector socket and is fixed to a lamp radiator through a fixing screw, an adjusting rubber pad is provided between the connector socket and the radiator to adjust the thickness, in order to ensure tightness of a waterproof surface; or external threads are provided on the connector plug to match with the internal threads of the fixing nut on the connector socket provided with the waterproof rubber ring to prevent water; an slot is provided on the connector socket, and the waterproof rubber ring is provided in the slot to prevent water.

Figure 6:
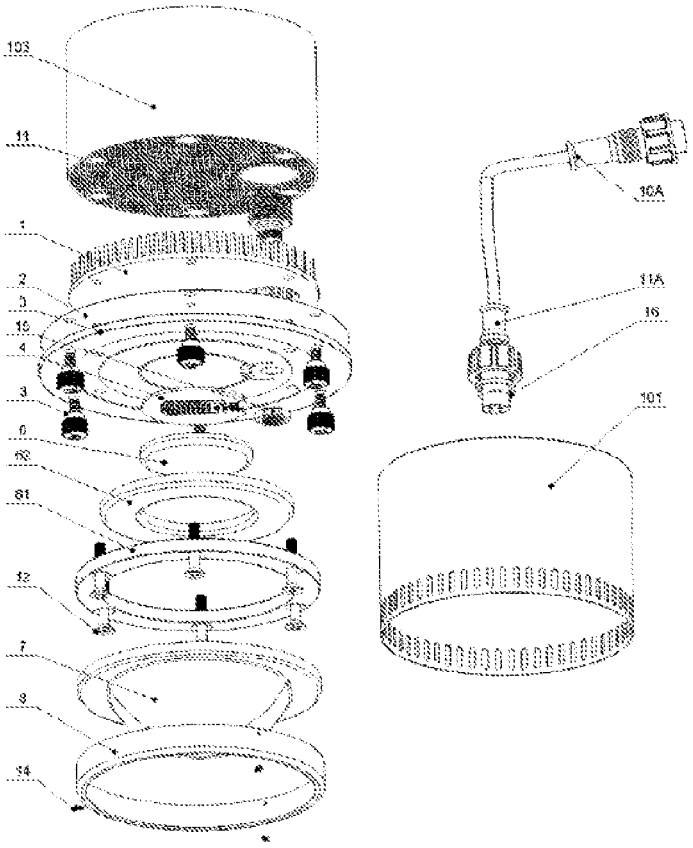
FIG. 6 is an exploded view of a structure in the present invention.
Figure 7:
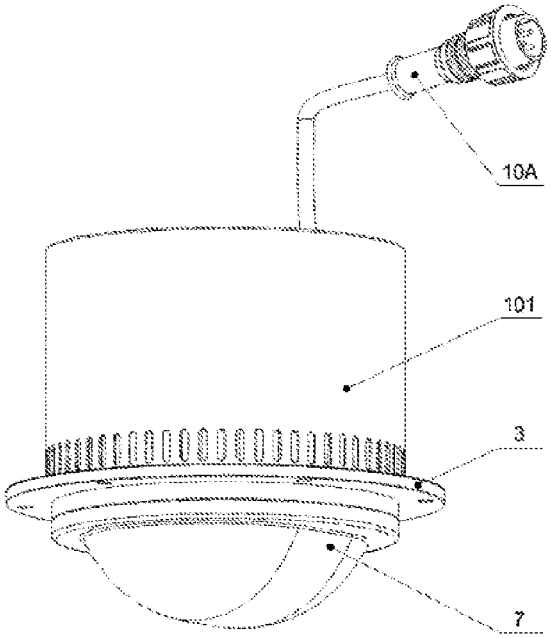
FIG. 7 is a structure diagram of an outline of core members of an LED bulb optical engine in the present invention.
Figure 9:
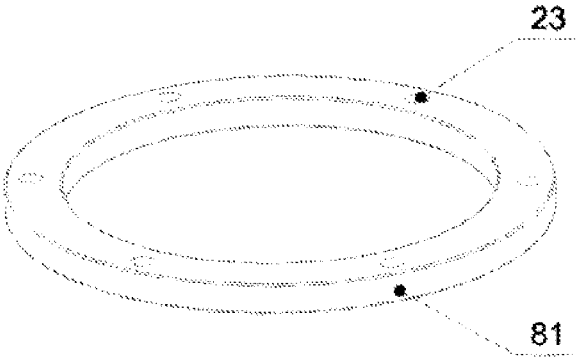
FIG. 9 is an external view of an inner snap ring in an embodiment of the present invention.
Figure 10:
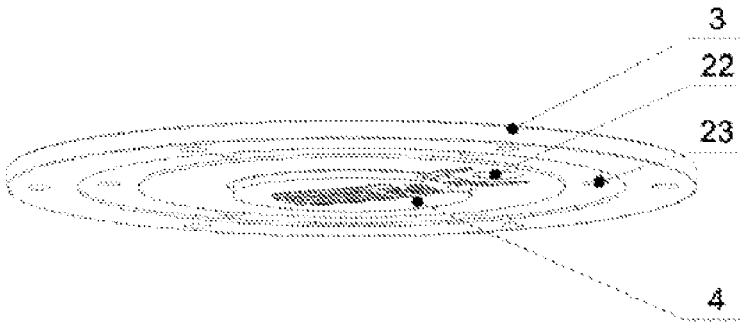
FIG. 10 is an external view of assembly of an optical engine module and a heat conductive bracket in an embodiment of the present invention.
Figure 30:
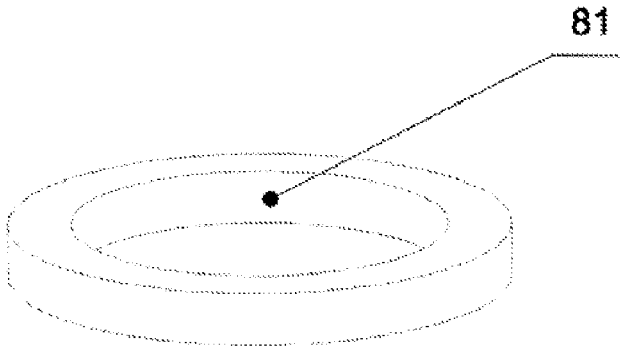
FIG. 30 is a schematic diagram of a structure of an inner snap ring provided with no radiator in the present invention.
Figure 31:
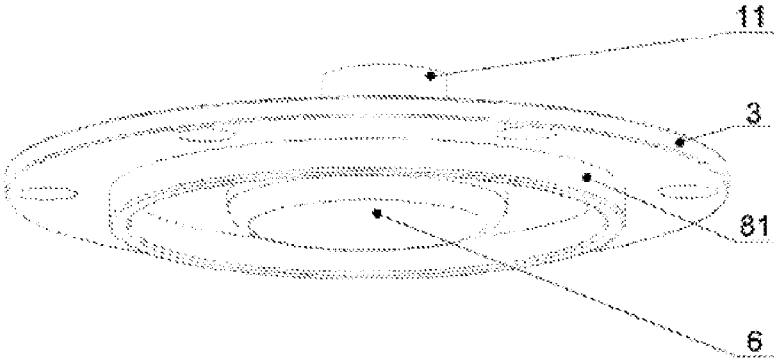
FIG. 31 is a schematic diagram of an installation structure of an inner snap ring provided with no radiator in the present invention.

A flange inner snap ring type LED bulb constructed by the foregoing method, as shown in FIG. 6 and FIG. 7, includes a heat conductive bracket 3 with a flange, a connector plug 11 is provided on the heat conductive bracket 3, at least an optical engine module 4, an inner snap ring 81 and a light distribution optical lens 7 are provided beneath the heat conductive bracket sequentially, a lens snap ring 8 fastens the light distribution optical lens 7, an inner cover 6 is provided outside the optical engine module 4, in order to prevent accidental drop-off of the lens 7, a lens snap ring fixing screw 14 is provided for fixing the lens snap ring 8 on the outer diameter of the inner snap ring 81; the optical engine module 4 is made up of an optical engine die plate, an LED chip and a relevant wiring by bonding and packaging, or is further integrated with a power supply drive chip. The optical engine module 4 (as shown in FIG. 10) is provided beneath the heat conductive bracket, the inner snap ring 81 is further provided on the heat conductive bracket 3, the inner snap ring 81 (as shown in FIG. 9) surrounds the outside of the optical engine module 4, or an inner ring cover 62 is further provided between the inner snap ring 81 and the inner cover 6, the upper part of the inner snap ring 81 is connected to the heat conductive bracket 3, the lower part of the inner snap ring 81 is adhered to the light distribution optical lens 7, a sealed waterproof space for packaging the optical engine module 4 is formed by the heat conductive bracket 3, the inner snap ring 81 and the light distribution optical lens 7, or the inner snap ring 81 is further used as the installation base of an LED bulb radiator; the lens snap ring 8 fastens the light distribution optical lens 7, and in order to prevent accidental drop-off of the lens 7, the lens snap ring fixing screw 14 is provided to fix the lens snap ring 8 to the outer diameter of the inner snap ring 81; under the condition that no radiator is installed, a step on the inner snap ring 81 may be removed, the structure may be as shown in FIG. 30 and the installation manner is as shown in FIG. 31. Or, the heat conductive bracket 3 and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

Figure 32:
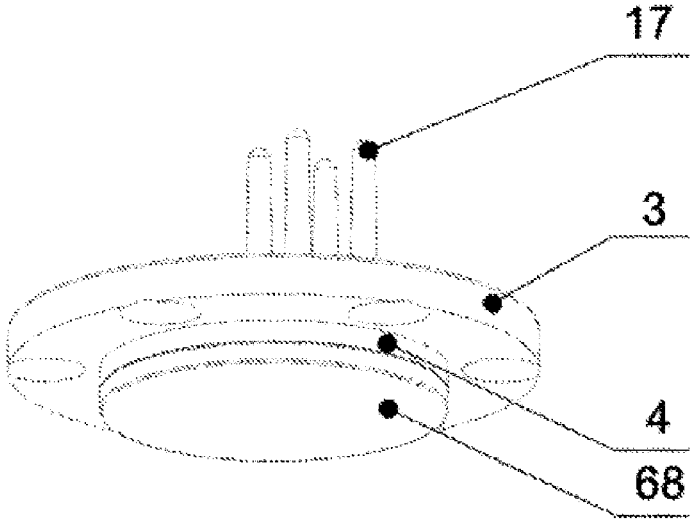
FIG. 32 is a schematic diagram of a structure of an optical engine core member under a small size condition in the present invention.
Figure 33:
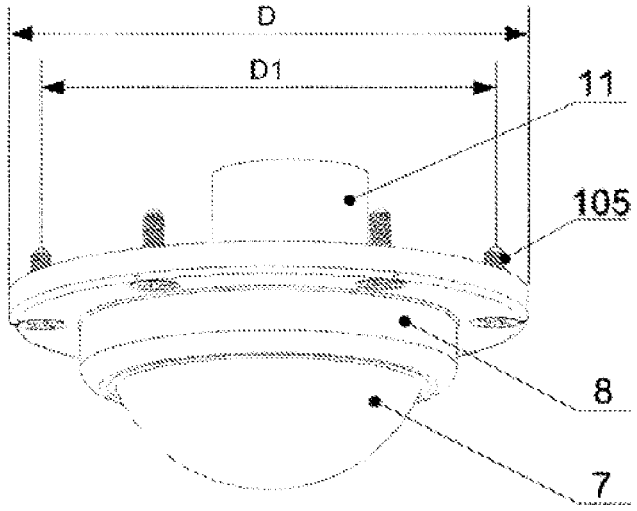
FIG. 33 is an external view of a small-specification bulb convex lens solution in the present invention.

For a small-specification LED bulb, the heat conductive bracket 3, the optical engine module 4, the inner snap ring 81 and the light distribution optical lens 7 are sequentially overlapped and adhered, or the inner ring cover 62 is further provided between the inner snap ring 81 and the inner cover 6, and the optical engine die plate of the optical engine module 4, the inner snap ring 81 and the light distribution optical lens 7 form a sealed waterproof space used for packaging components packaged on the optical engine die plate; or, the inner snap ring 81 and the inner cover 6 are processed to an inner cover 68 having a function of the inner snap ring and having an integral structure, as shown in FIG. 32.

Figure 8:
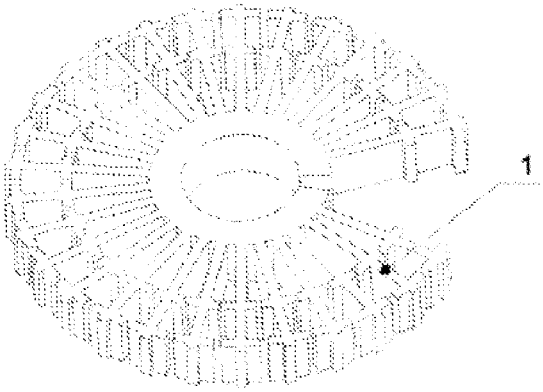
FIG. 8 is an external view of a heat conductive conversion bracket in an embodiment of the present invention.
Figure 14:
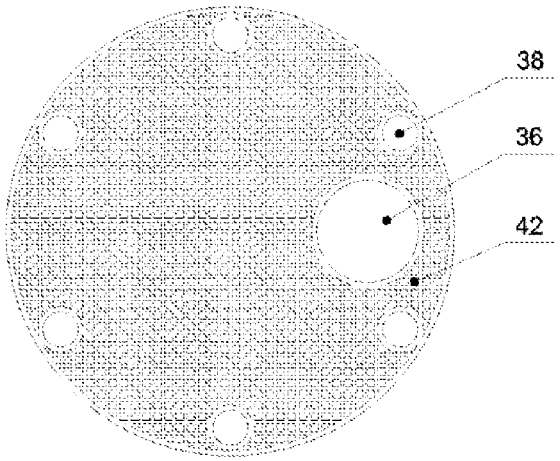
FIG. 14 is a sectional view of a nonmetal radiator in an embodiment of the present invention.
Figure 15:
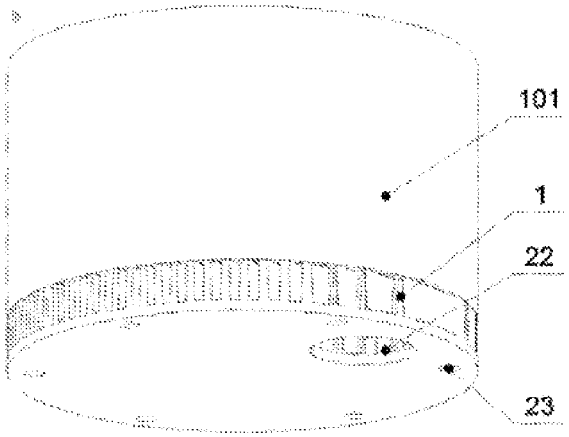
FIG. 15 is an external view of a nonmetal radiator assembly in an embodiment of the present invention.
Figure 16:
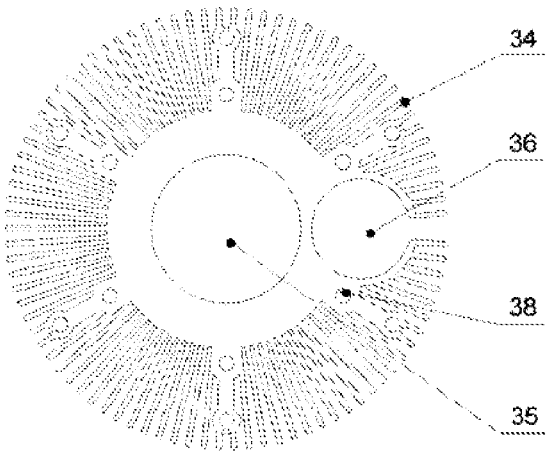
FIG. 16 is a sectional view of a metal radiator in an embodiment of the present invention.
Figure 17:
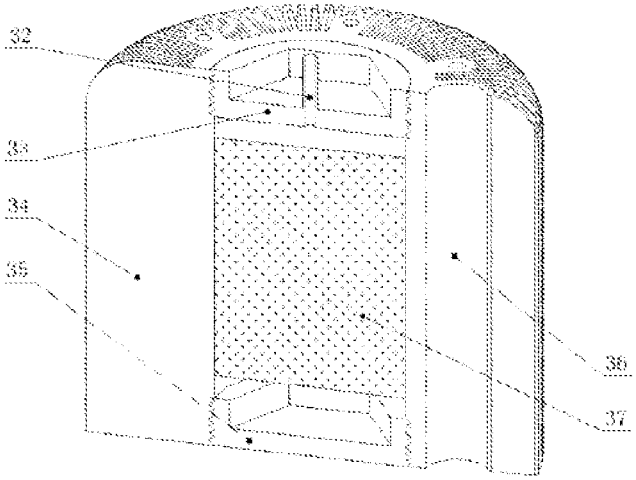
FIG. 17 is a schematic diagram of an internal structure of a metal radiator in an embodiment of the present invention.

For the LED bulb with a radiator: a radiator 103 is provided on the heat conductive bracket 3, and a heat conductive pad 2 is provided between the radiator 103 and the heat conductive bracket 3; the radiator 103 is a nonmetal radiator assembly, the nonmetal radiator assembly includes a screen mesh nonmetal radiator (as shown in FIG. 15, a screen mesh 42 may be seen from the section, and other structures capable of realizing ventilation may also be adopted, as shown in FIG. 8) and an overhead heat conductive conversion bracket 1 at the lower side thereof, a rubber sheath or screw fixing glue is filled in the radiator fixing screw hole 33 of the nonmetal radiator for connecting a fixing screw, a radiator outer cover 101 is provided outside the nonmetal radiator, and the section of the nonmetal radiator is as shown in FIG. 14. Or, the radiator 103 may also be a metal radiator, the heat conductive pad 2 is provided between the metal radiator and the heat conductive bracket 3, the metal radiator includes a cooling fin 34, as shown in FIG. 16 and FIG. 17, a superconductive fluid cavity is provided at the middle of the cooling fin 34, a foam metal 37 is filled in the superconductive fluid cavity and superconductive fluid is filled therein, an upper plug 33 and a lower plug 35 are provided at the two ends of the superconductive fluid cavity, and a vacuum suction pipe 32 is provided on the upper plug 33 or the lower plug 35; a cable hole 36 used for penetration of a cable and a radiator fixing screw hole 38 are further provided on the radiator 103. A radiator fixing screw 12 internally penetrates through the inner snap ring 81 and the radiator fixing through hole 22 on the radiator 103 to fix the radiator 103 to the inner snap ring 81.

Figure 11:
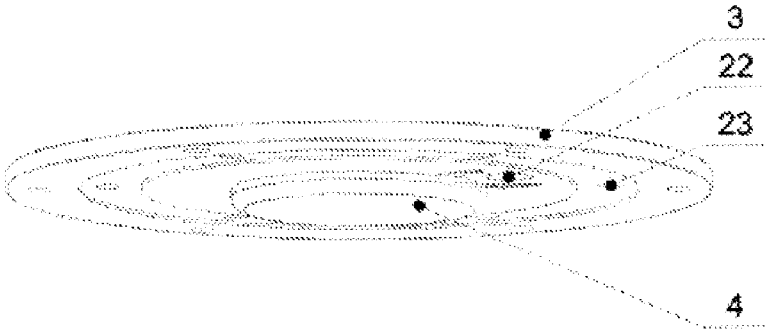
FIG. 11 is an external view of an optical engine module assembly provided with a flat inner cover in an embodiment of the present invention.
Figure 13:
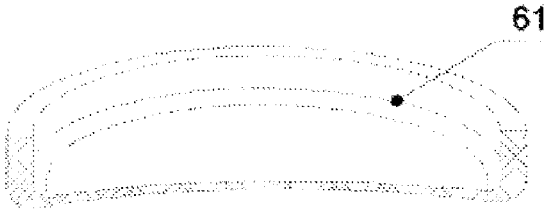
FIG. 13 is a cutaway view of a concave inner cover in an embodiment of the present invention.

Transparent silica gel for package is provided outside the LED chip on the optical engine module 4, an inner cover 6 is provided outside the optical engine module 4 with the transparent silica gel, and fluorescent powder coating is provided on the inner layer of the inner cover 6, as shown in FIG. 11; or no silica gel is packaged on the LED chip on the optical engine module 4, a concave inner cover 61 filled with transparent insulating heat conductive liquid is provided outside the optical engine module 4, the LED chip is soaked in the transparent insulating heat conductive liquid, fluorescent powder is provided in the transparent insulating heat conductive liquid, and the concave inner cover is an elastic inner cover the section of which is of a thin concave structure as shown in FIG. 11, as shown in FIG. 13. The optical engine module 4 is made up of an optical engine die plate, an LED chip and a relevant wiring by bonding and packaging, or a power supply drive chip is further integrated on the optical engine die plate.

Figure 12:
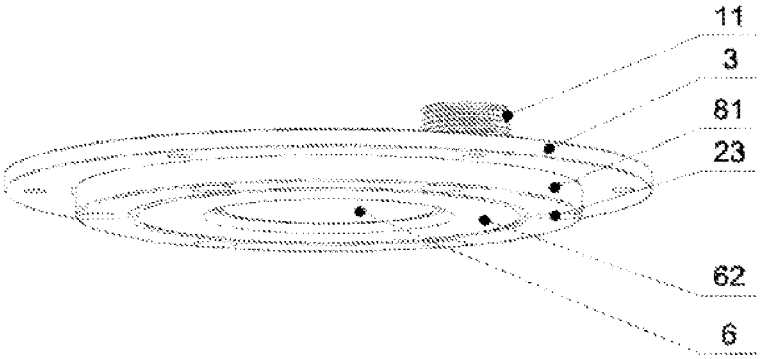
FIG. 12 is an external view of assembly of a heat conductive bracket and an electric connector with an inner snap ring and an optical engine module assembly in an embodiment of the present invention.
Figure 18:
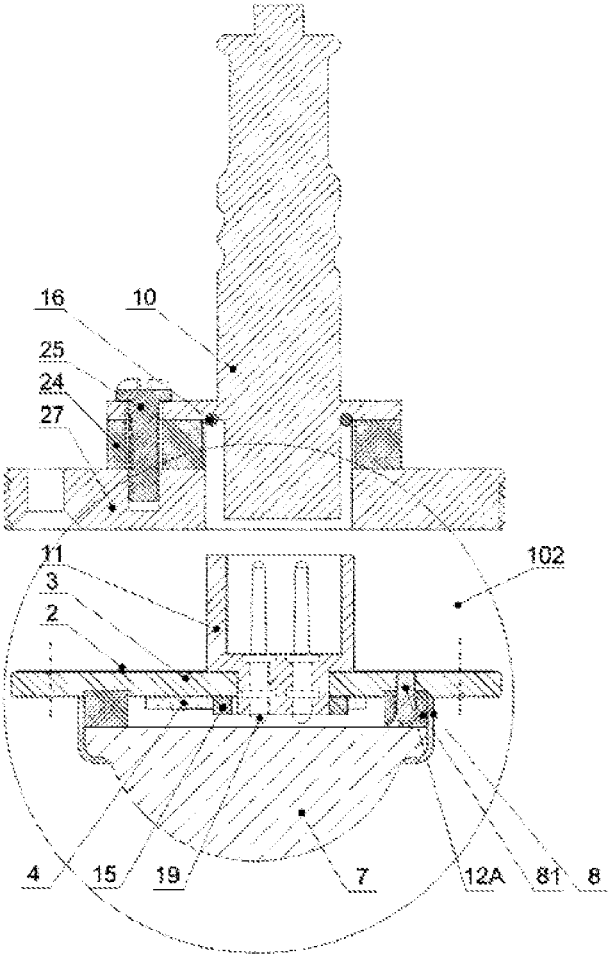
FIG. 18 is a schematic diagram of a structure of a small aperture bulb and assembly of an electric connector in an embodiment of the present invention.
Figure 19:
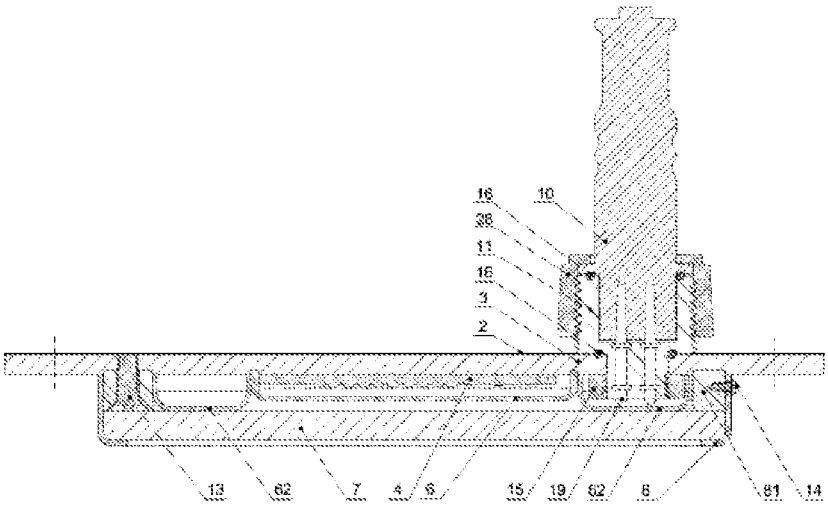
FIG. 19 is a schematic diagram of a structure of a large aperture bulb and assembly of an electric connector in an embodiment of the present invention.
Figure 20:
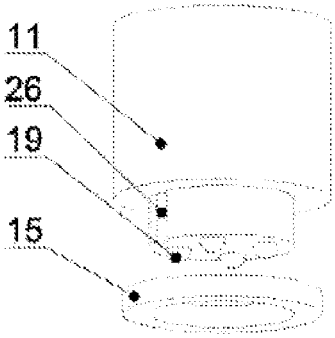
FIG. 20 is a schematic diagram of a structure of a connector plug at a fusion ring fixed end in the present invention.
Figure 21:
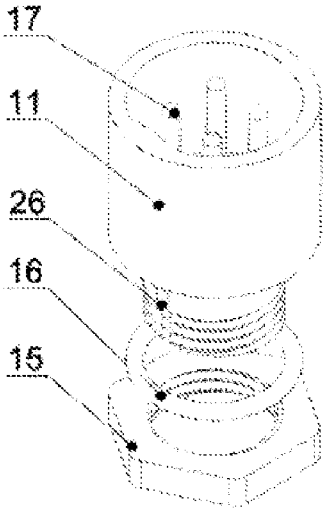
FIG. 21 is a first schematic diagram of a structure of a connector plug at a nut fixed end in the present invention.
Figure 22:
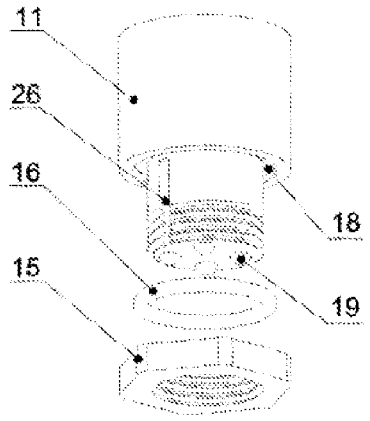
FIG. 22 is a second schematic diagram of a structure of a connector plug at a nut fixed end in the present invention.
Figure 23:
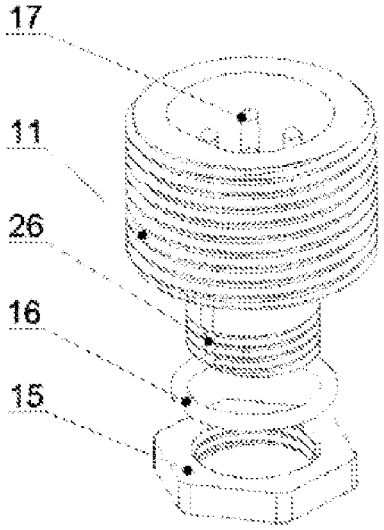
FIG. 23 is a schematic diagram of a structure of a connector plug with external threads in the present invention.
Figure 24:
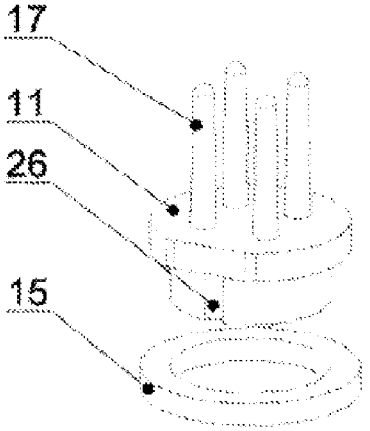
FIG. 24 is a schematic diagram of a structure of a pin type connector plug at a fusion ring fixed end in the present invention.
Figure 25:
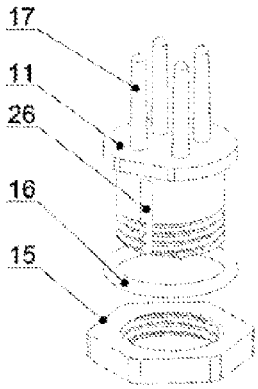
FIG. 25 is a schematic diagram of a structure of a pin type connector plug at a nut fixed end in the present invention.
Figure 26:
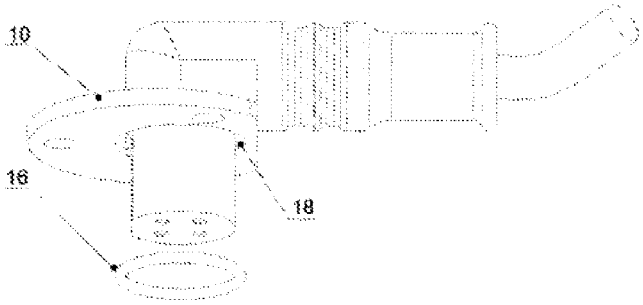
FIG. 26 is a schematic diagram of a structure of a connector socket fixedly connected in a bent shape in the present invention.
Figure 27:
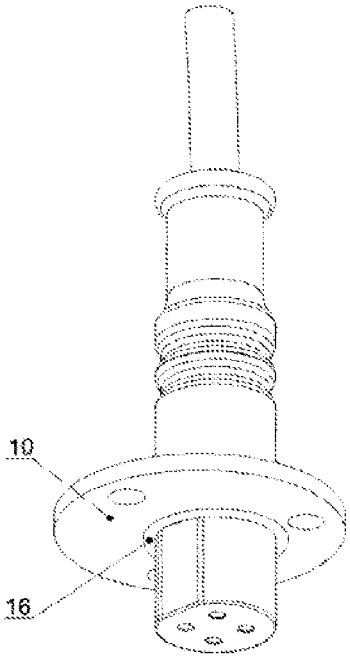
FIG. 27 is a schematic diagram of a structure of a connector socket fixedly connected in a straight shape in the present invention.
Figure 28:
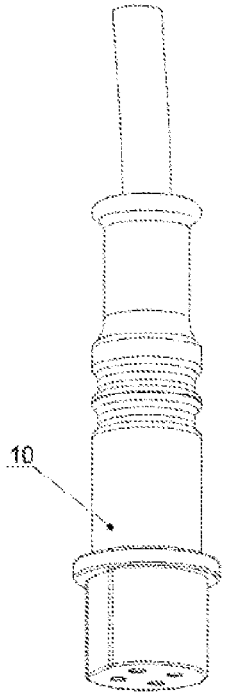
FIG. 28 is a schematic diagram of a structure of a straight-form connector socket non-fixedly connected in the present invention.

An electric connector is provided on the heat conductive bracket 3, the electric connector includes a connector plug 11, a contact pin 17 is provided on the connector plug 11, and a contact pin welding spot 19 on a tail end of the contact pin 17 is welded with the optical engine module 4; after penetrating through a fixing hole 22 of the connector plug on the universal LED bulb, the connector plug 11 is provided with a fixed end 15 for fixing; the connector plug 11 is cooperatively connected to a connector socket 10 with a jack, and the connector socket 10 is connected to a cable; the contact pin of the electric connector is of a four-pin structure, wherein two pins are used for power supply access, and two pins are used for control access. The fixed end 15 is a fusion ring, as shown in FIG. 20 and FIG. 24, wherein the connector plug 11 in FIG. 24 is provided with no protecting jacket; or the fixed end 15 is a fixing nut, a waterproof rubber ring slot 18 is further provided on the connector plug 11, and a waterproof rubber ring 16 is provided in the waterproof rubber ring slot 18, as shown in FIG. 21, FIG. 22, FIG. 23 and FIG. 25, wherein the connector plug 11 in FIG. 25 is provided with no protecting jacket; in order to prevent rotation, an antiskid groove 26 is provided on the connector plug 11, and a corresponding projection is provided at the through hole of the heat conductive bracket 3; the connector socket 10 is provided on a cable fixing head 11A at the other end of the cable in a waterproof joint 10A with the cable. A three-hole flange (as shown in FIG. 26 and FIG. 27) is provided on the connector socket 10, and the connector socket is fixed with a radiator 103 or a heat conductive converting plate 27 on the lamp through the three-hole flange and a fixing screw 25 of the connector socket, and a fixed adjusting rubber pad 24 is provided between the flange and the radiator 103 or the heat conductive converting plate 27 on the lamp to ensure tightness of a waterproof surface, as shown in FIG. 18; or the connector plug 11 is provided with external threads to match with the internal threads of the fixing nut 28 on the connector socket 10 provided with the waterproof rubber ring 16, in order to be fixed to the connector plug 11, as shown in FIG. 19; an slot is provided on the connector socket 10, and the waterproof rubber ring 16 is provided in the slot, wherein the connector socket may also be a non-fixed connector socket as shown in FIG. 28. Meanwhile, in order to shade the electric connector fixed end, the power supply element and the like, and to keep beautiful appearance of the bulb, a ring cover 62 is provided between the inner cover 6 and the inner snap ring 81, as shown in FIG. 12. A small-specification bulb (D≤70 mm) may be not provided with the ring cover 62 or the inner cover 6 generally (may also include the ring cover 62), and the structure thereof and the schematic diagram of assembly of the electric connector are as shown in FIG. 18; the structure of a large aperture bulb (D>70 mm) and the schematic diagram of assembly of the electric connector are as shown in FIG. 19.

Figure 29:
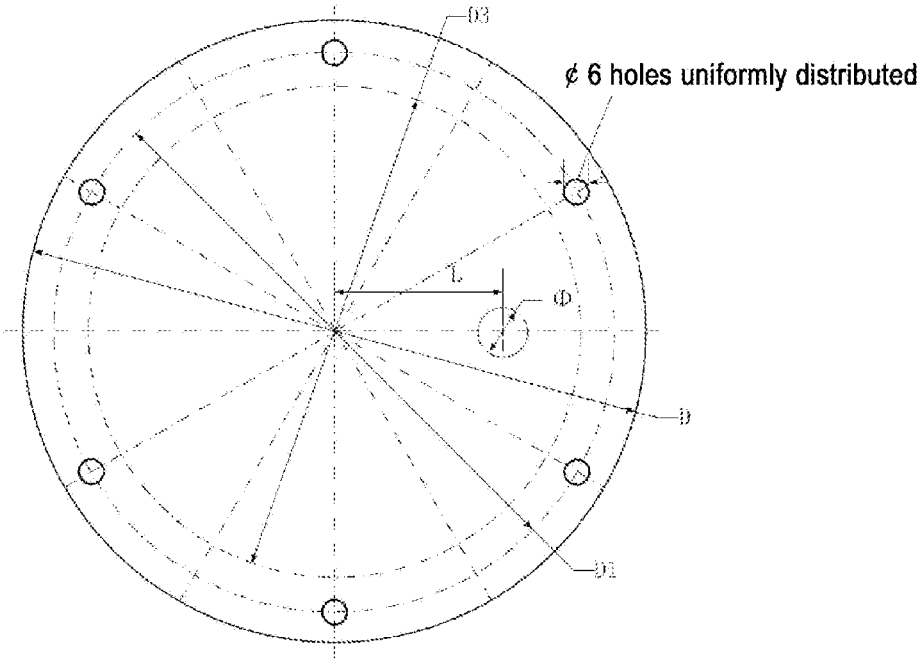
FIG. 29 is a diagram of a size and an opening of a bulb end installation interface in an embodiment of the present invention.

The bulb outer diameter D and an upper limit of the power W of the constructed LED bulb satisfy a relationship $W=1.1812e^{0.0361D}$, discrete values are selected for the diameter D on the relationship curve $W=1.1812e^{0.0361D}$ to construct a plurality of LED bulbs with fixed bulb outer diameters D, in order to improve the interchangeability and universality of the LED bulbs. On the relationship curve $W=1.1812e^{0.0361D}$, 20 mm is used as the lower limit of D, 130 mm is used as the upper limit, each 10 mm is set as a segment, the relationship curve is divided into 12 segments to form limited bulb outer diameter specifications, and the interchangeability and universality of the LED bulbs are further improved by the small amount of bulb outer diameter specifications. A screw hole distribution hole D1 for fixing the bulb and the diameter D2 of an interface opening (an opening used for penetration of the radiator on the installation interface) of the lamp radiator are influenced by the size of the used screw, and the diameter D1 is a value obtained by subtracting a diameter of a fixing screw cap and then subtracting a margin of 0.8-4 mm from an outer diameter D of the LED bulb; the diameter D2 of the radiator interface opening is a value obtained by subtracting a double diameter of the fixing screw cap and then subtracting the margin corresponding to the diameter D1 from the bulb outer diameter D; the value of the wire outgoing hole distance L (namely, the eccentric position of the connector plug on the heat conductive bracket) of the bulb is set according to the following table. In FIG. 1, FIG. 2, FIG. 3, FIG. 4, FIG. 5 and FIG. 33, the outer diameter D of the outline size of the bulb, the diameter D1 of the flange screw distribution circle and the outer diameter D3 of the radiator are manufactured according to specified sizes, and the related sizes are set forth in FIG. 29 and the following table.

| Outer diameter D (mm) of bulb | Diameter D1 (mm) of screw hole distribution circle | Diameter D2 (mm) of radiator interface opening | Wire outgoing hole distance L (mm) | Specification of fixing screw ¢ (mm) | Suitable power (W) |
|---|---|---|---|---|---|
| 20 | 16 | 12 | 2 | M1.6 | <2.5 |
| 30 | 25 | 20 | 2 | M1.6 | <3.5 |
| 40 | 35 | 30 | 2 | M1.6 | <5 |
| 50 | 42 | 34 | 2 | M2.5 | <7 |
| 60 | 52 | 44 | 2 | M2.5 | <10 |
| 70 | 62 | 54 | 2 | M2.5 | <14.5 |
| 80 | 70 | 60 | 18 | M3.5 | <21 |
| 90 | 80 | 70 | 18 | M3.5 | <30 |
| 100 | 90 | 80 | 27 | M3.5 | <44 |
| 110 | 100 | 90 | 27 | M3.5 | <64 |
| 120 | 110 | 100 | 33 | M3.5 | <90 |
| 130 | 120 | 110 | 33 | M3.5 | <130 |

Specific embodiments of lamp using the LED bulb in the present invention are given below.

Embodiment 1-1

An LED tunnel lamp using an extrusion type double-faced radiator structure, including a metal extrusion type double-faced radiator 103 formed by an extrusion process, wherein an LED bulb 102 is provided on the extrusion type double-faced radiator 103, and a lamp housing 101 punch-formed by a metal or die-cast by plastics is provided outside the extrusion type double-faced radiator 103; the extrusion type double-faced radiator 103 is installed on an installation support 106, and an installation interface used for installing the LED bulb 102 is provided on the extrusion type double-faced radiator 103. The extrusion type double-faced radiator 103 includes a substrate, and fins are provided on two sides of the substrate; the installation interface used for installing the LED bulb 102 is provided at one side of the substrate, and circular or elliptic conical spaces are formed by cutting the fins around the installation interface of the substrate according to the illumination angle of the light emitted by the bulb to the extent of not shielding the light emitted by the LED bulb 102; a conducting wire bracket 112 is provided on the other side of the substrate, and the conducting wire bracket 112 is used for connecting a conducting wire led out from the LED bulb 102 to a power supply; the installation interface includes a surface in contact with the LED bulb 102 and a hole connected to the LED bulb on the extrusion type double-faced radiator 103. The extrusion type double-faced radiator 103 is installed on an L-shaped connecting plate 110, the L-shaped connecting plate 110 is fixed to a diversion bracket 108, and the diversion bracket 108 is fixed to the installation support 106, such that the extrusion type double-faced radiator 103 may simultaneously adjust its angle in a horizontal direction and a vertical direction. A vent hole is provided on the lamp housing 101 to ensure the radiating effect of the extrusion type double-faced radiator 103.6 flange fixing holes on the installation interface of the extrusion type double-faced radiator 103 are uniformly distributed at a diameter D1, and the diameter D1 is a value obtained by subtracting a diameter of a fixing screw cap and then subtracting a margin of 0.8-4 mm from an outer diameter D of the LED bulb 102. The L-shaped connecting plate 110 is integrally connected to the extrusion type double-faced radiator 103 through a radiator fixing screw 111, the L-shaped connecting plate 110 is fixed to the diversion bracket 108 through a diversion bracket fixing screw 109, the diversion bracket 108 is fixed to the installation support 106 through an installation support rotation fixing screw 107, and a conducting wire fixing frame 113 is provided on the installation support 106.

Embodiment 1-2

Figure 34:
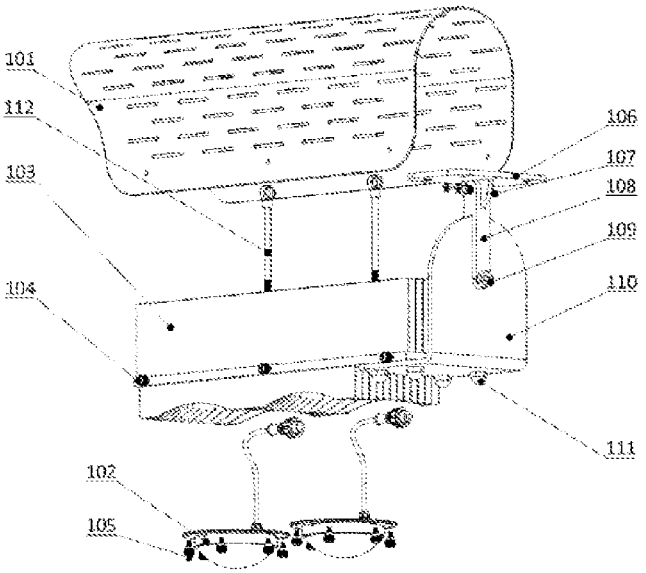
FIG. 34 is a schematic diagram of structures of embodiment 1-2 in the present invention.
Figure 35:
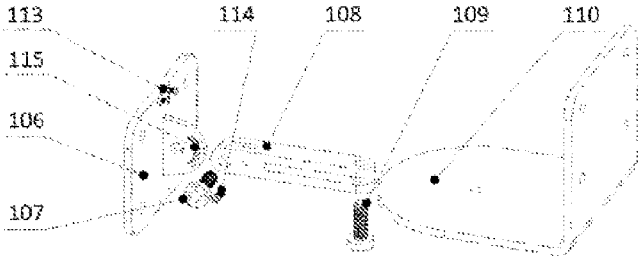
FIG. 35 is a schematic diagram of a structure of an installation support in embodiment 1-2 of the present invention.
Figure 40:
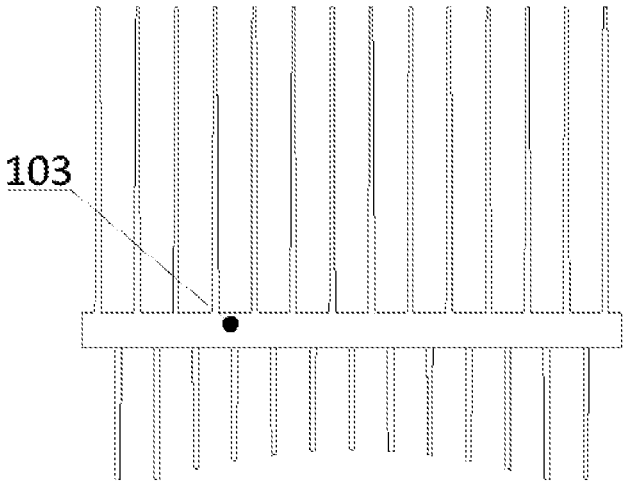
FIG. 40 is a sectional view of an extrusion type double-faced radiator in embodiment 1 of the present invention.
Figure 41:
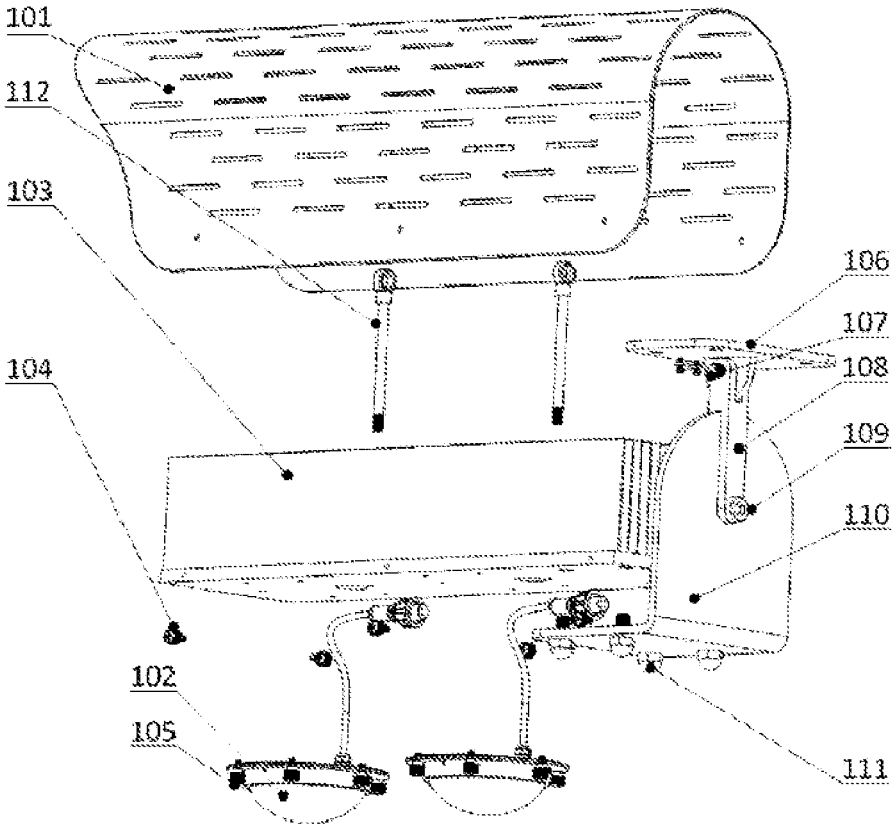
FIG. 41 is a schematic diagram of structures of embodiments 2-1 in the present invention.

An LED street lamp using an extrusion type double-faced radiator structure, as shown in FIG. 34, including a metal extrusion type double-faced radiator 103 formed by an extrusion process, wherein an LED bulb 102 is provided on the extrusion type double-faced radiator 103, and a lamp housing 101 punch-formed by a metal or die-cast by plastics is provided outside the extrusion type double-faced radiator 103; the extrusion type double-faced radiator 103 is installed on an installation support 106, and an installation interface used for installing the LED bulb 102 is provided on the extrusion type double-faced radiator 103. The extrusion type double-faced radiator 103 includes a substrate, and fins are provided at the two sides of the substrate, as shown in FIG. 41; the installation interface used for installing the LED bulb 102 is provided at one side of the substrate, and circular or elliptic conical spaces are formed by cutting the fins around the installation interface of the substrate according to the illumination angle of the light emitted by the bulb to the extent of not shielding the light emitted by the LED bulb 102; a conducting wire bracket 112 is provided at the other side of the substrate, and the conducting wire bracket 112 is used for connecting a conducting wire led out from the LED bulb 102 to a power supply and a control circuit; the installation interface includes a surface in contact with the LED bulb 102 and a hole connected to the LED bulb on the extrusion type double-faced radiator 103. The extrusion type double-faced radiator 103 is installed on an L-shaped connecting plate 110, the L-shaped connecting plate 110 is fixed to a diversion bracket 108, and the diversion bracket 108 is fixed to the installation support 106, such that the extrusion type double-faced radiator 103 may simultaneously adjust its angle in a horizontal direction and a vertical direction. A vent hole is provided on the lamp housing 101 to ensure the radiating effect of the extrusion type double-faced radiator 103.6 flange fixing holes on the installation interface of the extrusion type double-faced radiator 103 are uniformly distributed at a diameter D1, and the diameter D1 is a value obtained by subtracting a diameter of a fixing screw cap and then subtracting a margin of 0.8-4 mm from an outer diameter D of the LED bulb 102. The L-shaped connecting plate 110 is integrally connected to the extrusion type double-faced radiator 103 through a radiator fixing screw 111, the L-shaped connecting plate 110 is fixed to the diversion bracket 108 through a diversion bracket fixing screw 109, the diversion bracket 108 is fixed to the installation support 106 through an installation support rotation fixing screw 107, and a conducting wire fixing frame 113 is provided on the installation support 106, as shown in FIG. 35 and FIG. 40.

Figure 36:
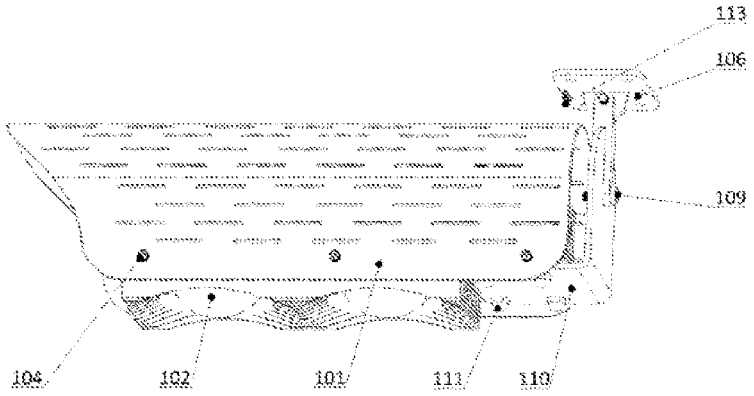
FIG. 36 is a schematic diagram of ceiling application in embodiment 1-2 of the present invention.

When in use, the present invention may be used vertically or used in a vertical ceiling manner, as shown in FIG. 36.

Figure 37:
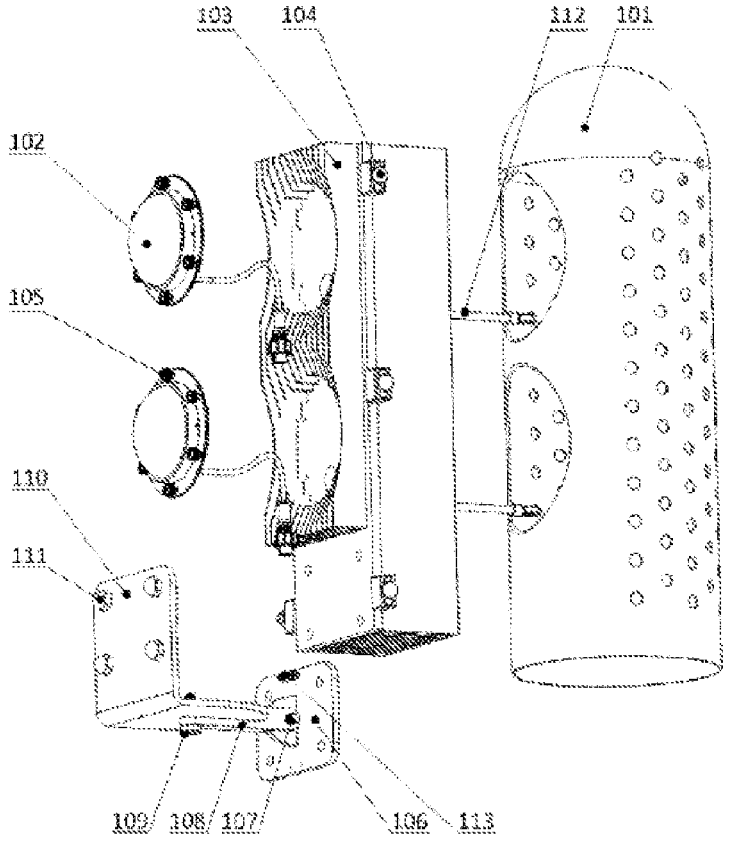
FIG. 37 is a schematic diagram of a structure when a columnar lamp housing is adopted in embodiment 1 of the present invention.
Figure 38:
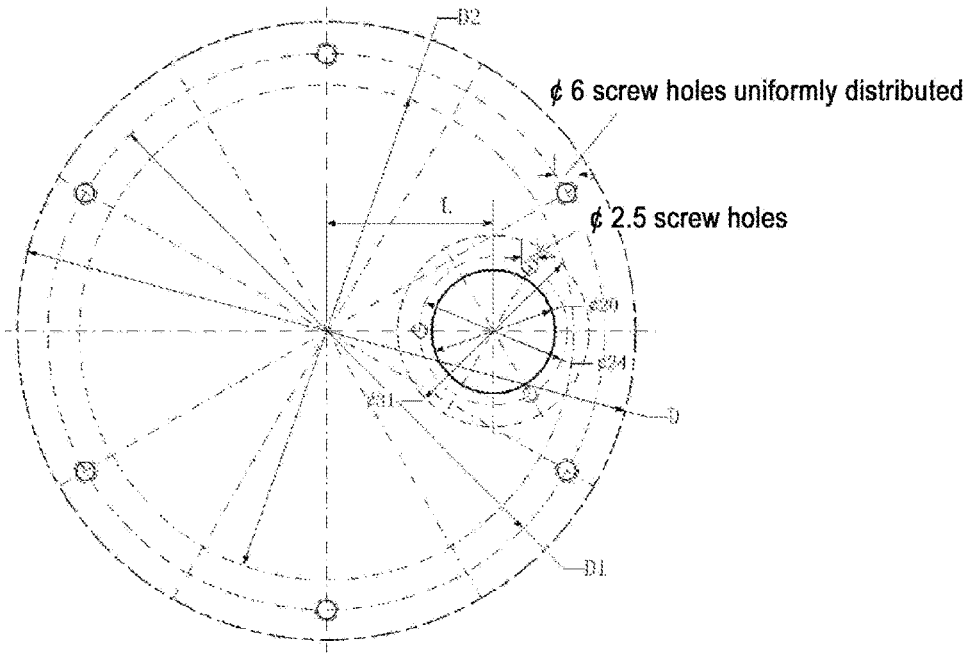
FIG. 38 is a schematic diagram of an installation interface opening of an extrusion type double-faced radiator in embodiment 1 of the present invention.
Figure 39:
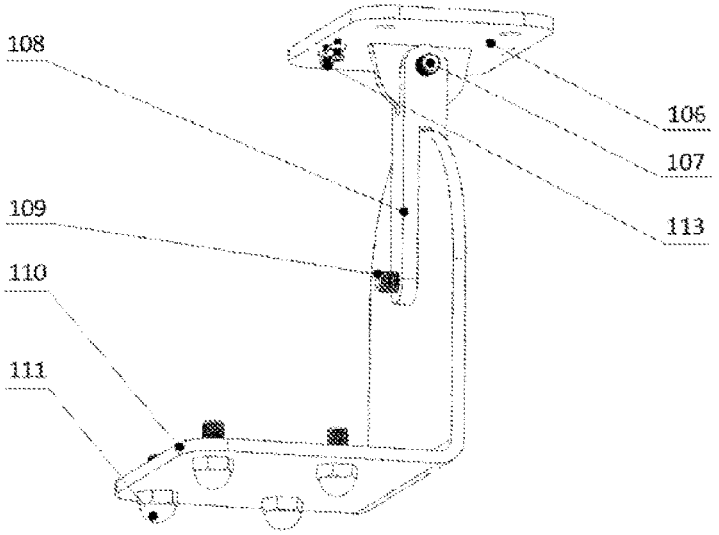
FIG. 39 is a schematic diagram of assembly of an installation support in embodiment 1-2 of the present invention.

The lamp housing 101 in the present invention may also be columnar, and a semicircular top is sealed, as shown in FIG. 37; no hole is provided on the top of the lamp housing 101 to be used in environments with heavy dust, so as to ensure that the descending dust will not drop into the lamp housing 101 when the lamp housing 101 is vertically installed for use.

In the present invention, in the case of an accident of the tunnel lamp, the LED bulb 102 may be conveniently detached and installed just by detaching the lamp housing 101, so that the LED bulb is very convenient to maintain and change.

Figure 43:
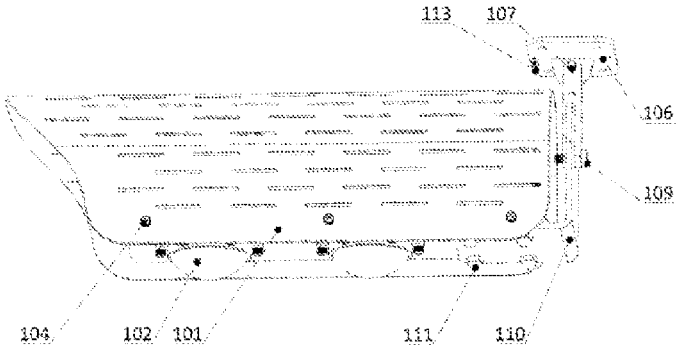
FIG. 43 is a schematic diagram of ceiling application in embodiment 2-1 of the present invention.

In the tunnel lamp in the present invention, an installation support turning locking groove 115 is engraved on the installation support 106, after the illumination angle of the lamp is adjusted, an installation support rotation fixing screw 107 (the screw is used for locking the lamp along the gravity direction to prevent loosening) and a diversion bracket fixing screw 109 may be screwed, meanwhile, an installation support turning locking screw 114 is screwed into the installation support turning locking groove 115 to prevent the illumination direction from changing, as shown in FIG. 43. Different from the condition that the weight of the traditional tunnel lamp itself is too large to be flexible, one property of the tunnel lamp in the present invention is that the illumination angle may be simultaneously adjusted in the horizontal and vertical directions by adjusting the diversion bracket fixing screw 109 and the installation support rotation fixing screw 107; the illumination direction may be adjusted just like a flashlight to be along the driving direction, to enable a driver to see no light source so as to effectively reduce the tunnel lighting glare problem to ensure better vehicle driving safety.

In the lamp of the embodiment, the extrusion type double-faced radiator is used as the installation bracket, and the LED bulb and other auxiliary components are overall integrally installed on the extrusion type double-faced radiator, so that the structure is simple, the manufacturing cost is low, and the installation, use and maintenance are convenient. The lamp in the present invention may operate in a vertical, upward or ceiling manner, when operateoperating vertically, all fins of the extrusion type double-faced radiator are vertical to the ground, thus the vertically descending dust will not be accumulated on the fins, and the horizontally flying dust will be shaded by the lamp housing so as not to be accumulated on the fins; when the lamp in the present invention is used in the upward or ceiling manner, upper and lower fins are at two different heat operateoperating states, meanwhile due to the protection of the lamp housing, severe pollution of the fins on any single surface will not cause ineffectiveness of the radiator; the lamp in the present invention has very strong wind resistance, water resistance, dust plug resistance and pest plug resistance, and the lamp in the present invention may still operate normally even if in environments with particularly severe dust and without water flush for long time. Different from the condition that the weight of the traditional tunnel lamp itself is too large to be flexible, in the present invention, the illumination angle may be simultaneously adjusted in the horizontal and vertical directions; the illumination direction may be adjusted just like a flashlight to be along the driving direction, to enable a driver to see no light source so as to effectively reduce the tunnel lighting glare problem to ensure better vehicle driving safety. The LED tunnel lamp in the present invention only has two components, namely the lamp with the extrusion type double-faced radiator as the core component and the LED bulb, thus the integral structure of the constructed LED tunnel lamp is simple; in the LED tunnel lamp in the present invention, the extrusion type double-faced radiator and the LED bulb do not need to be produced at the same time, and during installation, the extrusion type double-faced radiator and the LED bulb do not need to be installed at the same time either; the lamp and the LED bulb are independently produced and used, thereby greatly reducing the production procedures, improving mass production, facilitating standardized mass production, benefiting the industrialization of LED energy-saving lighting products and realizing very high universality and interchangeability.

The meanings of the reference numerals in the embodiment are as follows: 101—lamp housing, 102—LED bulb, 103—extrusion type double—faced radiator, 104—lamp housing fixing screw, 105—bulb fixing screw, 106—installation support, 107—installation support rotation fixing screw, 108—diversion bracket, 109—diversion bracket fixing screw, 110—L—shaped connecting plate, 111—radiator fixing screw, 112—conducting wire bracket, 113—conducting wire fixing frame, 114—installation support reserving locking screw, and 115—installation support turning locking groove.

Embodiment 2-1

Figure 42:
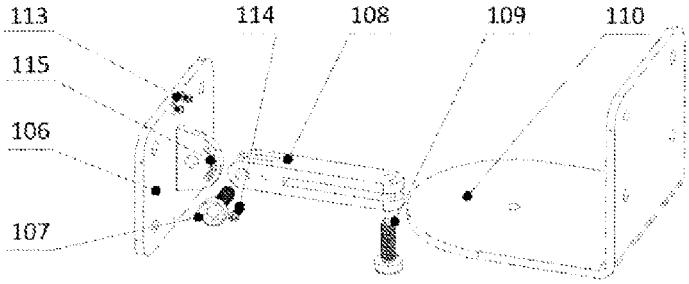
FIG. 42 is a schematic diagram of a structure of an installation support in embodiment 2-1 of the present invention.

An LED tunnel lamp using an extrusion type radiator structure, as shown in FIG. 42, including a metal extrusion type radiator 103 formed by an extrusion process, wherein an LED bulb 102 is provided on the extrusion type radiator 103, and a lamp housing 101 punch-formed by a metal or die-cast by plastics is provided outside the extrusion type radiator 103; the extrusion type radiator 103 is installed on an installation support 106, and an installation interface used for installing the LED bulb 102 is provided on the extrusion type radiator 103. The extrusion type radiator 103 includes a substrate, and fins are provided at one side of the substrate; the installation interface used for installing the LED bulb 102 is provided at the other side of the substrate; a conducting wire bracket 112 is provided at the side of the substrate on which the fins are provided, and the conducting wire bracket 112 is used for connecting a conducting wire led out from the LED bulb 102 to a power supply and a control circuit; the installation interface includes a surface in contact with the LED bulb 102 and a hole connected to the LED bulb, on the extrusion type radiator 103. The extrusion type radiator 103 is installed on an L-shaped connecting plate 110, the L-shaped connecting plate 110 is fixed to a diversion bracket 108, and the diversion bracket 108 is fixed to the installation support 106, such that the extrusion type radiator 103 may simultaneously adjust its angle in a horizontal direction and a vertical direction. A vent hole is provided on the lamp housing 101 to ensure the radiating effect of the extrusion type radiator 103.6 flange fixing holes on the installation interface of the extrusion type radiator 103 are uniformly distributed at a diameter D1, and the diameter D1 is a value obtained by subtracting a diameter of a fixing screw cap and then subtracting a margin of 0.8-4 mm from an outer diameter D of the LED bulb 102. The LED bulb is installed on the installation interface through a bulb fixing screw 105. The L-shaped connecting plate 110 is integrally connected to the extrusion type radiator 103 through a radiator fixing screw 111, the L-shaped connecting plate 110 is fixed to the diversion bracket 108 through a diversion bracket fixing screw 109, the diversion bracket 108 is fixed to the installation support 106 through an installation support rotation fixing screw 107, and a conducting wire fixing frame 113 is provided on the installation support 106.

Embodiment 2-2

Figure 2:
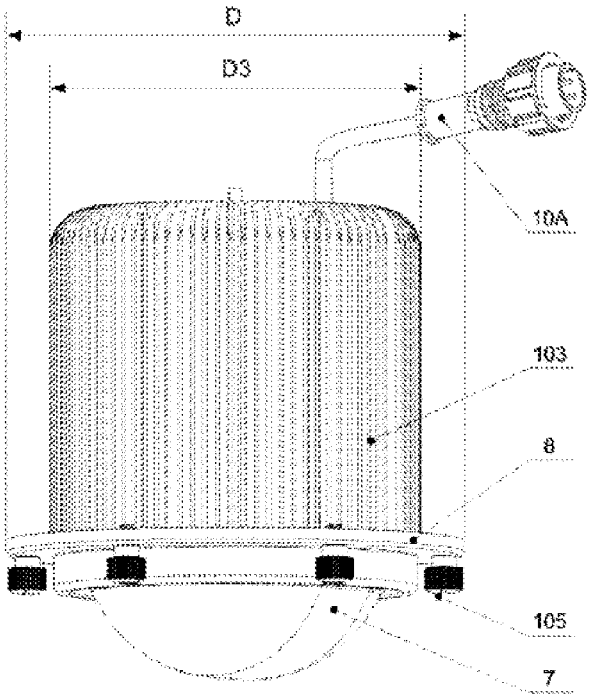
FIG. 2 is an external view of a bulb convex lens solution with a metal radiator in the present invention.
Figure 3:
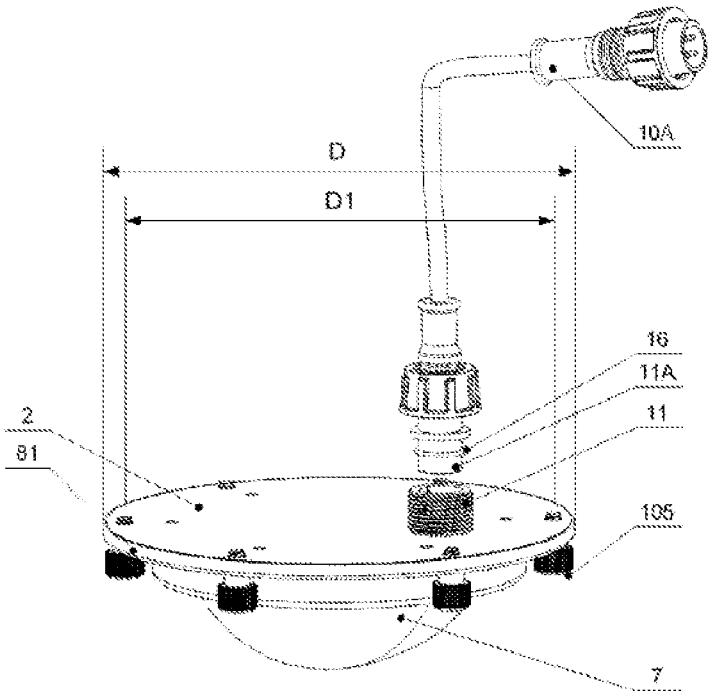
FIG. 3 is an external view of a bulb convex lens solution in the present invention.
Figure 4:
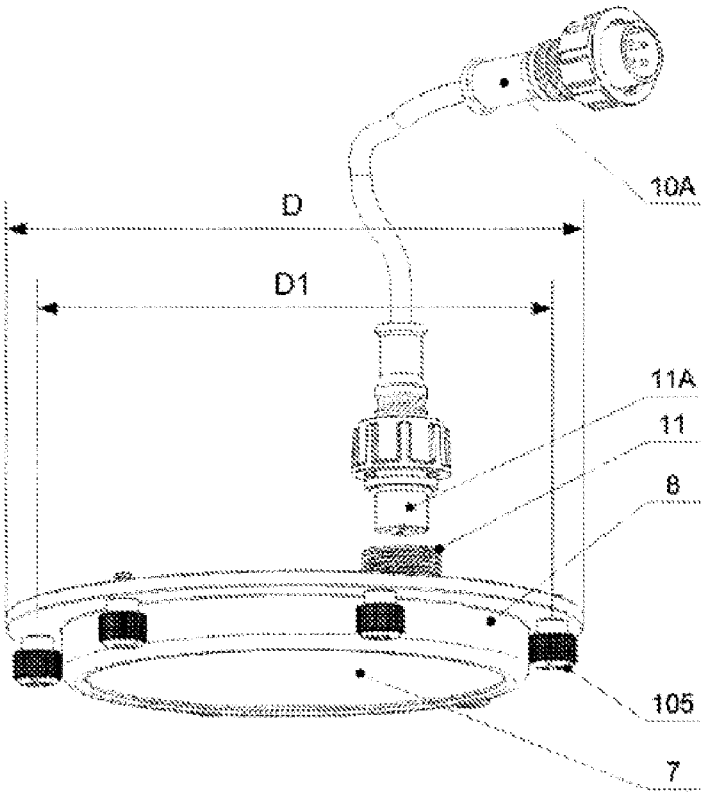
FIG. 4 is an external view of a bulb plate lens solution in the present invention.
Figure 5:
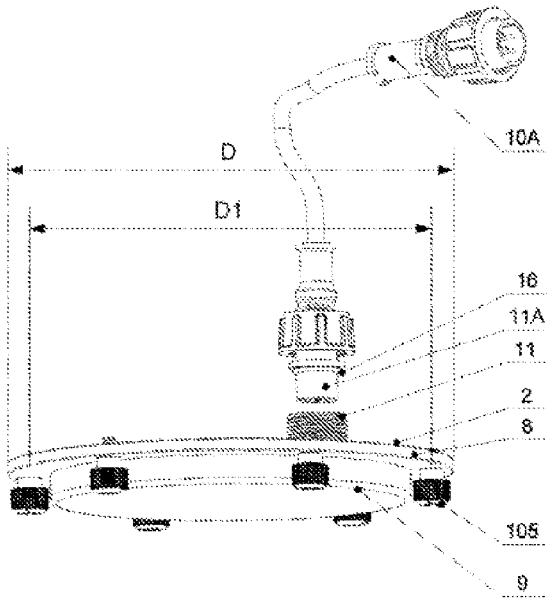
FIG. 5 is an external view of a flat bulb outer cover solution in the present invention.

An LED tunnel lamp using an extrusion type radiator structure, as shown in FIG. 1 and FIG. 28, including a metal extrusion type radiator 103 formed by an extrusion process, wherein an LED bulb 102 is provided on the extrusion type radiator 103, and a lamp housing 101 punch-formed by a metal or die-cast by plastics is provided outside the extrusion type radiator 103; the extrusion type radiator 103 is installed on an installation support 106, and an installation interface used for installing the LED bulb 102 is provided on the extrusion type radiator 103. The extrusion type radiator 103 includes a substrate, and fins are provided at one side of the substrate, as shown in FIG. 31; the installation interface used for installing the LED bulb 102 is provided at the other side of the substrate; a conducting wire bracket 112 is provided at the side of the substrate on which the fins are provided, and the conducting wire bracket 112 is used for connecting a conducting wire led out from the LED bulb 102 to a power supply and a control circuit; the installation interface includes a surface in contact with the LED bulb 102 and a hole connected to the LED bulb, on the extrusion type radiator 103. The extrusion type radiator 103 is installed on an L-shaped connecting plate 110, the L-shaped connecting plate 110 is fixed to a diversion bracket 108, and the diversion bracket 108 is fixed to the installation support 106, such that the extrusion type radiator 103 may simultaneously adjust its angle in a horizontal direction and a vertical direction. A vent hole is provided on the lamp housing 101 to ensure the radiating effect of the extrusion type radiator 103.6 flange fixing holes on the installation interface of the extrusion type radiator 103 are uniformly distributed at a diameter D1, and the diameter D1 is a value obtained by subtracting a diameter of a fixing screw cap and then subtracting a margin of 0.8-4 mm from an outer diameter D of the LED bulb 102. The LED bulb is installed on the installation interface through a bulb fixing screw 105. The L-shaped connecting plate 110 is integrally connected to the extrusion type double-faced radiator 103 through a radiator fixing screw 111, the L-shaped connecting plate 110 is fixed to the diversion bracket 108 through a diversion bracket fixing screw 109, the diversion bracket 108 is fixed to the installation support 106 through an installation support rotation fixing screw 107, and a conducting wire fixing frame 113 is provided on the installation support 106, as shown in FIG. 2 and FIG. 30.

Figure 44:
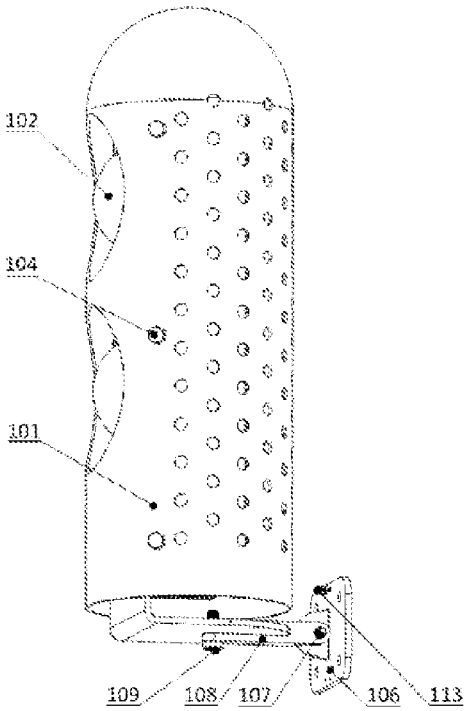
FIG. 44 is a schematic diagram of vertical use when a barrel-shaped lamp housing is adopted in embodiment 2 of the present invention.

When in use, the present invention may be used vertically or used in a vertical ceiling manner, as shown in FIG. 44.

Figure 45:
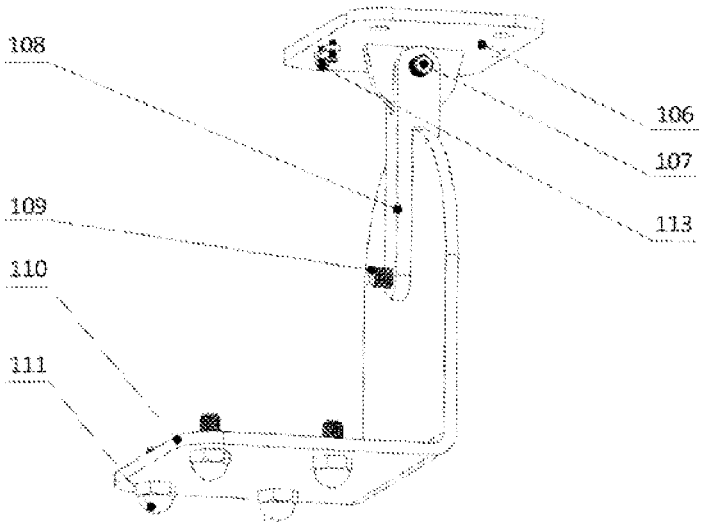
FIG. 45 is a schematic diagram of assembly of an installation support in embodiment 2-1 of the present invention.
Figure 46:
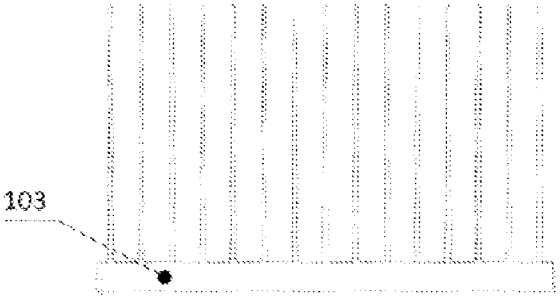
FIG. 46 is a sectional view of an extrusion type radiator in embodiment 2 of the present invention.
Figure 47:
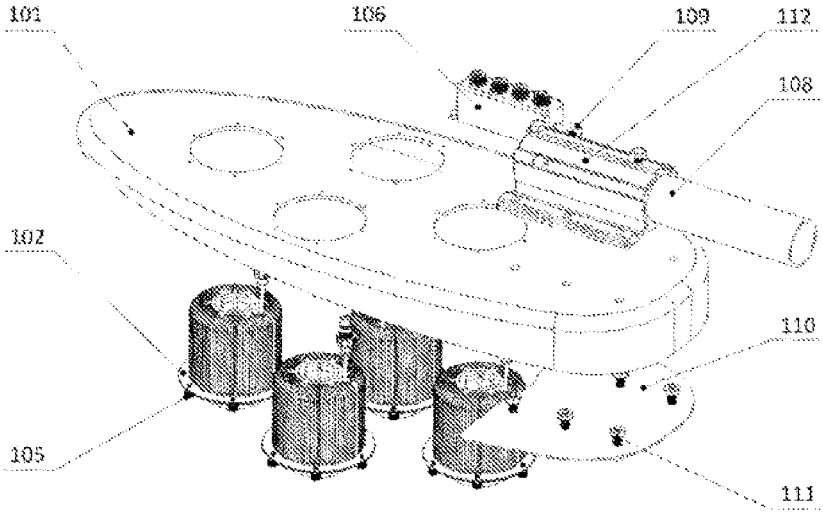
FIG. 47 is a schematic diagram of a structure of an LED bulb with waterproof and dustproof functions and provided with a radiator in embodiment 3-2 of the present invention.
Figure 48:
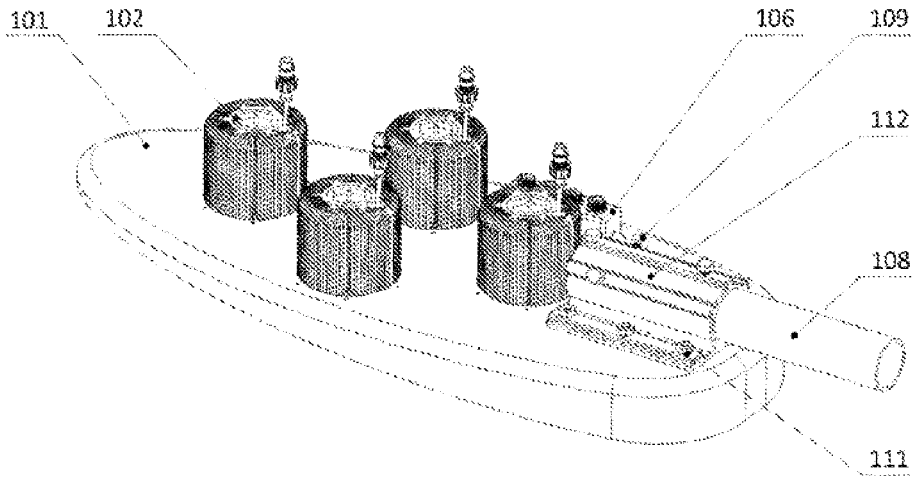
FIG. 48 is a use state diagram of an LED bulb with waterproof and dustproof functions and provided with a radiator in embodiment 3-2 of the present invention.

The lamp housing 101 in the present invention may also be barrel-shaped, as shown in FIG. 45; no hole is provided on the top of the lamp housing 101, so as to ensure that the descending dust will not drop into the lamp housing 101 when the lamp housing 101 is vertically installed for use.

In the present invention, in the case of an accident, the LED bulb 102 may be conveniently detached and installed just by detaching the lamp housing 101, so that the LED bulb is very convenient to maintain and change.

In the tunnel lamp in the present invention, an installation support turning locking groove 115 is engraved on the installation support 106, after the illumination angle of the lamp is adjusted, an installation support rotation fixing screw 107 (the screw is used for locking the lamp along the gravity direction to prevent loosening) and a diversion bracket fixing screw 109 may be screwed, meanwhile, an installation support turning locking screw 114 is screwed into the installation support turning locking groove 115 to prevent the illumination direction from changing, as shown in FIG. 35. Different from the condition that the weight of the traditional tunnel lamp itself is too large to be flexible, one property of the tunnel lamp in the present invention is that the illumination angle may be simultaneously adjusted in the horizontal and vertical directions by adjusting the diversion bracket fixing screw 109 and the installation support rotation fixing screw 107; the illumination direction may be adjusted just like a flashlight to be along the driving direction, to enable a driver to see no light source so as to effectively reduce the tunnel lighting glare problem to ensure better vehicle driving safety.

In the lamp of the embodiment, the extrusion type radiator is used as the installation bracket, and the LED bulb and other auxiliary components are overall integrally installed on the extrusion type radiator, so that the structure is simple, the manufacturing cost is low, and the installation, use and maintenance are convenient. The lamp in the present invention may operate in a vertical, upward or ceiling manner, when operateoperating vertically, the fins of the extrusion type radiator are vertical to the ground, thus the vertically descending dust will not be accumulated on the fins, and the horizontally flying dust will be shaded by the lamp housing so as not to be accumulated on the fins; when being used in the upward or ceiling manner, the fins of the extrusion type radiator are at an operateoperating state of being vertical to the ground, meanwhile due to the protection of the lamp housing, severe dust accumulation of the fins is unlikely to form, such that the lamp in the present invention has very strong wind resistance, water resistance, dust plug resistance and pest plug resistance. Different from the condition that the weight of the traditional tunnel lamp itself is too large to be flexible, in the present invention, the illumination angle may be simultaneously adjusted in the horizontal and vertical directions; the illumination direction may be adjusted just like a flashlight to be along the driving direction, to enable a driver to see no light source so as to effectively reduce the tunnel lighting glare problem to ensure better vehicle driving safety. The LED tunnel lamp in the embodiment only has two components, namely the lamp with the extrusion type radiator as the core component and the LED bulb, thus the integral structure of the constructed LED tunnel lamp is simple; in the LED tunnel lamp in the present invention, the extrusion type radiator and the LED bulb do not need to be produced at the same time, and during installation, the extrusion type radiator and the LED bulb do not need to be installed at the same time either; the lamp and the LED bulb are independently produced and used, thereby greatly reducing the production procedures of the LED lighting products, improving mass production, facilitating standardized mass production, benefiting the industrialization of LED energy-saving lighting products and realizing very high universality and interchangeability.

In the present invention, the installation structure of the bulb component is transferred onto a bracket lining, such that the structure between the LED chip and the radiating component is simpler, the heat generated by the chip will be quickly transferred onto the heat conductive bracket for dispersion, thereby being conductive to cooling the LED chip and prolonging the service life of the LED chip. The bracket lining is made of a nonmetal material and is riveted with the metal heat conductive bracket via hot pressing, thereby being not only stable in structure, but also capable of achieving seamless combination of the heat conductive bracket and the bracket lining so as to ensure better water resistance of the optical engine module clamped between the heat conductive bracket and the bracket lining, after the outer cover or the lens is installed.

The extrusion type radiator in the present invention does not need to undertake more waterproof and insect prevention functions like the traditional tunnel lamp, compared with the traditional tunnel lamp, the LED bulb in the present invention has enough waterproof and insect prevention functions.

Therefore, the integral practicability, beautiful appearance and individuality of the lamp may be better considered in the design of the LED tunnel lamp in the present invention.

The meanings of the reference numerals in the embodiment are as follows: 101—lamp housing, 102—LED bulb, 103—extrusion type radiator, 104—lamp housing fixing screw, 105—bulb fixing screw, 106—installation support, 107—installation support rotation fixing screw, 108—diversion bracket, 109—diversion bracket fixing screw, 110—L—shaped connecting plate, 111—radiator fixing screw, 112—conducting wire bracket, 113—conducting wire fixing frame, 114—installation support reserving locking screw, and 115—installation support turning locking groove.

Embodiment 3-1

An LED street lamp using a multifunctional lamp housing as an installation interface bracket structure, including the multifunctional lamp housing 101 punch-formed by a metal sheet by a stamping process, wherein the multifunctional lamp housing 101 is fixed to a lamp post 108 through a lamp post fixing member; one or more installation interface used for installing an LED bulb 102 is provided on the multifunctional lamp housing 101, and the LED bulb 102 with waterproof and dustproof functions and provided with a radiator is installed on the installation interface. A wire harness connector 106 is provided on the multifunctional lamp housing 101, and the wire harness connector 106 is used for connecting a plurality of LED bulbs 102 to a power supply and a control circuit; an edgefold for reinforcing the structural strength is further provided at the edge of the multifunctional lamp housing 101; the installation interface includes a surface in contact with the LED bulb and a hole connected to the LED bulb, on the multifunctional lamp housing 101. The lamp post fixing member includes a lamp post fixing bracket 112 and a reinforcing plate 110, wherein the lamp post fixing bracket 112 and the reinforcing plate 110 are provided at the upper and lower sides of the multifunctional lamp housing 101; the multifunctional lamp housing 101 is fixed to the lamp post 108 through the lamp post fixing bracket 112 and the reinforcing plate 110, or the multifunctional lamp housing 101 is directly fixed to the lamp post 108 through the lamp post fixing bracket 112. A radiator interface opening and 6 flange fixing holes are provided on the installation interface of the bulb, the flange fixing holes are used for fixing the LED bulb 102, and the radiator interface opening is used for enabling the radiator of the LED bulb 102 to penetrate through the installation interface; the flange fixing holes are uniformly distributed at a diameter D1, and the diameter D1 is a value obtained by subtracting a diameter of a fixing screw cap and then subtracting a margin of 0.8-4 mm from an outer diameter D of the LED bulb 102; the diameter D2 of the radiator interface opening is a value obtained by subtracting two times of a diameter of the fixing screw cap and then subtracting two times of the margin corresponding to diameter D1 from the outer diameter D of the bulb. The LED bulb 102 is installed on the installation interface through a bulb fixing screw 105, the lamp post 108 is installed on the lamp post fixing bracket through a lamp post fixing screw 104, and the lamp post fixing bracket 112 and the reinforcing plate 110 are installed on the multifunctional lamp housing 101 through a lamp post fixing bracket bolt 111.

Embodiment 3-2

Figure 49:
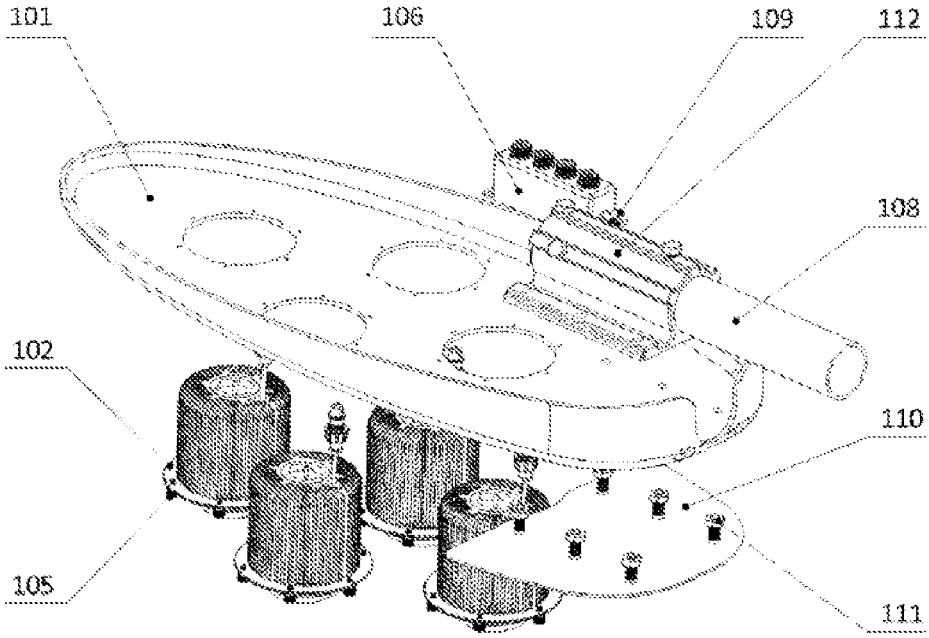
FIG. 49 is a schematic diagram of another structure of an LED bulb with waterproof and dustproof functions and provided with a radiator in embodiment 3-2 of the present invention.
Figure 50:
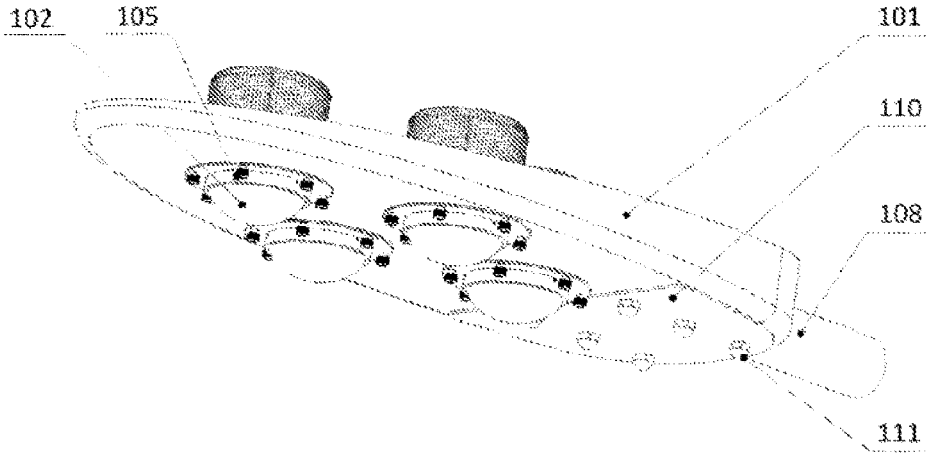
FIG. 50 is another use state diagram of an LED bulb with waterproof and dustproof functions and provided with a radiator in embodiment 3-2 of the present invention.

An LED street lamp using a multifunctional lamp housing as an installation interface bracket structure, as shown in FIG. 49 and FIG. 50, including the multifunctional lamp housing 101 punch-formed by a metal sheet by a stamping process, wherein the multifunctional lamp housing 101 is fixed to a lamp post 108 through a lamp post fixing member; one or more installation interface used for installing an LED bulb 102 is provided on the multifunctional lamp housing 101, and the LED bulb 102 is installed on the installation interface. A wire harness connector 106 is provided on the multifunctional lamp housing 101, and the wire harness connector 106 is used for connecting a plurality of LED bulbs 102 to a power supply and a control circuit; an edgefold for reinforcing the structural strength is further provided at the edge of the multifunctional lamp housing 101; the installation interface includes a surface in contact with the LED bulb and a hole connected to the LED bulb, on the multifunctional lamp housing 101. The lamp post fixing member includes a lamp post fixing bracket 112 and a reinforcing plate 110, wherein the lamp post fixing bracket 112 and the reinforcing plate 110 are provided at the upper and lower sides of the multifunctional lamp housing 101; the multifunctional lamp housing 101 is fixed to the lamp post 108 through the lamp post fixing bracket 112 and the reinforcing plate 110, or the multifunctional lamp housing 101 is directly fixed to the lamp post 108 through the lamp post fixing bracket 112. A radiator interface opening and 6 flange fixing holes are provided on the installation interface of the bulb, the flange fixing holes are used for fixing the LED bulb 102, and the radiator interface opening is used for enabling the LED bulb 102 to penetrate through the installation interface; the flange fixing holes are uniformly distributed at a diameter D1, and the diameter D1 is a value obtained by subtracting a diameter of a fixing screw cap and then subtracting a margin of 0.8-4 mm from an outer diameter D of the LED bulb 102; the diameter D2 of the radiator interface opening is a value obtained by subtracting two times of a diameter of the fixing screw cap and then subtracting two times of the margin corresponding to the diameter D1 from the outer diameter D of the bulb. The LED bulb 102 is installed on the installation interface through a bulb fixing screw 105, the lamp post 108 is installed on the lamp post fixing bracket through a lamp post fixing screw 104, and the lamp post fixing bracket 112 and the reinforcing plate 110 are installed on the multifunctional lamp housing 101 through a lamp post fixing bracket bolt 111.

Figure 51:
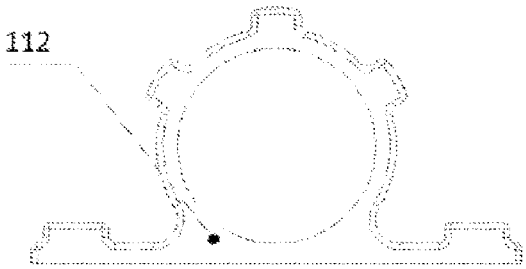
FIG. 51 is a projection drawing of a lamp post fixing bracket in embodiment 3 of the present invention.
Figure 52:
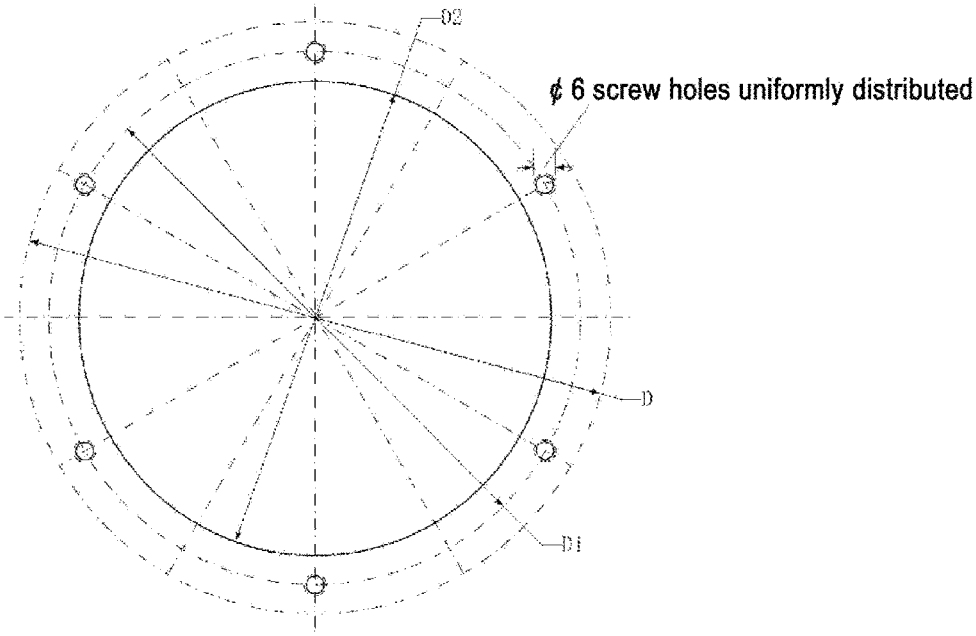
FIG. 52 is a schematic diagram of a radiator interface opening of a multifunctional lamp housing in embodiment 3 of the present invention.

In embodiment 3-2, different states of the outline of the multifunctional lamp housing may also be adopted according to different use environments, as shown in FIG. 51 and FIG. 52.

Figure 53:
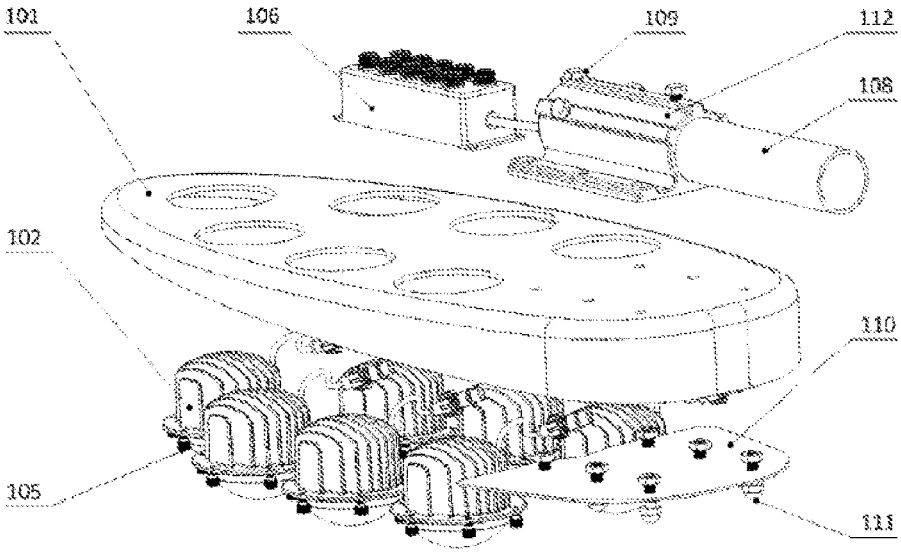
FIG. 53 is a schematic diagram of a structure when an LED bulb with waterproof and dustproof functions is adopted in embodiment 3-2 of the present invention.
Figure 54:
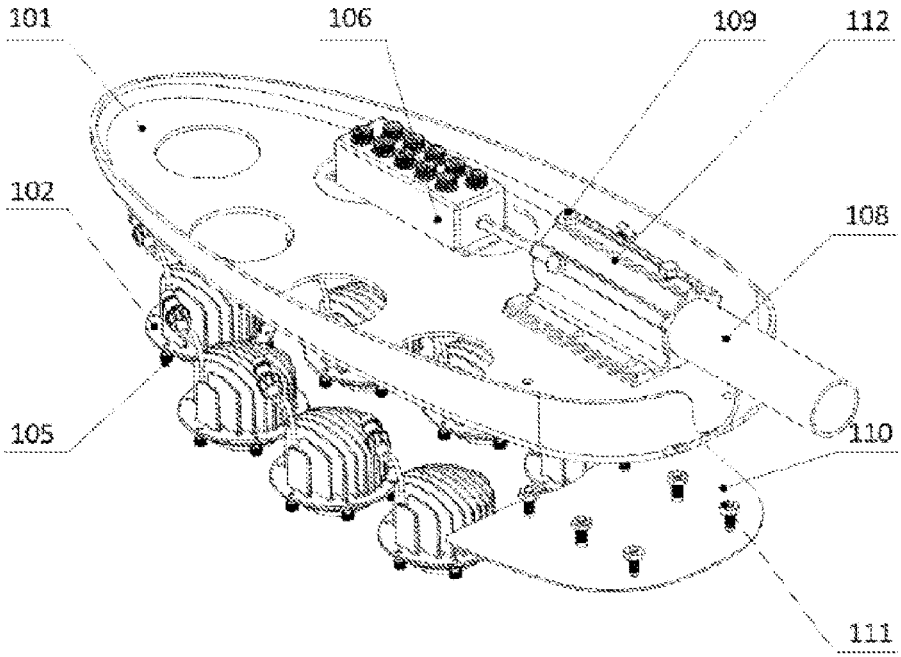
FIG. 54 is a schematic diagram of another structure when an LED bulb with waterproof and dustproof functions is adopted in embodiment 3-2 of the present invention.
Figure 55:
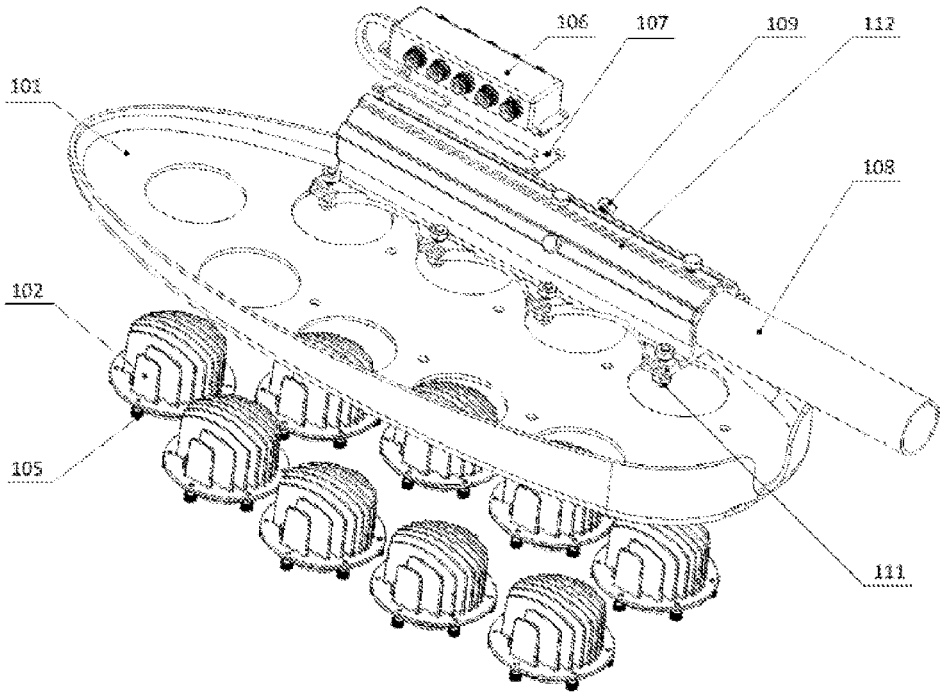
FIG. 55 is a schematic diagram of a structure when a multifunctional lamp housing is directly fixed to a lamp post through a lamp post fixing bracket in embodiment 3-2 of the present invention.
Figure 56:
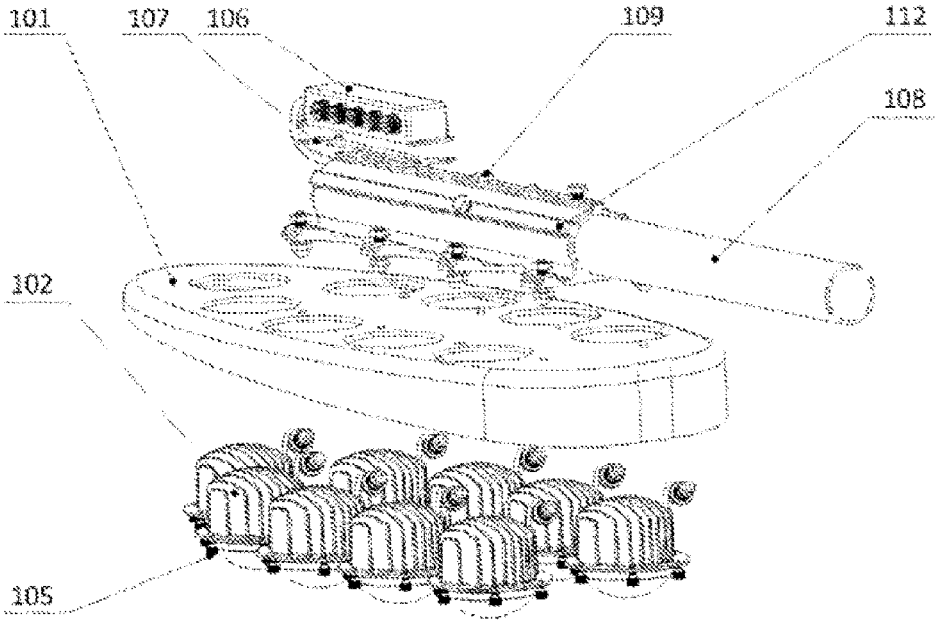
FIG. 56 is a schematic diagram of another structure when a multifunctional lamp housing is directly fixed to a lamp post through a lamp post fixing bracket in embodiment 3-2 of the present invention.

In embodiment 2, the second LED bulb is adopted, as shown in FIG. 53 and FIG. 54.

Figure 57:
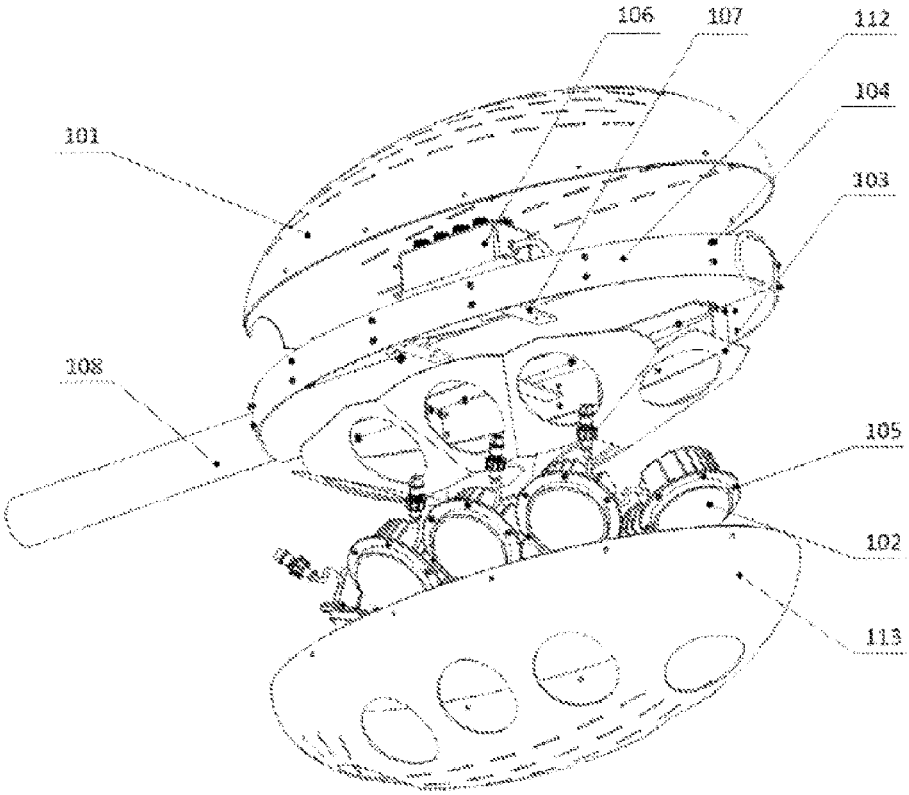
FIG. 57 is a schematic diagram of a structure of embodiment 4 of the present invention.
Figure 58:
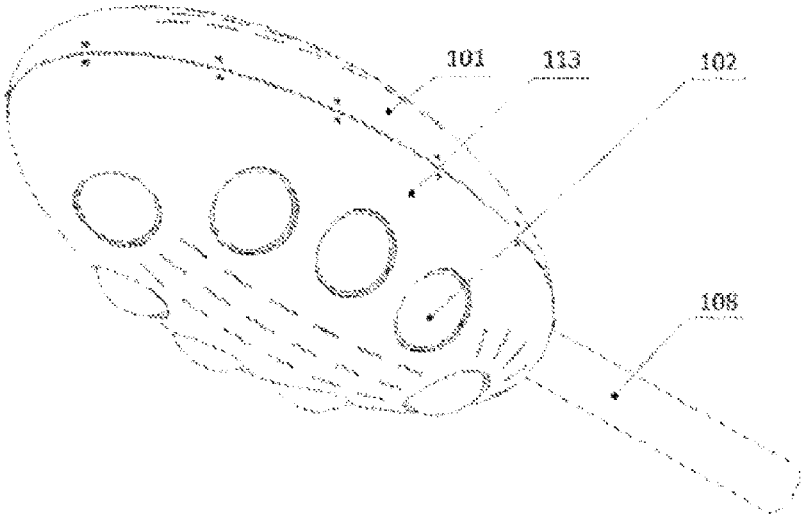
FIG. 58 is an external view of embodiment 4 of the present invention.
Figure 59:
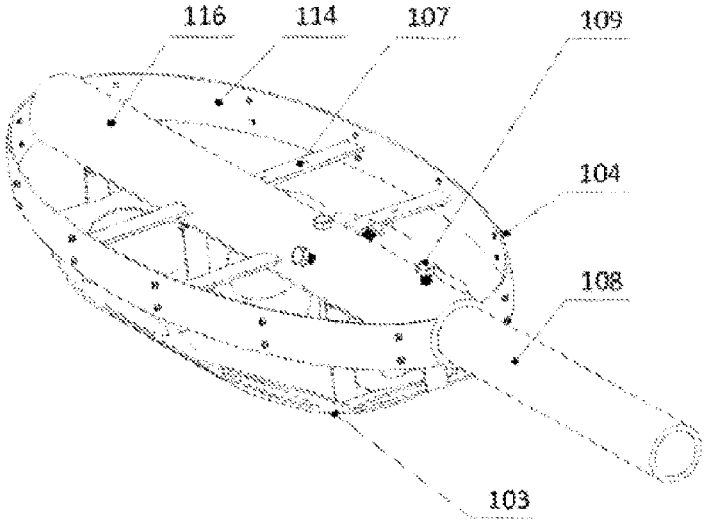
FIG. 59 is a structure diagram of an installation interface plate fixing bracket in embodiment 4 of the present invention.
Figure 60:
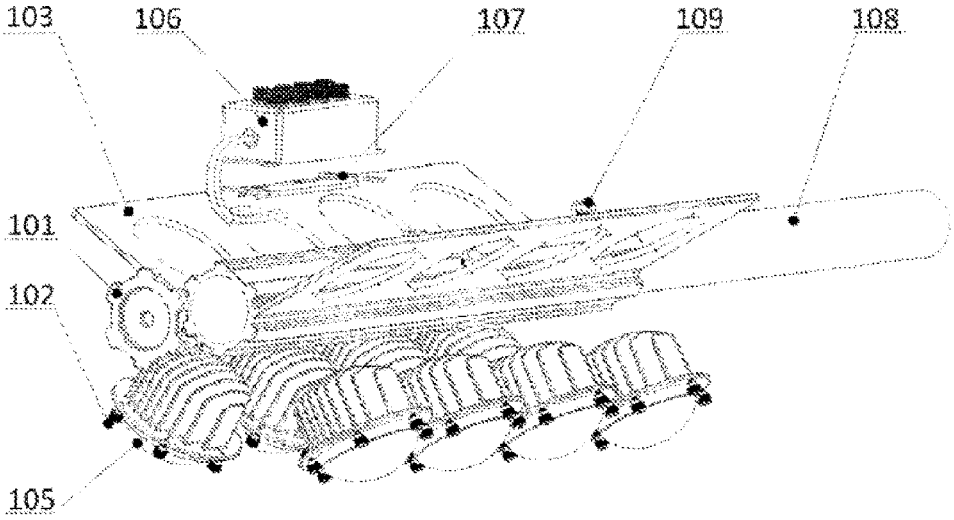
FIG. 60 is a schematic diagram of a structure of embodiment 5 in the present invention.
Figure 61:
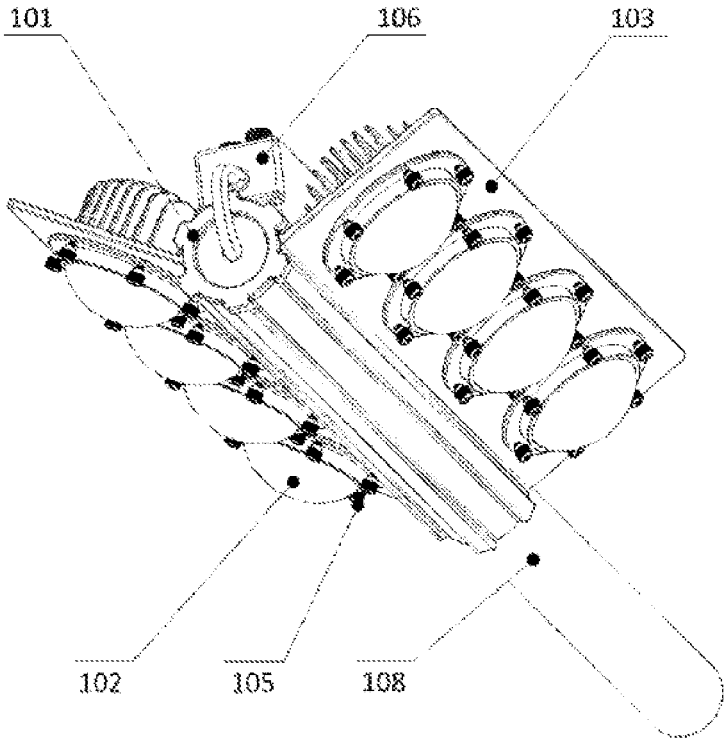
FIG. 61 is a vertical external view of embodiment 5 in the present invention.
Figure 62:
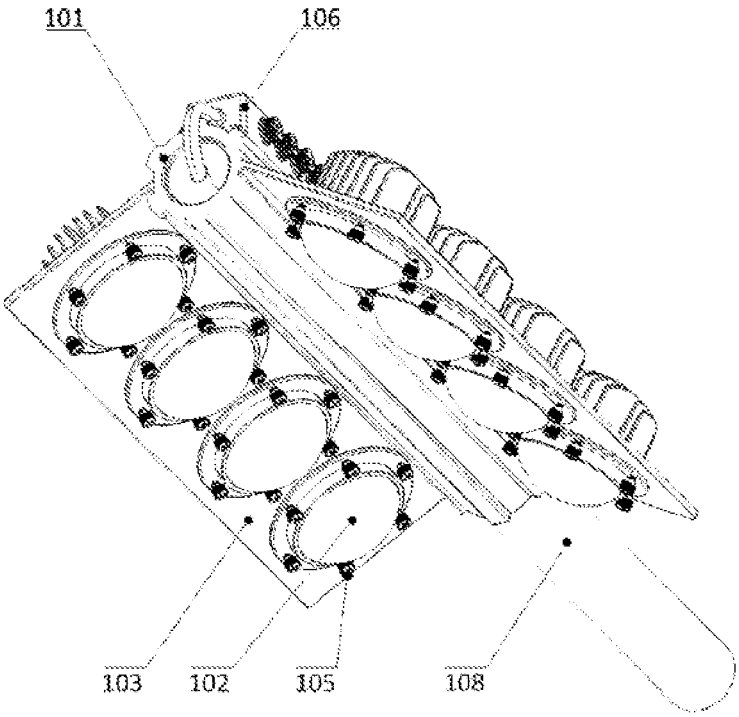
FIG. 62 is a vertical external view when bracket panels are provided downwards to form an included angle in embodiment 5 of the present invention.

In embodiment 2, the multifunctional lamp housing 101 is directly fixed to the lamp post 108 through the lamp post fixing bracket 112, as shown in FIG. 57 and FIG. 58.

The lamp in the embodiment uses the multifunctional lamp housing as the core, the lamp housing is additionally provided with the function of installing the installation interface bracket of the LED bulb, the multifunctional lamp housing provides conditions for the lamp post when providing a supporting surface to the LED bulb, the LED bulb and other auxiliary components are overall collectively installed and fixed to the multifunctional lamp housing, thus the LED street lamp is simple, practical and beautiful. The LED tunnel lamp in the present invention only has two main components, namely the lamp with the multifunctional lamp housing as the core component and the LED bulb, thus the integral structure of the constructed LED tunnel lamp is simple; in the LED tunnel lamp in the present invention, the lamp and the LED bulb do not need to be produced at the same time, and during installation, the lamp and the LED bulb do not need to be installed at the same time either; the lamp and the LED bulb are independently produced and used, thereby greatly reducing the production procedures of the LED lighting products, improving mass production, facilitating standardized mass production, benefiting the industrialization of LED energy-saving lighting products and realizing very high universality and interchangeability.

The meanings of the reference numerals in the embodiment are as follows: 101—multifunctional lamp housing, 102—LED bulb, 103—radiator, 105—bulb fixing screw, 106—wire harness connector, 108—lamp post, 109—lamp post fixing bracket, 110—reinfrocing plate, 111—lamp post fixing bracket bolt, 112—lamp post fixing bracket, 301—bulb installation flange fixing hole, 302—bracket lining rivet hole, 501—bracket lining rivet projection, and 502—power supply or control end welding spot hole.

Embodiment 4

An oval LED street lamp using an installation interface bracket structure, as shown in FIG. 1 and FIG. 14, including an installation interface plate fixing bracket 112, wherein an installation interface plate 103 is provided under the installation interface plate fixing bracket 112, an installation interface is provided on the installation interface plate 103, and an LED bulb 102 is provided on the installation interface; the installation interface plate fixing bracket 112 is connected to a lamp post 108; a lamp housing 101 is provided on the installation interface plate fixing bracket 112, a lampshade 113 is provided outside the installation interface plate 103, and the lamp housing 101 matches with the lampshade 113 to form an oval shape. A wire harness connector 106 is provided on the installation interface plate fixing bracket 112, and the wire harness connector 106 is used for connecting a plurality of LED bulbs 102 to a power supply and a control circuit. The installation interface plate fixing bracket 112 includes a sleeve 116, the sleeve 116 is used for installing the lamp post 108, wire harness connector brackets 107 are provided on two sides of the sleeve 116, and the wire harness connector brackets 107 are used for installing the wire harness connector 106; a ring plate 114 is provided outside the sleeve 116 and the wire harness connector brackets 107, and the ring plate 114 is used for fixedly connecting the installation interface plate 103 to the installation interface plate fixing bracket 112, as shown in FIG. 15. A light penetration hole is provided on the lampshade 113; the installation interface includes a surface in contact with the LED bulb 102 and a hole connected to the LED bulb on the installation interface plate 103. A radiator interface opening and 6 flange fixing holes are provided on the installation interface of the installation interface plate 103, the flange fixing holes are used for fixing the LED bulb 102, and the radiator interface opening is used for enabling the LED bulb 102 to penetrate through the installation interface; the flange fixing holes are uniformly distributed at a diameter D1, and the diameter D1 is a value obtained by subtracting a diameter of a fixing screw cap and then subtracting a margin of 0.8-4 mm from an outer diameter D of the LED bulb 102; the diameter D2 of the radiator interface opening on the installation interface is a value obtained by subtracting two times of a diameter of a fixing screw cap and then subtracting the margin corresponding to the diameter D1 from the outer diameter D of the bulb. The LED bulb 102 is installed on the bulb installation interface through a bulb fixing screw 105, and the lamp post 108 is installed in the sleeve through a lamp post fixing screw 109.

The lamp in the embodiment uses the installation interface plate fixing bracket as the core, the installation interface plate fixing bracket provides an installation interface for the lamp post while providing a supporting interface for the installation interface plate, and the installation interface plate provides an installation interface for the LED bulb. In the present invention, the LED bulb and other auxiliary components are overall collectively installed and fixed to the installation interface plate fixing bracket, thus the LED street lamp is simple, practical and beautiful.

The meanings of the reference numerals in the embodiment are as follows: 101—lamp housing, 102—LED bulb, 103—installation interface plate, 105—bulb fixing screw, 106—wire harness connector, 107—wire harness connector bracket, 108—lamp post, 109—lamp post fixing screw, 112—installation interface plate fixing bracket, 113—lampshade, 114—ring plate, and 116—sleeve.

Embodiment 5

Figure 63:
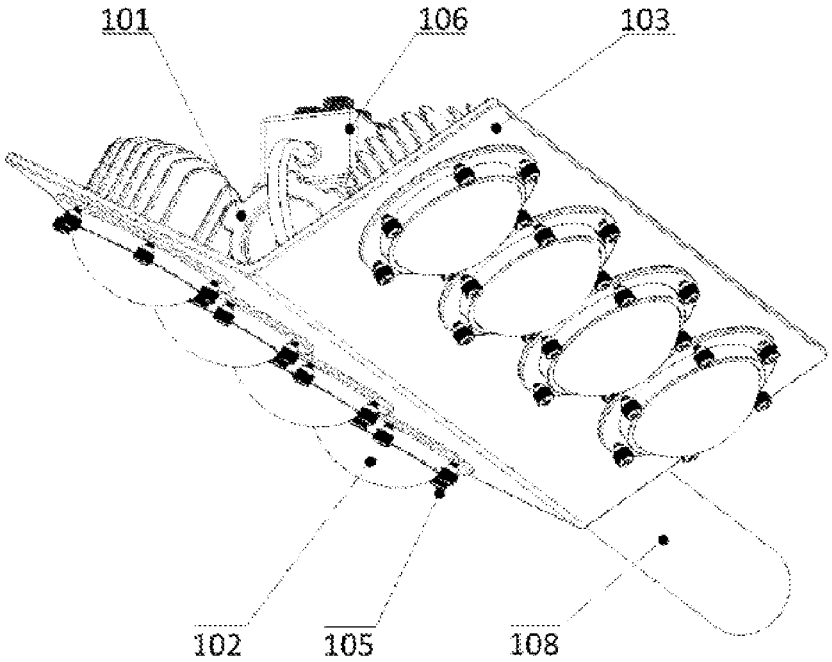
FIG. 63 is a vertical external view when bracket panels are connected and are provided upwards to form an included angle in embodiment 5 of the present invention.
Figure 64:
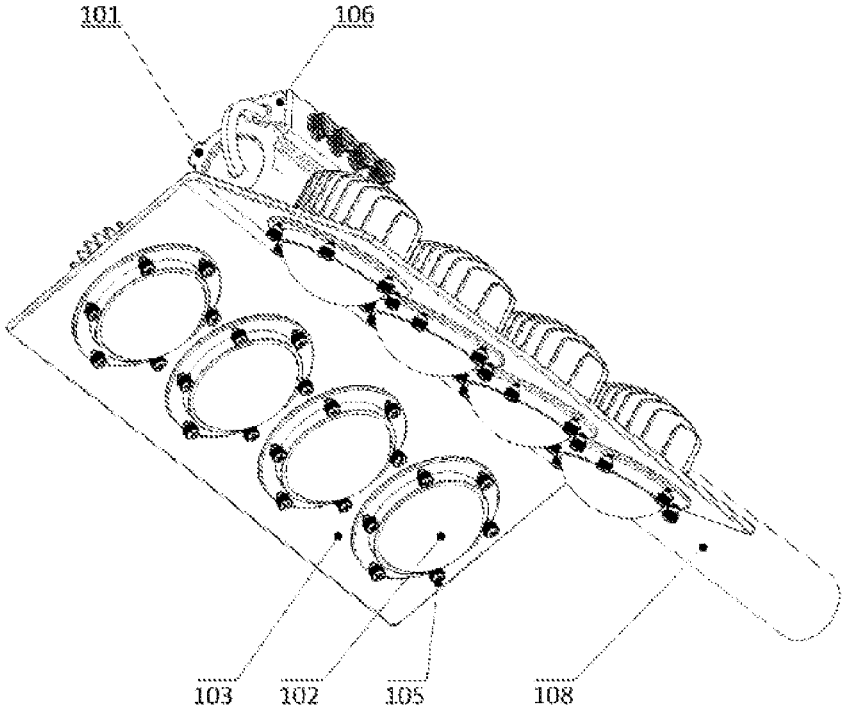
FIG. 64 is a vertical external view when bracket panels are connected and are provided downwards to form an included angle in embodiment 5 of the present invention.
Figure 65:
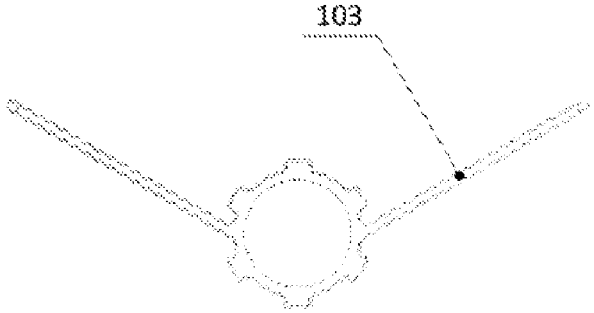
FIG. 65 is a projection drawing of a lamp post fixing bracket in embodiment 5 of the present invention.
Figure 69:
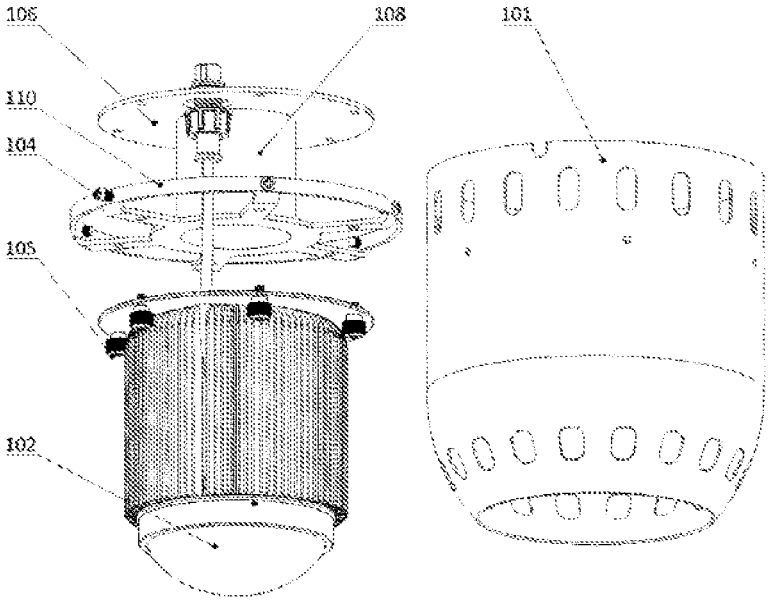
FIG. 69 is a schematic diagram of structures of embodiment 6-1 in the present invention.

An LED street lamp using an extrusion type installation interface bracket structure, as shown in FIG. 63 and FIG. 65, including an extrusion type installation interface bracket 103, wherein the extrusion type installation interface bracket 103 is fixed to a lamp post 108; the extrusion type installation interface bracket 103 includes a lamp post fixing sleeve, bracket panels are provided at the two sides of the lamp post fixing sleeve, and an installation interface used for installing an LED bulb 102 is provided on the bracket panels; the LED bulb 102 with waterproof and dustproof functions and provided with a radiator is installed on the installation interface. The LED street lamp using the extrusion type installation interface bracket structure further includes a wire harness connector 106, wherein the wire harness connector 106 is provided on the lamp post fixing sleeve, and the wire harness connector 106 is used for connecting a plurality of LED bulbs 102 to a power supply and a control circuit. In the extrusion type installation interface bracket 103, the bracket panels at the two sides are provided upwards to form an included angle, as shown in FIG. 69; a lamp post seal head 101 is provided at one end of the lamp post fixing sleeve, and the other end of the lamp post fixing sleeve is fixed to the lamp post 108 through a lamp post fixing screw 109; the installation interface includes a surface in contact with the LED bulb 102 and a hole connected to the LED bulb, on the bracket panels. A radiator interface opening and 6 flange fixing holes are provided on the installation interface, the flange fixing holes are used for fixing the LED bulb 102, and the radiator interface opening is used for enabling the LED bulb 102 to penetrate through the installation interface; the 6 flange fixing holes are uniformly distributed at a diameter D1, and the diameter D1 is a value obtained by subtracting a diameter of a fixing screw cap and then subtracting a margin of 0.8-4 mm from an outer diameter D of the LED bulb 102; the diameter D2 of the radiator interface opening on the installation interface is a value obtained by subtracting two times of a double diameter of a fixing screw cap and then subtracting the margin corresponding to the diameter D1 from the outer diameter D of the bulb. The LED bulb 102 is installed on the installation interface through a bulb fixing screw 105. The wire harness connector 106 is installed on the lamp post fixing sleeve through a wire harness connector bracket and fixing screw 107.

Figure 66:
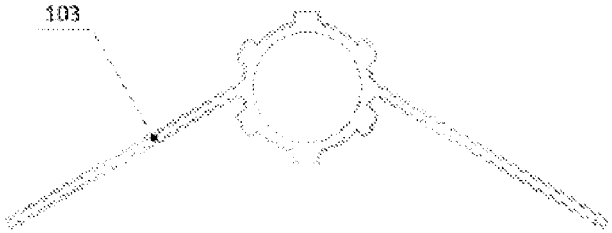
FIG. 66 is a projection drawing of a lamp post fixing bracket when bracket panels are provided downwards to form an included angle in embodiment 5 of the present invention.
Figure 70:
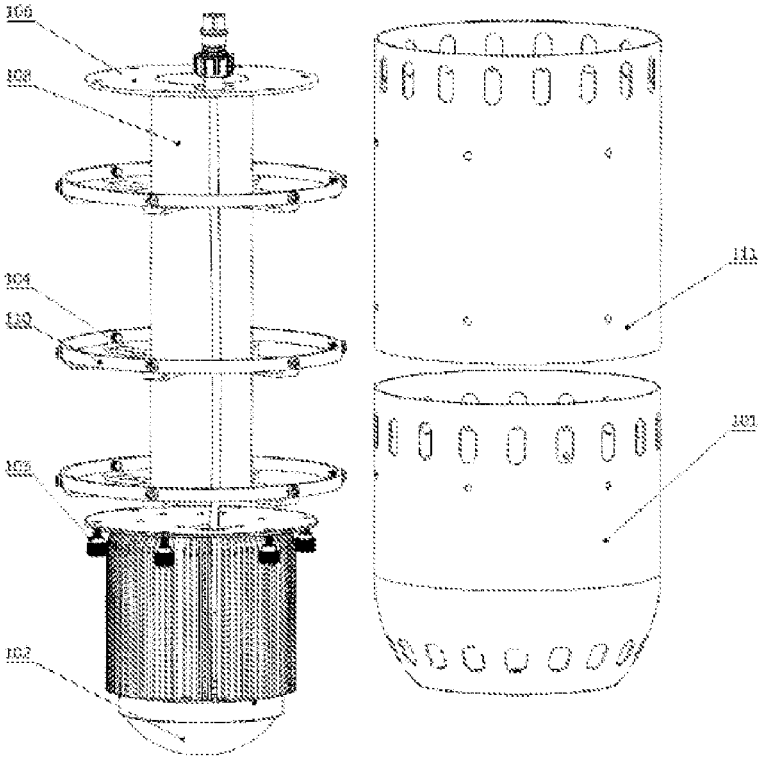
FIG. 70 is a schematic diagram of a structure of an LED lighting lamp using an elongation cover in the present invention.

In the embodiment, the bracket panels may also be provided downwards to form an included angle, as shown in FIG. 66 and FIG. 70.

Figure 67:
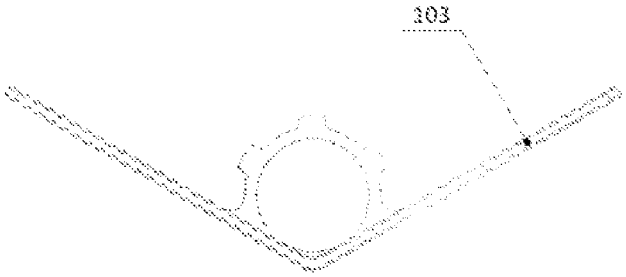
FIG. 67 is a projection drawing of a lamp post fixing bracket when bracket panels are connected and are provided upwards to form an included angle in embodiment 5 of the present invention.
Figure 71:
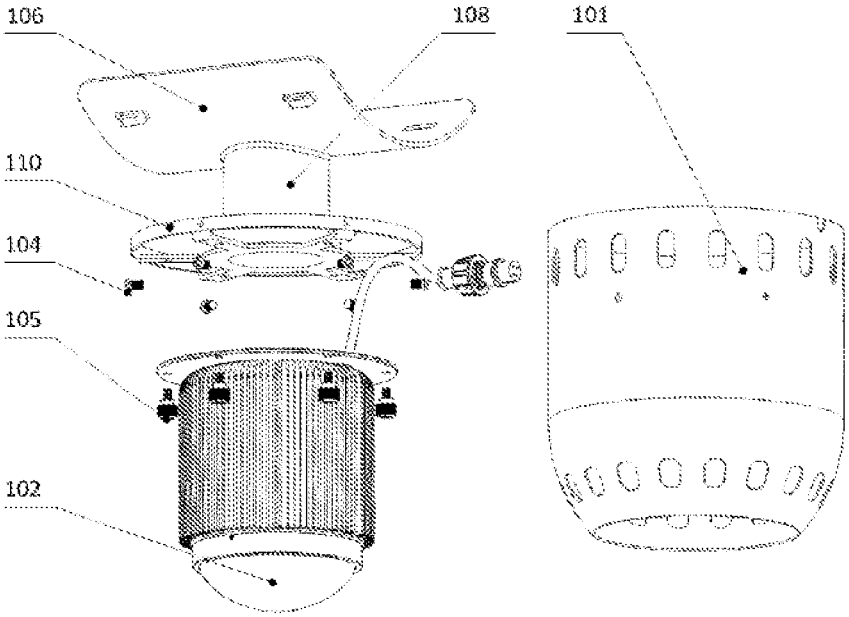
FIG. 71 is a schematic diagram of a structure of a lamp using an arched fixing flange in the present invention.

In the embodiment, the bracket panels may also be connected and provided upwards to form an included angle, as shown in FIG. 67 and FIG. 71.

Figure 68:
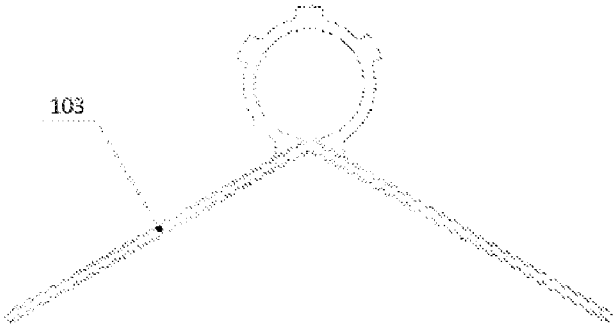
FIG. 68 is a projection drawing of a lamp post fixing bracket when bracket panels are connected and are provided downwards to form an included angle in embodiment 5 of the present invention.
Figure 72:
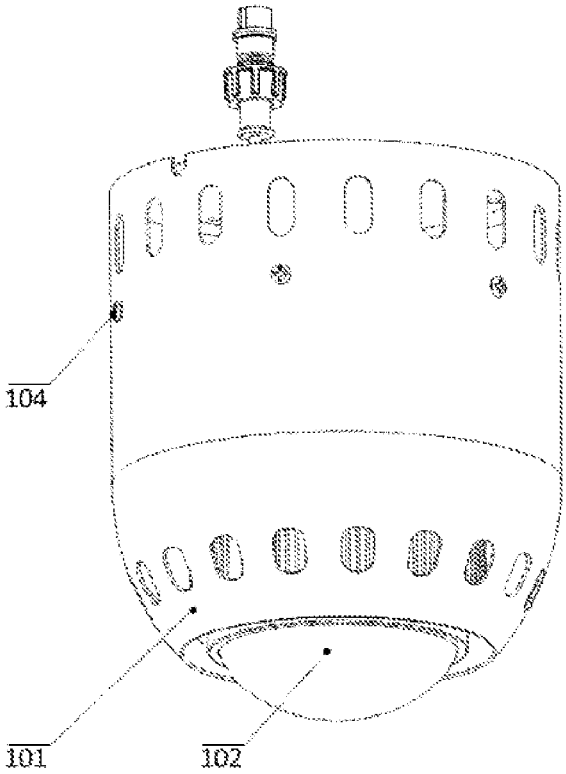
FIG. 72 is an external view of a lamp using a flat fixing flange in the present invention.

In the embodiment, the bracket panels may also be connected and provided downwards to form an included angle, as shown in FIG. 68 and FIG. 72.

In the present invention, in the case of an accident, the bulb may be conveniently maintained and changed just by directly detaching the bulb 102 from the extrusion type installation interface bracket 103, as shown in FIG. 63.

The lamp in the embodiment adopts the extrusion type installation interface bracket as the main component, the bracket panels of the extrusion type installation interface bracket provide installation supporting interfaces for the LED bulb, the LED bulb and other auxiliary components are overall collectively installed on the extrusion type installation interface bracket, thereby being simple in structure, low in manufacturing cost and convenient to install, use and maintain. The extrusion type installation interface bracket performs such functions of the lamp housing as preventing water and preventing dust and the like at the same time.

The meanings of the reference numerals in the embodiment are as follows: 101—lamp post seal head, 102—LED bulb, 103—extrusion type installation interface bracket, 105—bulb fixing screw, 106—wire harness connector, 107—wire harness connector bracket and fixing screw, 108—lamp post, and 109—lamp post fixing screw.

Embodiment 6-1

An LED lighting lamp using an installation interface bracket combined member, including the installation interface bracket combined member, wherein an LED bulb 102 with waterproof and dustproof functions and provided with a radiator is provided on the installation interface bracket combined member; a lamp housing 101 punch-formed by a metal or die-cast by plastics is provided outside the installation interface bracket combined member; the installation interface bracket combined member includes a pipe bracket 108 which is formed by segmenting a standard pipe, a lamp fixing flange 106 and a lamp housing and bulb fixing bracket 110, the pipe bracket 108, the lamp fixing flange 106 and the lamp housing and bulb fixing bracket 110 are connected, an installation interface used for installing the LED bulb 102 is provided on the lamp housing and bulb fixing bracket 110, and the pipe bracket 108 is connected to the lamp fixing flange 106 and the lamp housing and bulb fixing bracket 110; the lamp fixing flange 106 is a flat flange or an arched flange; the lamp housing 101 is connected to the installation interface bracket combined member through the lamp housing and bulb fixing bracket 110. The installation interface includes a surface in contact with the LED bulb 102 and a hole connected to the LED bulb, on the lamp housing and bulb fixing bracket 110; the lamp housing and bulb fixing bracket 110 is punch-formed by a metal, the pipe bracket 108 is connected to the center of the lamp housing and bulb fixing bracket 110, the lamp housing and bulb fixing bracket (110) is engraved to be hollow around its portion connected to the pipe bracket (108), so that passage of a cable and formation of a chimney effect in the lamp housing are facilitated to ensure ventilating and radiating effects, and a screw hole used for installing the lamp housing 101 is provided at the edge of the lamp housing and bulb fixing bracket 110.6 flange fixing holes provided on the installation interface are uniformly distributed at a diameter D1, and the diameter D1 is a value obtained by subtracting a diameter of a fixing screw cap and then subtracting a margin of 0.8-4 mm from an outer diameter D of the LED bulb 102.

Embodiment 6-2

Figure 73:
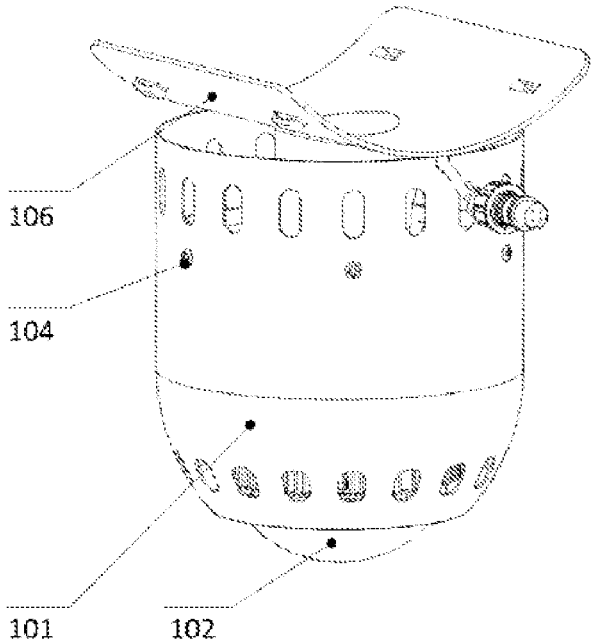
FIG. 73 is an external view of a lamp using an arched fixing flange in the present invention.
Figure 76:
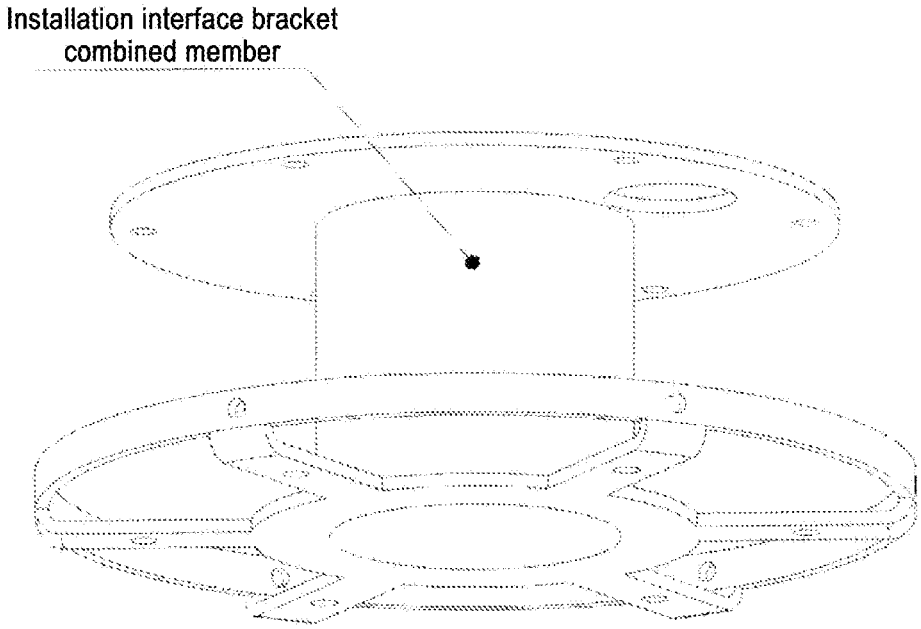
FIG. 76 is a schematic diagram of a structure of an installation interface bracket combined member in the present invention.
Figure 80:
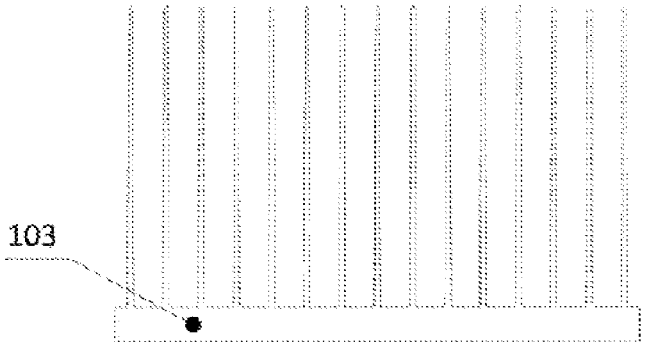
FIG. 80 is a cross-section diagram of an extrusion type radiator in embodiment 7 of the present invention.
Figure 81:
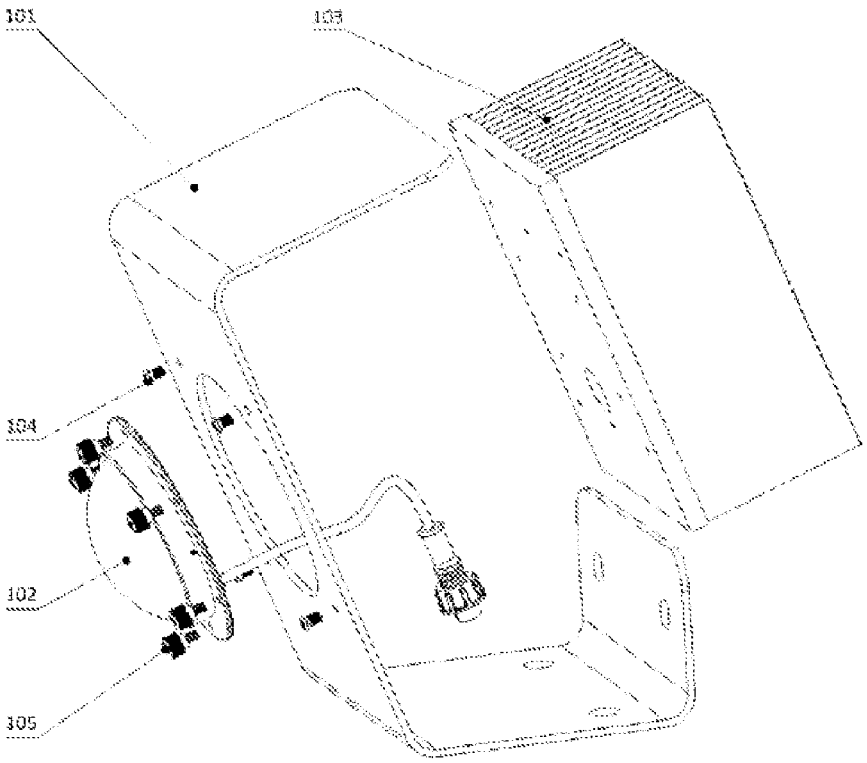
FIG. 81 is a structure diagram when a protection plate is adopted in embodiment 7 of the present invention.

An LED lighting lamp using an installation interface bracket combined member, as shown in FIG. 73 and FIG. 76, includes the installation interface bracket combined member, wherein an LED bulb 102 with waterproof and dustproof functions and provided with a radiator is provided on the installation interface bracket combined member, and a lamp housing 101 punch-formed by a metal or die-cast by plastics is provided outside the installation interface bracket combined member; the installation interface bracket combined member includes a pipe bracket 108 which is formed by segmenting a standard pipe, a lamp fixing flange 106 and a lamp housing and bulb fixing bracket 110, the pipe bracket 108, the lamp fixing flange 106 and the lamp housing and bulb fixing bracket 110 are connected, as shown in FIG. 80, an installation interface used for installing the LED bulb 102 is provided on the lamp housing and bulb fixing bracket 110, and the pipe bracket 108 is connected to the lamp fixing flange 106 and the lamp housing and bulb fixing bracket 110; the lamp fixing flange 106 is a flat flange; the lamp housing 101 is connected to the installation interface bracket combined member through the lamp housing and bulb fixing bracket 110. The installation interface includes a surface in contact with the LED bulb 102 and a hole connected to the LED bulb, on the lamp housing and bulb fixing bracket 110; the LED bulb 102 is installed on the installation interface through a bulb fixing screw 105, the lamp housing and bulb fixing bracket 110 is punch-formed by a metal, the pipe bracket 108 is connected to the center of the lamp housing and bulb fixing bracket 110, the lamp housing and bulb fixing bracket (110) is engraved to be hollow around its portion connected to the pipe bracket (108), so that passage of a cable and formation of a chimney effect in the lamp housing are facilitated to ensure ventilating and radiating effects, and a screw hole used for installing the lamp housing 101 is provided at the edge of the lamp housing and bulb fixing bracket 110. The lamp housing 101 is installed on the lamp housing and bulb fixing bracket 110 through a lamp housing fixing screw group 104.6 flange fixing holes provided on the installation interface are uniformly distributed at a diameter D1, and the diameter D1 is a value obtained by subtracting a diameter of a fixing screw cap and then subtracting a margin of 0.8-4 mm from an outer diameter D of the LED bulb 102.

Figure 75:
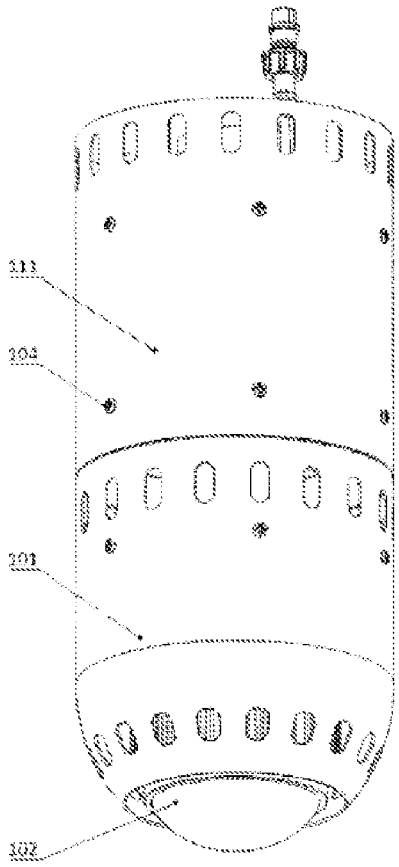
FIG. 75 is an external view of an LED lighting lamp using an elongation cover in the present invention.
Figure 77:
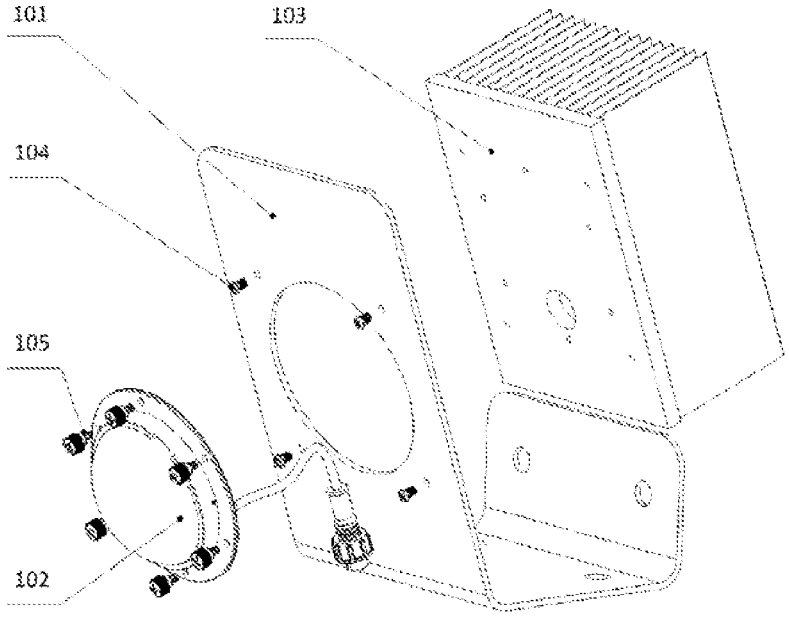
FIG. 77 is a schematic diagram of a structure of embodiment 7 in the present invention.
Figure 78:
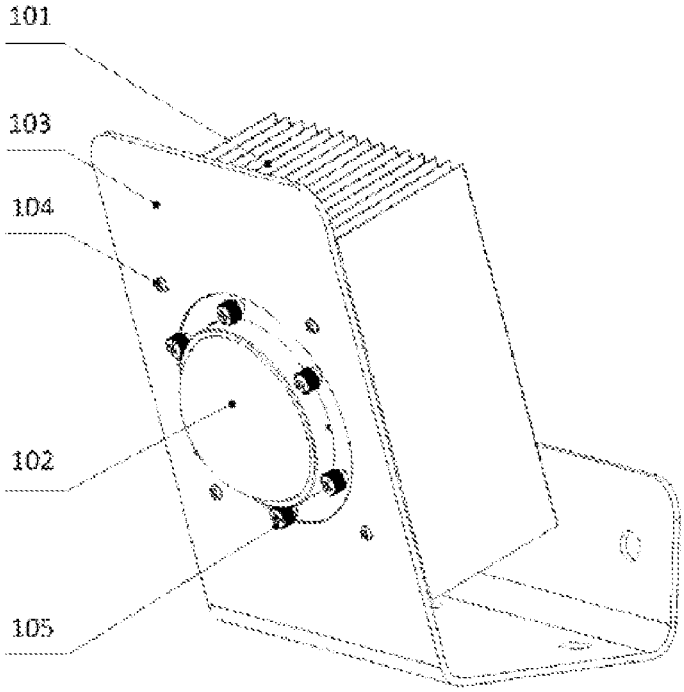
FIG. 78 is an external view of embodiment 7 of the present invention.

In the embodiment, the lamp fixing flange 106 may also be an arched flange, as shown in FIG. 75, FIG. 77 and FIG. 78, which is suitable for being installed on such a round bar or pipe truss structure as a factory building, an airport or the like.

Figure 74:
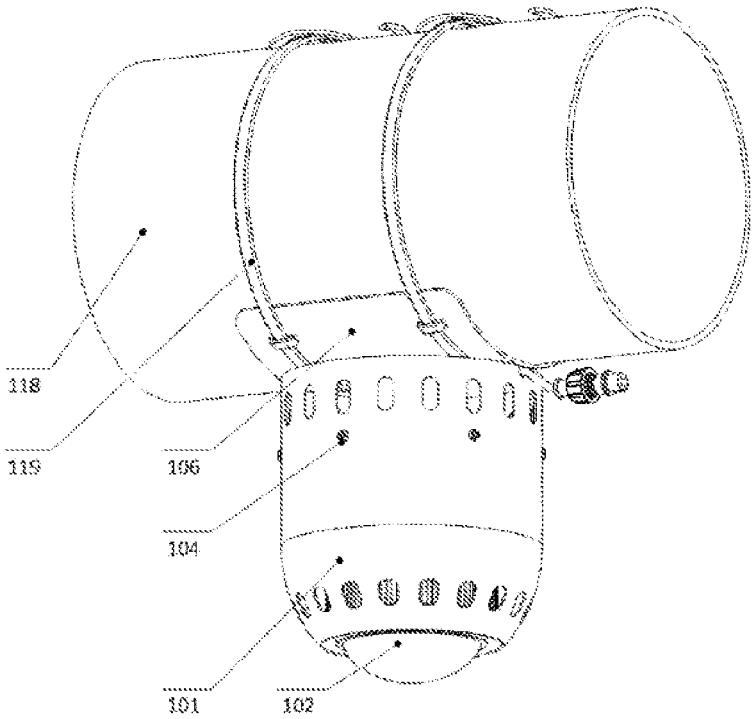
FIG. 74 is a schematic diagram of installing the present invention on a pipe truss structure.
Figure 79:
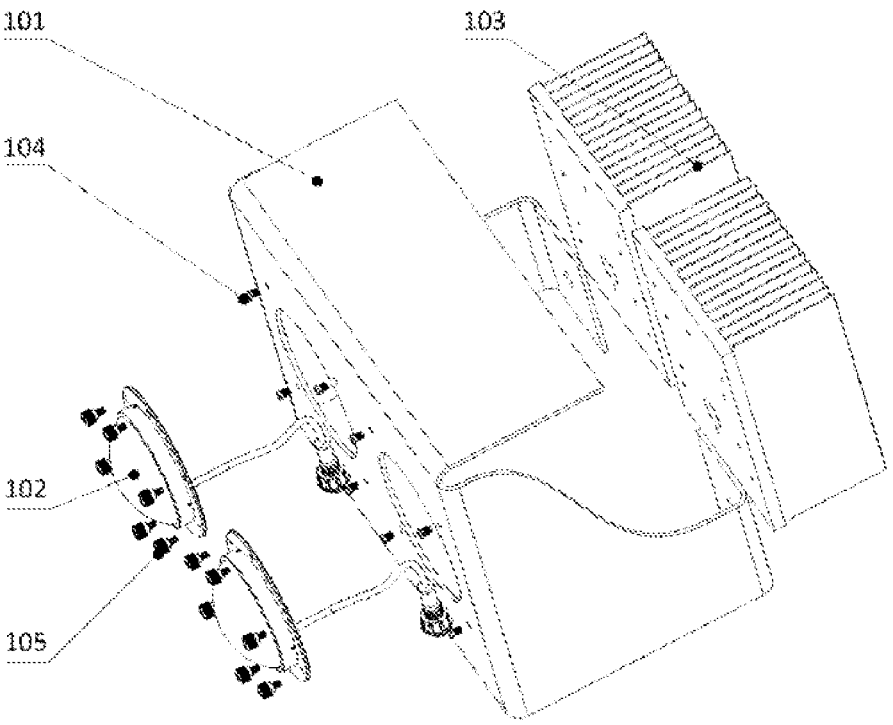
FIG. 79 is a structure diagram when a plurality of LED bulbs, a transverse installation bracket plate and a protection plate are adopted in embodiment 7 of the present invention.

In the embodiment, the lamp housing 101 may also be used with an elongation cover 111, and the elongation cover 111 is also installed on the lamp housing and bulb fixing bracket 110, as shown in FIG. 74 and FIG. 79.

During maintenance, in the present invention, only the lamp housing 101 is detached, as shown in FIG. 73, and the bulb may be conveniently detached and installed, thus the bulb is very convenient to maintain and change.

When the present invention is in use, according to different demands, different lamp fixing flanges 3 are selected to adapt to different installation occasions. When being installed on the pipe truss structure, it is as shown in FIG. 78.

To better present dust, when the present invention is in use, a bulb installation flange fixing hole 301 on the heat conductive bracket 3 may be omitted, and the outer diameter thereof is reduced to be equal to the outer diameter of the lens snap ring 8.

The lamp in the embodiment adopts the installation interface bracket combined member as the installation fixing component, the installation interface bracket combined member provides a supporting interface for the LED bulb, and the lamp housing, the LED bulb and other auxiliary components are overall collectively installed on the bracket combined member, thereby being simple in structure, low in manufacturing cost and convenient to install, use and maintain. The lamp housing and bulb fixing bracket of the lamp in the present invention are hollowed around the portion connected to the pipe bracket, so that passage of a cable and formation of a chimney effect in the lamp housing are facilitated to improve the ventilating and radiating effects. Due to the design features of the lamp in the present invention, the application range of the present invention is wider, when the lamp fixing flange is the flat flange, it may be used in a vertical manner, an upward manner or a ceiling manner, and thus is suitable for being installed on such places as a tunnel top, an airport hall, a factory building, a lawn, a park and the like; when the lamp fixing flange is an arched flange, it may be used on various round bar or pipe truss structures.

The meanings of the reference numerals in the embodiment are as follows: 101—lamp housing, 102—LED bulb, 103—radiator, 104—lamp housing fixing screw group, 105—bulb fixing screw, 106—lamp fixing flange, 108—pipe bracket, 110—lamp housing and bulb fixing bracket, 111—elongation cover, 301—bulb installation flange fixing hole, 302—bracket lining rivet hole, 501—bracket lining rivet projection, and 502—power supply or control end welding spot hole.

Embodiment 7

Figure 82:
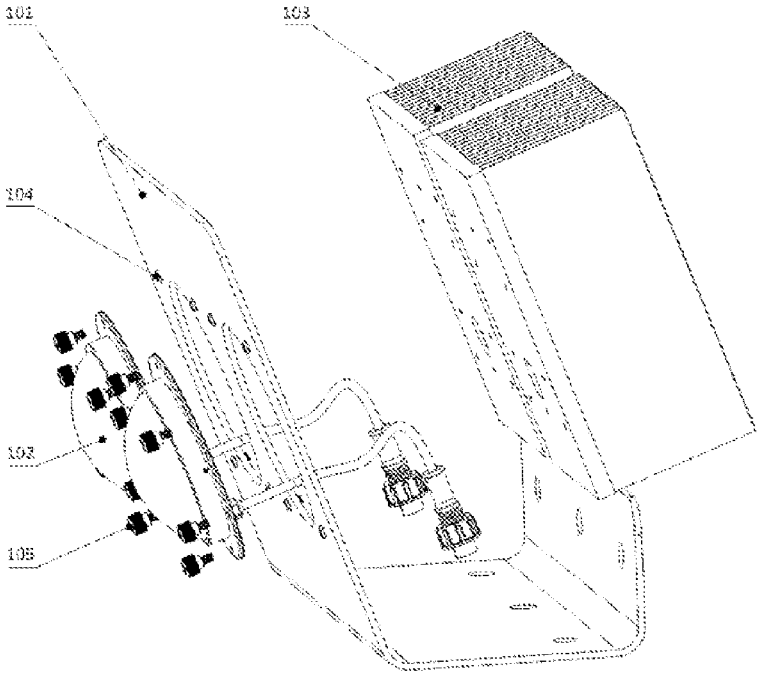
FIG. 82 is a structure diagram when a plurality of LED bulbs are adopted in embodiment 7 of the present invention.
Figure 83:
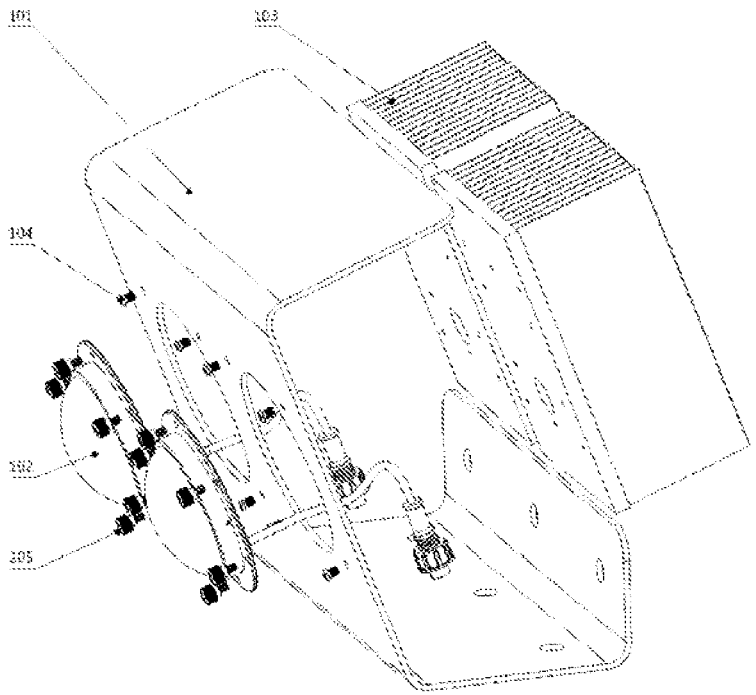
FIG. 83 is a structure diagram when a plurality of LED bulbs and a protection plate are adopted in embodiment 7 of the present invention.
Figure 84:
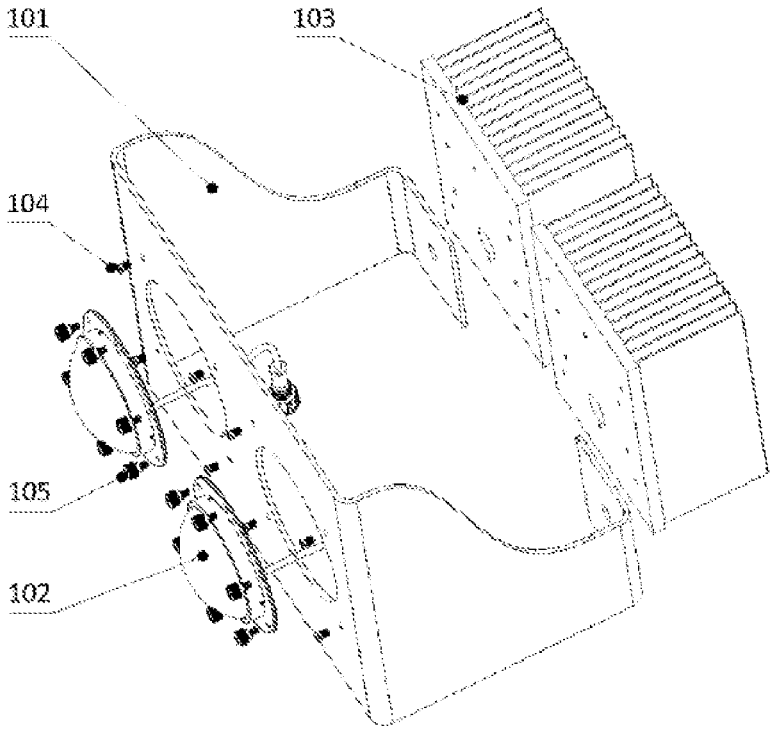
FIG. 84 is a structure diagram when a transverse installation bracket plate is adopted in embodiment 7 of the present invention.
Figure 85:
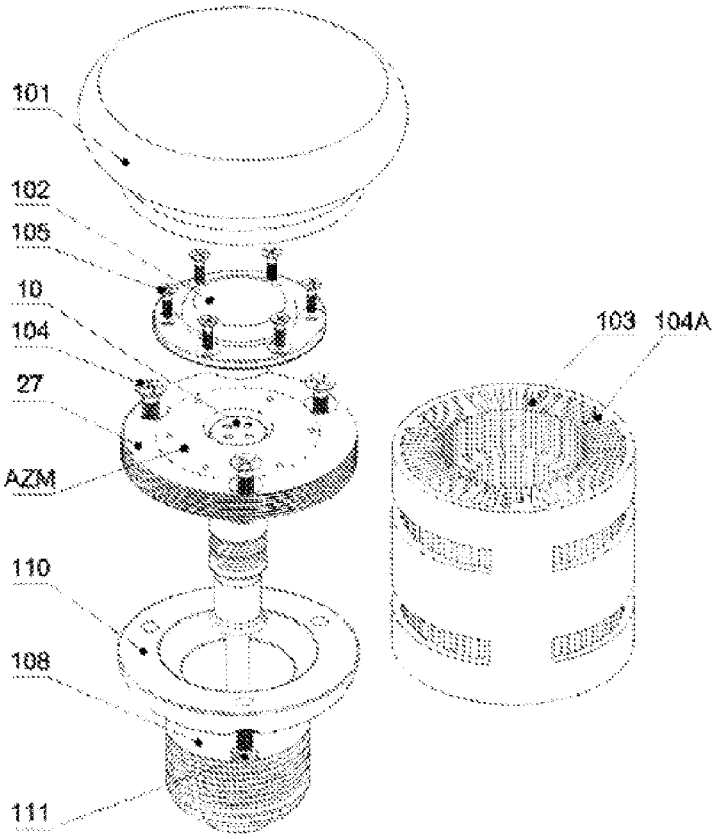
FIG. 85 is a schematic diagram of a structure of an LED screw lamp using a columnar radiator in embodiment 8 of the present invention.
Figure 86:
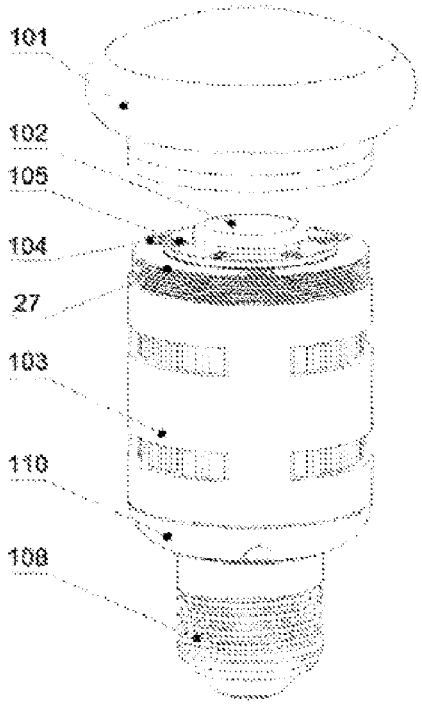
FIG. 86 is a schematic diagram of an outline structure of an LED screw lamp using a columnar radiator in embodiment 8 of the present invention.

An LED tunnel lamp using a lamp housing as an installation interface bracket structure, as shown in FIG. 82 and FIG. 83, including the lamp housing 101 formed by a metal stamping or plastics die casting process, wherein the lamp housing 101 includes an installation interface bracket plate used for installing an extrusion type radiator 103 and a foot screw hole used for fixedly installing the entire LED tunnel lamp; one or more opening used for installing the extrusion type radiator 103 is provided on the installation interface bracket plate, an installation interface is provided on the extrusion type radiator 103, and an LED bulb 102 with waterproof and dustproof functions is provided on the installation interface. The extrusion type radiator 103 includes a substrate, a fin is provided at one side of the substrate, as shown in FIG. 86, and the installation interface used for installing the LED bulb 102 is provided at the other side of the substrate; the installation interface includes a surface in contact with the LED bulb 102 and a hole connected to the LED bulb, on the extrusion type radiator 103.6 flange fixing holes on the installation interface are uniformly distributed at a diameter D1, and the diameter D1 is a value obtained by subtracting a diameter of a fixing screw cap and then subtracting a margin of 0.8-4 mm from an outer diameter D of the LED bulb 102. The LED bulb 102 is installed on the installation interface through a bulb fixing screw 105, and the extrusion type radiator 103 is installed on the lamp housing through a lamp housing fixing screw 104.

Figure 87:
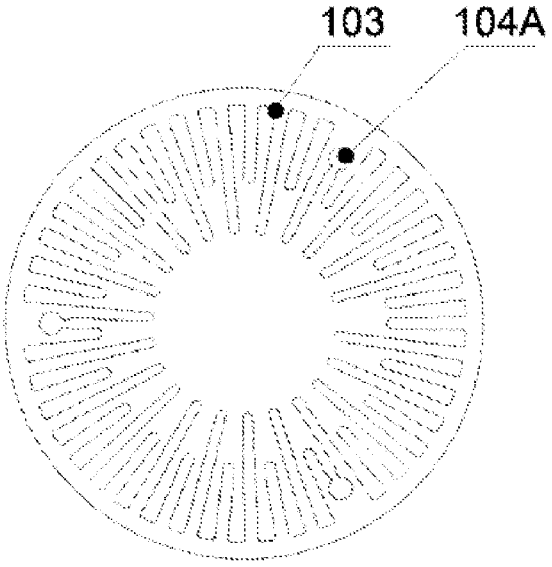
FIG. 87 is a schematic diagram of a sectional structure of the columnar radiator in embodiment 8 of the present invention.

Aiming at particularly severe environments, the lamp housing 101 in the present invention is further provided with a protection plate, as shown in FIG. 87.

Figure 88:
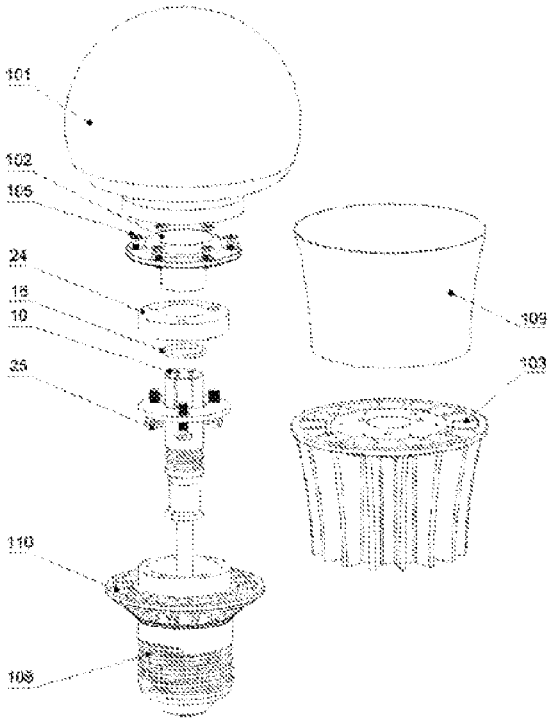
FIG. 88 is a schematic diagram of a structure of an LED screw lamp using a convection radiator in embodiment 8 of the present invention.
Figure 89:
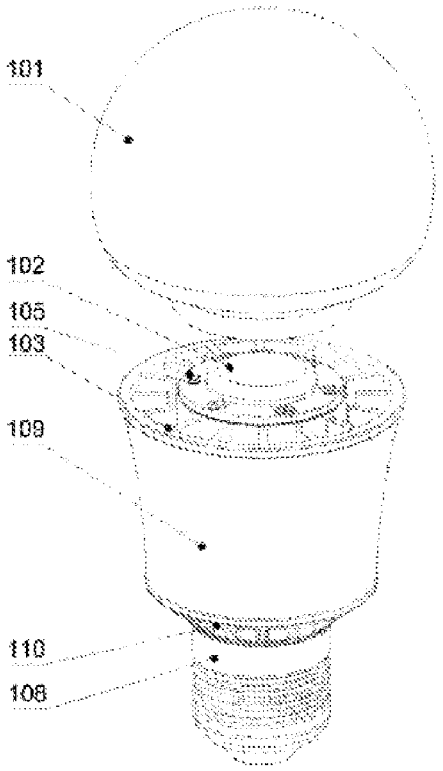
FIG. 89 is a schematic diagram of an outline of an LED screw lamp using the convection radiator in embodiment 8 of the present invention.

Aiming at the use environment with particular requirements on light intensity, a plurality of LED bulbs may also be adopted in the present invention, as shown in FIG. 88 and FIG. 89.

Figure 90:
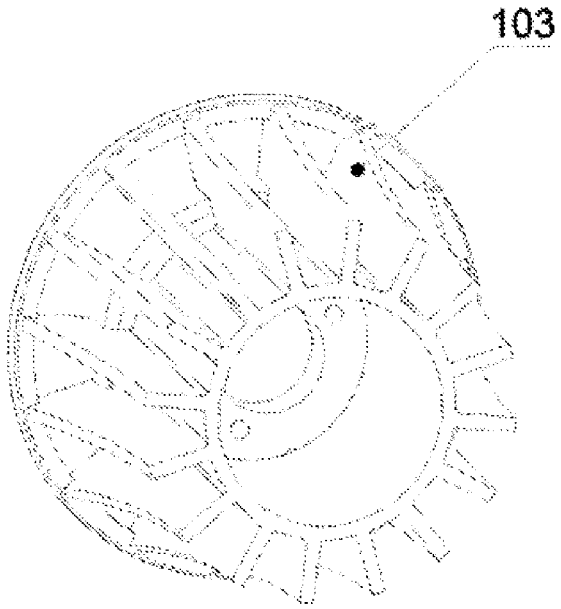
FIG. 90 is a schematic diagram of a structure of the convection radiator in embodiment 8 of the present invention.
Figure 91:
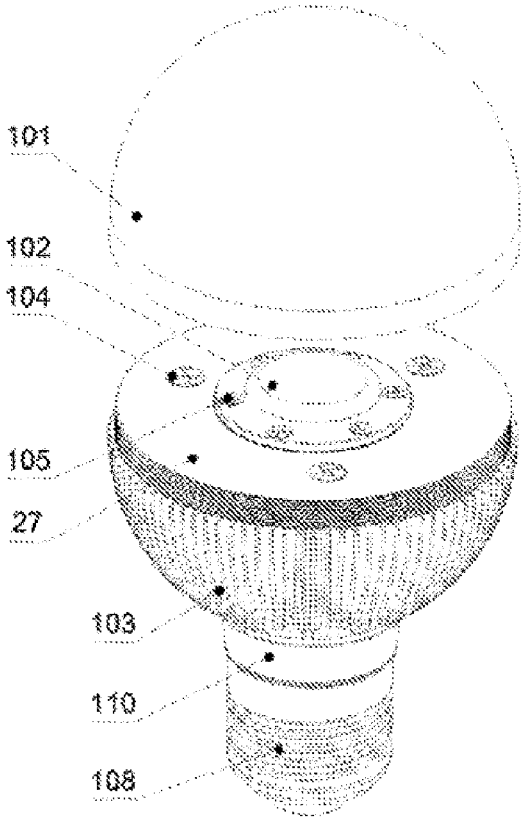
FIG. 91 is a first schematic diagram of an outline of an LED screw lamp using other radiators in embodiment 8 of the present invention.

Aiming at the use environment with particular requirements on vertical ventilation, a transverse installation bracket plate may also be adopted in the present invention, as shown in FIG. 90 and FIG. 91.

The lamp in the embodiment uses the lamp housing as the core, the lamp housing is additionally provided with the function of the original installation interface bracket, the extrusion type radiator, the LED bulb and other auxiliary components are overall collectively installed and fixed to the lamp housing, thus the LED tunnel lamp is simple, practical and beautiful. When the present invention is in use, dust is unlikely to accumulate on the fins of the extrusion type radiator; the LED tunnel lamp has very strong wind resistance, water resistance, dust plug resistance and pest plug resistance, and the LED tunnel lamp in the present invention may operate normally even if in environments with particularly severe dust. The extrusion type radiator of the tunnel lamp in the present invention has a large radiating area, each part of the extrusion type radiator is close to the heat source, so the utilization rate of the radiating metal is very high, nearly each gram of metal becomes the component of the extrusion type radiator, the entire metal dosage is about 50% less than that of the radiator of the traditional LED street lamp, thus the consumption of the metal material is greatly reduced.

The meanings of the reference numerals in the embodiment are as follows: 101—lamp housing, 102—LED bulb, 103—extrusion type radiator, 104—lamp housing fixing screw group, 105—bulb fixing screw, 301—bulb installation flange fixing hole, 302—bracket lining rivet hole, 501—bracket lining rivet projection, and 502—power supply or control end welding spot hole.

Embodiment 8

Figure 92:
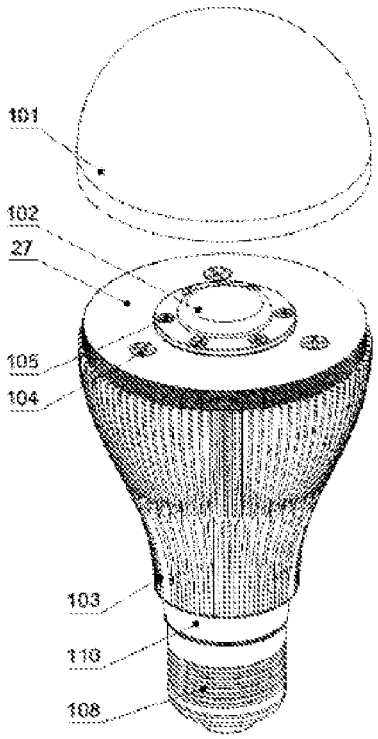
FIG. 92 is a second schematic diagram of an outline of an LED screw lamp using other radiator in embodiment 8 of the present invention.
Figure 93:
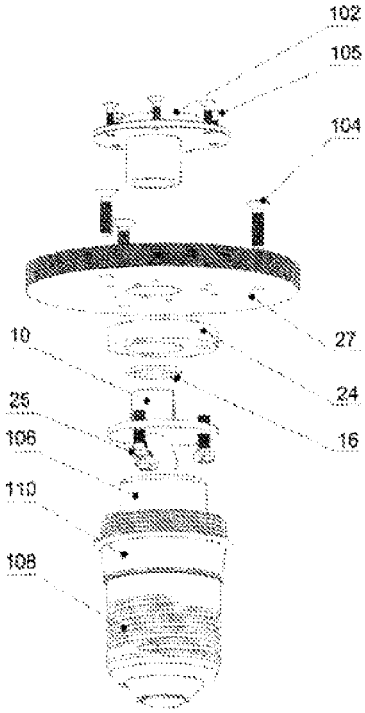
FIG. 93 is a schematic diagram of a structure of an LED screw lamp driven by a conventional power supply in embodiment 8 of the present invention.
Figure 94:
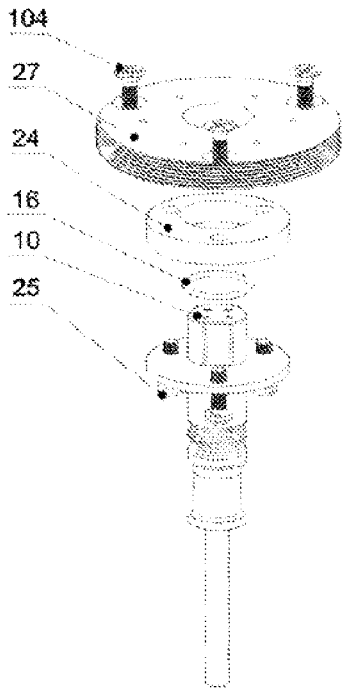
FIG. 94 is a schematic diagram of an installation structure of a connector socket in embodiment 8 of the present invention.
Figure 95:
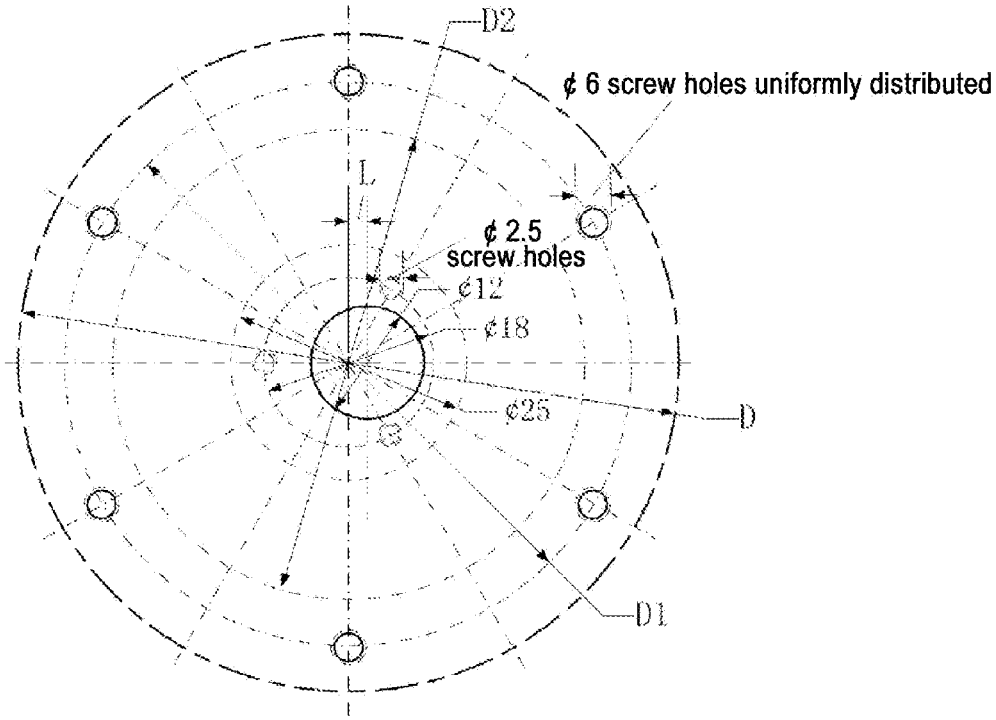
FIG. 95 is a schematic diagram of an installation interface for installing a bulb with outer diameter of 70 mm or less on a lamp in an embodiment of the present invention.

An LED screw lamp, as shown in FIG. 92, includes a screw lamp holder 108, a radiator 103, an LED bulb 102 and a lampshade 101; an intermediate connecting element 110 on the screw lamp holder 108 is connected to the radiator 103 via threads or a lamp holder fixing screw 111 or direct adhesion; the LED bulb 102 is fixedly installed via a bulb fixing screw 105 with the radiator 103 or a heat conductive converting plate 27 (the heat conductive converting plate 27 is fixed in a fixing screw hole 104A on the radiator 103 through a fixing screw 104 for cooperative installation) as an installation interface AZM, and the lampshade 101 is connected to the radiator 103 or the heat conductive converting plate 27 in an adhesion, or threaded connection or clamping manner. The installation interface includes a surface in contact with the LED bulb 102 and a hole connected to the LED bulb on the radiator 103 or the heat conductive converting plate 27. The radiator 103 is a columnar radiator, as shown in FIG. 93 and FIG. 94, the radiator is provided with a radiator substrate thickness inwards at the maximal outer diameter of the cylinder and is provided with fins towards the center of the cylinder in a radial line, 2-3 layers of interrupted grooves are provided on the columnar radiator along an enclosed circular arc with the substrate as thickness, after the radiator is heated, external air naturally flows into the center of the radiator through the interrupted grooves to form convection current, so as to achieve a cooling effect. The radiator 103 may also be a convection radiator, as shown in FIG. 95, FIG. 96 and FIG. 97, the radiator is provided with a radiator substrate thickness outwards from the cylindrical surface (using the outer diameter of a straightly fixed connector socket flange as the diameter) at the center and is provided with fins outwards from the substrate in a radial line radiation manner, and an arched shape is formed on the surface of each fin upwards to gradually increase the open area; the surface of the each fin is covered with a radiator outer cover, and a plurality of through air flow channels are formed between the outer cover and the fins; after the radiator is heated, the air enters from the flow channel opening at the lower end and flows out from the flow channel opening at the higher end, of the radiator to form a chimney effect, in order to achieve air convection to dissipate heat. The screw lamp radiator may also adopt any shape, as long as the fixed connector socket and the installation interface are provided. For example, a sunflower radiator is manufactured into different shapes to obtain different screw lamp outlines, as shown in FIG. 98 and FIG. 99. For the LED solution in which a conventional power supply is adopted for driving, the driving power supply 106 may be provided at the central position between the screw lamp radiator 103 and the lamp holder 108, as shown in FIG. 100. The outer bulb cover 101 may adopt different shapes to obtain different appearance effects, for example, a mushroom head, a candle head, a round head and a flat head. A connector socket 10 is provided on the radiator 103 or the heat conductive converting plate 27, the connector socket 10 is cooperatively connected to a connector plug 11 on the LED bulb, a three-hole flange is provided on the connector socket 10, the connector socket is fixed with the radiator 103 or the heat conductive converting plate 27 through the three-hole flange and a fixing screw 25 of the connector socket, and a fixed adjusting rubber pad 24 is further provided between the flange and the radiator 103 or the heat conductive converting plate 27 to ensure tightness of a waterproof surface; a conducting wire led out from the connector socket is welded on the lamp holder 108. The LED bulb 102 is constructed in the following manner: an optical engine module is adhered at the center of a heat conductive bracket provided with an installation flange; or a nonmetal heat conductive bracket provided with a flange and the optical engine module are integrally made of the same material; the structure between the optical engine module and the heat conductive bracket is simple and smooth, being favorable for the heat dissipation of LED, and the LED bulb is installed on the installation interface through the flange.

The meanings of the reference numerals in the embodiment are as follows: 101—screw lamp housing, 102—LED bulb in the present invention, 103—radiator, 104—fixing screw, 104A—fixing screw hole, 105—bulb fixing screw, 106—driving power supply, 108—screw lamp holder, 109—radiator outer cover, 110—intermediate connecting element, 301—flange fixing hole, and AZM—installation interface.

The invention claimed is:

1. A method for constructing a universal LED bulb, comprising:

establishing an optical engine core member of the LED bulb using a heat conductive bracket with a flange as a structure supporting main body of the bulb, supporting the optical engine core member of the LED bulb in an auxiliary manner using an inner snap ring fixed to the heat conductive bracket, and using the inner snap ring as an installation base of a lens snap ring, wherein the optical engine core member of the LED bulb is composed of the heat conductive bracket, an optical engine module, the inner snap ring and a light distribution optical lens, an inner cover is provided outside the optical engine module, and an electric connector is provided to the heat conductive bracket, and wherein the optical engine module is made up of an optical engine die plate, an LED chip set and a relevant wiring by bonding and packaging, or is further integrated with a power supply drive chip.

2. The method for constructing the universal LED bulb of claim 1, wherein a diameter of the heat conductive bracket is a bulb outer diameter D, the bulb outer diameter D and an upper limit of power W of the constructed LED bulb satisfy a relationship $W=1.1812e^{0.0361D}$, discrete values are selected on the relationship curve $W=1.1812e^{0.0361D}$ to construct a plurality of LED bulbs having fixed bulb outer diameters D in order to improve interchangeability and universality of the LED bulbs; on the relationship curve $W=1.1812e^{0.0361D}$, with 20 mm used as a lower limit and 130 mm used as an upper limit of the bulb outer diameter D, the relationship curve is divided into 12 segments each of which is set to 10 mm to form a limited number of bulb outer diameter specifications, and interchangeability and universality of the LED bulbs are further improved by the small amount of bulb outer diameter specifications; flange fixing holes on the installation flange of the heat conductive bracket are uniformly distributed at a diameter D1, and the diameter D1 is a value obtained by subtracting a diameter of a fixing screw cap and then subtracting a margin of 0.8-4 mm from the bulb outer diameter D; a diameter D2 of a radiator interface opening of the LED bulb on a lamp is a value obtained by subtracting two times of a diameter of the fixing screw cap and then subtracting two times of the margin corresponding to the diameter D1 from the bulb outer diameter D; an installation interface of the LED bulb includes a surface in contact with the LED bulb and a hole connected to the LED bulb, on the lamp.

3. The method for constructing the universal LED bulb of claim 1, wherein a radiator is provided to the heat conductive bracket, and a heat conductive pad is provided between the radiator and the heat conductive bracket; the radiator is a nonmetal radiator assembly, the nonmetal radiator assembly includes a nonmetal radiator and a heat conductive conversion bracket, the nonmetal radiator and the heat conductive conversion bracket are obtained by low temperature extrusion moulding and high temperature sintering of an ultrafine nonmetal heat conductive material, contact surfaces of the nonmetal radiator and the heat conductive conversion bracket are adhered into an integral piece by being coated with a heat conductive adhesive; a rubber sheath or a screw fixing glue is filled in a fixing screw hole of the nonmetal radiator for connecting a fixing screw, and a radiator outer cover is provided outside the nonmetal radiator; the heat conductive conversion bracket is overhead, the nonmetal radiator has a screen mesh structure, and the nonmetal radiator is kept overhead by the heat conductive conversion bracket so that air can enter the screen meshes of the nonmetal radiator from the heat conductive conversion bracket; or the radiator is a metal radiator, the metal radiator has a hollow structure, a foam metal is filled in its hollow part, superconductive liquid is filled in the hollow structure, upper and lower stoppers are pressed by interference fit or screwed by a threaded seal gum into the hollow structure to form a sealed space, and the sealed space is vacuumized; the fixing screw of the radiator penetrates through a fixing through hole on the inner snap ring to be connected to the fixing screw hole of the nonmetal radiator or the metal radiator.

4. The method for constructing the universal LED bulb of claim 1, wherein a connector plug fixing hole is provided to the heat conductive bracket, a connector plug with a contact pin is inserted into the connector plug fixing hole and is fixed with the part inserted into the bulb as a fixed end, a tail end of the contact pin is welded to the optical engine die plate in the universal LED bulb to form a simple electric interface on an outer surface of the universal LED bulb, and during installation, the electric connection of the universal LED bulb is achieved as long as the connector plug is butt jointed with the connector socket with a cable and the universal LED bulb is fixed; an eccentric position of the connector plug fixing hole on the heat conductive bracket and a size of the fixed end of the connector plug are limited such that the optical engine die plate in the LED bulb may meet demands of arranging the LED chip and the power supply drive chip and registering them; the connector plug with the contact pin is of a four-pin structure in which two pins are used for power supply access and the other two pins are used for control access; the fixed end is formed in a nut fixing manner or a fusion ring fixing manner; when the fixed end is formed in the nut fixing manner, a waterproof rubber ring is added between the connector plug and the heat conductive bracket to prevent water; in order to prevent rotation, an antiskid groove is provided in the connector plug, and a corresponding projection is provided at the connector plug fixing hole of the heat conductive bracket; a three-hole flange is provided to the connector socket and is fixed to the radiator of the lamp through a fixing screw, and an adjusting rubber pad is provided between the connector socket and the radiator to adjust its thickness in order to ensure tightness of a waterproof surface; or external threads are provided to the connector plug to match with internal threads of a fixing nut on the connector socket provided with a waterproof rubber ring to prevent water; an slot is provided to the connector socket, and a waterproof rubber ring is provided in the slot to prevent water.

5. A flange inner snap ring type LED bulb comprising a heat conductive bracket (3) with a flange, wherein an optical engine core member of the LED bulb is established using the heat conductive bracket (3) as a structure supporting main body of the bulb, the optical engine core member of the LED bulb is supported in an auxiliary manner using an inner snap ring (81) fixed to the heat conductive bracket (3), and the inner snap ring (81) is used as an installation base of a lens snap ring (8);

wherein a connector plug (11) is provided to the heat conductive bracket (3), at least an optical engine module (4), the inner snap ring (81) and a light distribution optical lens (7) are provided beneath the heat conductive bracket (3) sequentially, the lens snap ring (8) fastens the light distribution optical lens (7), an inner cover (6) is provided outside the optical engine module (4), and in order to prevent accidental drop-off of the lens (7), a lens snap ring fixing screw (14) is provided to fix the lens snap ring (8) to the outer diameter of the inner snap ring (81); and wherein the optical engine module (4) is made up of an optical engine die plate, an LED chip and a relevant wiring by bonding and packaging, or is further integrated with a power supply drive chip.

6. The flange inner snap ring type LED bulb of claim 5, wherein the inner snap ring (81) surrounds the optical engine module (4), or an inner ring cover (62) is further provided between the inner snap ring (81) and the inner cover (6), an upper part of the inner snap ring (81) is connected to the heat conductive bracket (3) and a lower part of the inner snap ring is adhered to the light distribution optical lens (7) so that a sealed waterproof space used for enclosing the optical engine module (4) is formed by the heat conductive bracket (3), the inner snap ring (81) and the light distribution optical lens (7), or the inner snap ring (81) is further used as an installation base of a radiator of the LED bulb; or, the heat conductive bracket (3) and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

7. The flange inner snap ring type LED bulb of claim 5, wherein the heat conductive bracket (3), the optical engine module (4), the inner snap ring (81) and the light distribution optical lens (7) are sequentially overlapped and adhered, or an inner ring cover (62) is further provided between the inner snap ring (81) and the inner cover (6), and the optical engine die plate of the optical engine module (4), the inner snap ring (81) and the light distribution optical lens (7) form a sealed waterproof space used for enclosing components packaged on the optical engine die plate; or, the inner snap ring (81) and the inner cover (6) are formed into the inner cover (68) having a function of the inner snap ring and having an integral structure; or the inner snap ring (81) is further used as an installation base of a radiator of the LED bulb; or the heat conductive bracket (3) and the optical engine die plate are integrally made of the same nonmetal heat conductive material; the optical engine die plate is a metal material heat conductive substrate in which a circuit is obtained by PCB printed circuit board technology; or the optical engine die plate is a nonmetal material heat conductive substrate in which a circuit is embedded by silver paste printed circuit technology.

8. The flange inner snap ring type LED bulb of claim 5, wherein a radiator (103) is provided to the heat conductive bracket (3), and a heat conductive pad (2) is provided between the radiator (103) and the heat conductive bracket (3), the radiator (103) is a nonmetal radiator assembly, the nonmetal radiator assembly includes a screen mesh nonmetal radiator and an overhead heat conductive conversion bracket (1) below the nonmetal radiator, a rubber sheath or a screw fixing glue is filled in a radiator fixing screw hole (33) of the nonmetal radiator for connecting a fixing screw, a radiator outer cover (101) is provided outside the nonmetal radiator; or the radiator (103) is a metal radiator, the metal radiator includes a cooling fin (34), a superconductive liquid cavity is provided in the cooling fin (34), a foam metal (37) and superconductive liquid are filled in the superconductive fluid cavity, an upper stopper (33) and a lower stopper (35) are provided on two ends of the superconductive liquid cavity, and a vacuum suction pipe (32) is provided to the upper stopper (33) or the lower stopper (35); a cable hole (36) used for penetration of a cable and a radiator fixing screw hole (38) are further provided to the radiator (103).

9. The flange inner snap ring type LED bulb of claim 5, wherein only transparent silica gel for package is provided outside the LED chip on the optical engine module (4), the inner cover (6) is provided outside the optical engine module (4) with the transparent silica gel, and fluorescent powder coating is coated on an inner side of the inner cover (6); or, no silica gel is covered on the LED chip on the optical engine module (4), a concave inner cover (61) filled with transparent insulating heat conductive liquid is provided outside the optical engine module (4), the LED chip on the optical engine module (4) is soaked in the transparent insulating heat conductive liquid, fluorescent powder is applied in the transparent insulating heat conductive liquid, and the concave inner cover is an elastic inner cover of a thin concave structure.

10. The flange inner snap ring type LED bulb of claim 5, wherein the electric connector is provided to the heat conductive bracket (3), the electric connector comprises a connector plug (11), a contact pin (17) is provided on the connector plug (11), and a contact pin welding spot (19) on a tail end of the contact pin (17) is welded to the optical engine module (4); after penetrating through a connector plug fixing hole (22) on the universal LED bulb, the connector plug (11) is fixed on a fixed end (15) thereof; the connector plug (11) is cooperatively connected to a connector socket (10) with a jack, and the connector socket (10) is connected to a cable; the contact pin of the electric connector has a four-pin structure in which two pins are used for power supply access and the other two pins are used for control access.

11. The flange inner snap ring type LED bulb of claim 10, wherein the fixed end (15) is a fusion ring or the fixed end (15) is a fixing nut, a waterproof rubber ring slot (18) is further provided to the connector plug (11), and a waterproof rubber ring (16) is provided in the waterproof rubber ring slot (18); in order to prevent rotation, an antiskid groove (26) is provided in the connector plug (11), and a corresponding projection is provided at the connector plug fixing hole of the heat conductive bracket (3); a three-hole flange is provided to the connector socket (10), and the connector socket is fixed to the radiator (103) or a heat conductive converting plate (27) on the lamp through the three-hole flange and a connector socket fixing screw (25), and a fixed adjusting rubber pad (24) is provided between the flange and the radiator (103) or the heat conductive converting plate (27) on the lamp to ensure tightness of a waterproof surface; or the connector plug (11) is provided with external threads to match with internal threads of a fixing nut (28) on the connector socket (10) provided with the waterproof rubber ring (16) so as to be fixed to the connector plug (11); an slot is provided to the connector socket (10), and the waterproof rubber ring (16) is provided in the slot.

12. A lamp using the LED bulb of claim 5, comprising an installation interface, wherein the LED bulb is provided on the installation interface.

13. The lamp of claim 12, wherein the lamp is an LED tunnel lamp, an extrusion type radiator structure is used as the installation interface, the LED tunnel lamp comprises a metal extrusion type radiator (103) formed by an extrusion process, the LED bulb (102) is provided to the extrusion type radiator (103), and a lamp housing (101) punch-formed by a metal or die-cast by plastics is provided outside the extrusion type radiator (103); the extrusion type radiator (103) is installed to an installation support (106), and the installation interface used for installing the LED bulb (102) is provided on the extrusion type radiator (103).

14. The lamp of claim 13, wherein the extrusion type radiator (103) includes a substrate, and fins are provided on one side of the substrate; the installation interface used for installing the LED bulb (102) is provided on the other side of the substrate, a conducting wire bracket (112) is provided on the side of the substrate on which the fins are provided, and the conducting wire bracket (112) is used for connecting a conducting wire led out from the LED bulb to a power supply and a control circuit; the installation interface includes a surface in contact with the LED bulb (102) and a hole connected to the LED bulb, on the extrusion type radiator (103);

wherein the extrusion type radiator (103) is installed to an L-shaped connecting plate (110), the L-shaped connecting plate (110) is fixed to a diversion bracket (108), and the diversion bracket (108) is fixed to the installation support (106), such that the extrusion type radiator (103) may simultaneously adjust its angle in a horizontal direction and a vertical direction.

15. The lamp of claim 12, wherein the lamp is an LED street lamp, a multifunctional lamp housing is used as a bracket structure of the installation interface, the LED street lamp comprises the multifunctional lamp housing (101) punch-formed by a metal sheet via a stamping process, the multifunctional lamp housing (101) is fixed to a lamp post (108) through a lamp post fixing member; one or more installation interfaces used for installing an LED bulb (102) are provided on the multifunctional lamp housing (101), and the LED bulb (102) is installed on the installation interfaces;

wherein a wire harness connector (106) is provided to the multifunctional lamp housing (101), and the wire harness connector (106) is used for connecting a plurality of LED bulbs (102) to a power supply and a control circuit; an edgefold for reinforcing structural strength is further provided at an edge of the multifunctional lamp housing (101); the installation interface includes a surface in contact with the LED bulb (102) and a hole connected to the LED bulb, on the multifunctional lamp housing (101);

wherein the lamp post fixing member includes a lamp post fixing bracket (112), a lamp post fixing bracket bolt (111) and a reinforcing plate (110), the lamp post fixing bracket (112) and the reinforcing plate (110) are provided on upper and lower sides of the multifunctional lamp housing (101) respectively; the multifunctional lamp housing (101) is fixed to the lamp post (108) through the lamp post fixing bracket (112) and the reinforcing plate (110); or the multifunctional lamp housing (101) is directly fixed to the lamp post (108) through the lamp post fixing bracket (112).

16. The lamp of claim 12, wherein the lamp is an oval LED street lamp, the oval LED street lamp comprises an installation interface plate fixing bracket (112), an installation interface plate (103) is provided under the installation interface plate fixing bracket (112), an installation interface is provided on the installation interface plate (103), and the LED bulb (102) is provided on the installation interface; the installation interface plate fixing bracket (112) is connected to a lamp post (108); a lamp housing (101) is provided to the installation interface plate fixing bracket (112), a lampshade (113) is provided outside the installation interface plate (103), and the lamp housing (101) matches with the lampshade (113) to form an oval shape;

wherein a wire harness connector (106) is provided to the installation interface plate fixing bracket (112), and the wire harness connector (106) is used for connecting a plurality of LED bulbs (102) to a power supply and a control circuit;

wherein the installation interface plate fixing bracket (112) comprises a sleeve (116), the sleeve (116) is used for installing the lamp post (108), wire harness connector brackets (107) are provided on two sides of the sleeve (116), and the wire harness connector brackets (107) are used for installing the wire harness connector (106); a ring plate (114) is provided outside the sleeve (116) and the wire harness connector brackets (107), and the ring plate (114) is used for fixedly connecting an installation interface plate (103) to the installation interface plate fixing bracket (112);

wherein a light penetration hole and a water drainage hole are provided to the lampshade (113); the installation interface includes a surface in contact with the LED bulb (102) and a hole connected to the LED bulb, on the installation interface plate (103).

17. The lamp of claim 12, wherein the lamp is an LED street lamp, the LED street lamp comprising a metal extrusion type installation interface bracket (103), the extrusion type installation interface bracket (103) is fixed to a lamp post (108); the extrusion type installation interface bracket (103) includes a lamp post fixing sleeve, bracket panels are provided on two sides of the lamp post fixing sleeve, and an installation interface used for installing the LED bulb (102) is provided on the bracket panels; the LED bulb (102) is installed on the installation interface;

wherein the LED street lamp further comprising a wire harness connector (106), wherein the wire harness connector (106) is provided to the lamp post fixing sleeve, and the wire harness connector (106) is used for connecting a plurality of LED bulbs (102) to a power supply and a control circuit;

wherein in the extrusion type installation interface bracket (103), the bracket panels on the two sides are provided to form an angle; a lamp post seal head (101) is provided on one end of the lamp post fixing sleeve, and the other end of the lamp post fixing sleeve is fixed to the lamp post (108) through a lamp post fixing screw (109); the installation interface includes a surface in contact with the LED bulb (102) and a hole connected to the LED bulb, on the bracket panels.

18. The lamp of claim 12, wherein the lamp is an LED lighting lamp, the LED lighting lamp comprising an installation interface bracket combined member, the LED bulb (102) with a radiator is provided to the installation interface bracket combined member; a lamp housing (101) punch-formed by a metal or die-cast by plastics is provided outside the installation interface bracket combined member; the installation interface bracket combined member includes a pipe bracket (108) which is formed by segmenting a standard pipe, a lamp fixing flange (106) and a lamp housing and bulb fixing bracket (110), the pipe bracket (108), the lamp fixing flange (106) and the lamp housing and bulb fixing bracket (110) are connected, an installation interface used for installing the LED bulb (102) is provided on the lamp housing and bulb fixing bracket (110), and the pipe bracket (108) is connected to the lamp fixing flange (106) and the lamp housing and bulb fixing bracket (110); the lamp fixing flange (106) is a flat flange or an arched flange; the lamp housing (101) is connected to the installation interface bracket combined member through the lamp housing and bulb fixing bracket (110).

19. The lamp of claim 18, wherein the installation interface comprises a surface in contact with the LED bulb (102) and a hole connected to the LED bulb, on the lamp housing and bulb fixing bracket (110); the lamp housing and bulb fixing bracket (110) is punch-formed by a metal, the pipe bracket (108) is connected to a center of the lamp housing and bulb fixing bracket (110), the lamp housing and bulb fixing bracket (110) is engraved to be hollow around its portion connected to the pipe bracket (108), so that passage of a cable and formation of a chimney effect in the lamp housing are facilitated to ensure ventilating and radiating effects, and a screw hole used for installing the lamp housing (101) is provided at an edge of the lamp housing and bulb fixing bracket (110);

wherein a lamp housing is used as a bracket structure of an installation interface, the LED tunnel lamp comprises the lamp housing (101) formed by a metal stamping or plastics die casting process, the lamp housing (101) includes an installation interface bracket plate used for installing an extrusion type radiator (103) and a foot screw hole used for fixedly installing the entire LED tunnel lamp; one or more openings used for installing the extrusion type radiator (103) is provided to the installation interface bracket plate, an installation interface is provided on the extrusion type radiator (103), and the LED bulb (102) is provided on the installation interface;

wherein the extrusion type radiator (103) includes a substrate, and a fin is provided on one side of the substrate; the installation interface used for installing the LED bulb (102) is provided on the other side of the substrate; the installation interface includes a surface in contact with the LED bulb (102) and a hole connected to the LED bulb, on the extrusion type radiator (103).

20. The lamp of claim 12, wherein the lamp is an LED screw lamp, an installation interface is provided on a radiator (103) of the LED screw lamp or on a heat conductive converting plate (27) connected to the top of the radiator (103) to fixedly install the LED bulb (102), and the lampshade (101) of the LED screw lamp is connected to the radiator (103) or the heat conductive converting plate (27) by adhesion or threaded connection or clamping; the installation interface includes a surface in contact with the LED bulb (102) and a hole connected to the LED bulb, on the radiator (103) or the heat conductive converting plate (27).

21. The lamp of claim 20, wherein the LED screw lamp includes a screw lamp holder (108), an intermediate connecting element (110), the radiator (103), the lampshade (101), or further includes a driving power supply (106) provided in the screw lamp holder (108); the electric connector assembly is provided at a position where the LED bulb (102) and the LED screw lamp are connected; the intermediate connecting element (110) on the screw lamp holder (108) is connected to the radiator (103) through threads or a lamp holder fixing screw (111) or direct adhesion; or the heat conductive converting plate (27) is further provided to the radiator (103);

wherein the electric connector assembly includes a connector socket (10), a fixing screw (25) and an adjusting rubber pad (24); the connector socket (10) is cooperatively connected to a connector plug (11) on the LED bulb, a three-hole flange is provided to the connector socket (10), the connector socket is fixed to the radiator (103) or the heat conductive converting plate (27) through the three-hole flange and the fixing screw (25) of the connector socket, and a fixed adjusting rubber pad (24) is further provided between the flange and the radiator (103) or the heat conductive converting plate (27) to ensure tightness of a waterproof surface; a conducting wire led out from the connector socket is welded to the lamp holder (108);

wherein the radiator (103) is a columnar radiator, the radiator has a radiator substrate thickness provided inwards from the maximal outer diameter of the cylinder and is provided with fins formed towards a center of the cylinder in a radial line, 2-3 layers of interrupted grooves are provided to the columnar radiator along an enclosed circular arc with the substrate as thickness, and after the radiator is heated, external air naturally flows into the center of the radiator through the interrupted grooves to form convection so as to achieve a cooling effect;

or the radiator (103) is a convection radiator, the radiator has a radiator substrate thickness provided outwards from the cylindrical surface at the center and is provided with fins formed outwards from the substrate in a radial line, and an arched shape is formed on a surface of each fin to gradually increase an open area; the surface of the each fin is covered with a radiator outer cover, and a plurality of through air flow channels are formed between the outer cover and the fins; after the radiator is heated, air enters the radiator from a flow channel on a lower end and flows out of the radiator from a flow channel on a higher end to form a chimney effect, in order to achieve air convection for heat dissipation.

* * * * *